US011064816B2

(12) United States Patent
Sun

(10) Patent No.: US 11,064,816 B2
(45) Date of Patent: Jul. 20, 2021

(54) DISCRETE GRAVITY FEED MERCHANDISE ADVANCEMENT SEATS AND ASSEMBLY COMBINATIONS

(71) Applicant: SUNGAL CORPORATION, Westport, CT (US)

(72) Inventor: Yeyang Sun, Westport, CT (US)

(73) Assignee: SUNGAL CORPORATION, Westport, CT (US)

( * ) Notice: Subject to any disclaimer, the term of this patent is extended or adjusted under 35 U.S.C. 154(b) by 0 days.

(21) Appl. No.: 15/789,319

(22) Filed: Oct. 20, 2017

(65) Prior Publication Data

US 2018/0110345 A1 Apr. 26, 2018

Related U.S. Application Data

(60) Provisional application No. 62/552,087, filed on Aug. 30, 2017, provisional application No. 62/476,210,
(Continued)

(51) Int. Cl.
*A47F 1/12* (2006.01)
*A47B 57/40* (2006.01)
(Continued)

(52) U.S. Cl.
CPC ..... *A47F 1/12* (2013.01); *A47B 57/406* (2013.01); *A47F 5/005* (2013.01); *A47F 5/103* (2013.01); *A47F 5/105* (2013.01)

(58) Field of Classification Search
CPC .. A47F 1/12; A47F 1/125; A47F 1/126; A47F 5/005; A47F 5/103; A47F 5/105; A47B 57/406
See application file for complete search history.

(56) References Cited

U.S. PATENT DOCUMENTS 5,069,349 A * 12/1991 Wear ..... A47F 1/126 211/59.3
5,788,090 A * 8/1998 Kajiwara ..... A47F 7/28 211/151
(Continued)

FOREIGN PATENT DOCUMENTS

EP 2944228 A1 * 11/2015 ..... A47F 1/12
FR 2942590 A1 * 9/2010 ..... A47F 1/126
(Continued)

OTHER PUBLICATIONS

International Preliminary Report on Patentability dated Feb. 1, 2019 from corresponding International PCT Application PCT/US2017/057598, 8 pages.
(Continued)

*Primary Examiner* — Stanton L Krycinski
(74) *Attorney, Agent, or Firm* — Ohlandt, Greeley, Ruggiero & Perle, L.L.P.

(57) ABSTRACT

Disclosed are discrete gravity feed merchandise-advancement seats for use on a shelf support. The seats have a width having two sides and a length, a merchandise-advancement mechanism retention element disposed on each side along the length, and a merchandise-advancement mechanism disposed in retention elements. A driver is disposed in combination with the seat. A guide channel on each side of the driver surrounds the two retention elements so that the driver can traverse the length of the seat, and provide vertical and horizontal stability to the driver. The seats may have attachment mechanisms on front and rear edges that attach to mating attachment mechanisms proximal the front and rear of the shelf support. Dividers cooperate with the seats to provide merchandise display channels. Attachment mechanisms disposed proximal the front and rear of the
(Continued)

shelf support allow for adjustable lateral placement of the seats and dividers.

19 Claims, 52 Drawing Sheets

Related U.S. Application Data filed on Mar. 24, 2017, provisional application No. 62/460,208, filed on Feb. 17, 2017, provisional application No. 62/411,087, filed on Oct. 21, 2016.

(51) Int. Cl.
*A47F 5/00* (2006.01)
*A47F 5/10* (2006.01)

(56) References Cited

U.S. PATENT DOCUMENTS

| | | | | |
|---|---|---|---|---|
| 6,089,385 | A * | 7/2000 | Nozawa | A47F 7/28 193/35 R |
| 6,332,547 | B1 * | 12/2001 | Shaw | A47F 1/12 211/59.2 |
| 6,409,026 | B2 * | 6/2002 | Watanabe | A47F 1/12 211/59.2 |
| 6,497,326 | B1 * | 12/2002 | Osawa | A47F 7/28 211/59.2 |
| 7,114,606 | B2 * | 10/2006 | Shaw | B65G 1/023 193/35 R |
| 7,497,342 | B2 * | 3/2009 | Hardy | A47F 1/126 211/151 |
| 7,628,282 | B2 * | 12/2009 | Hardy | A47F 1/126 211/151 |
| 8,276,772 | B2 * | 10/2012 | Kim | A47F 1/12 211/151 |
| 8,376,154 | B2 * | 2/2013 | Sun | A47F 1/125 193/35 J |
| 8,573,379 | B2 * | 11/2013 | Brugmann | A47F 1/125 193/35 C |
| 8,596,443 | B2 * | 12/2013 | Brugmann | A47F 5/0093 193/35 R |
| 8,662,325 | B2 * | 3/2014 | Davis | A47B 57/585 211/151 |
| 9,016,482 | B2 * | 4/2015 | Kim | A47F 1/126 211/59.2 |
| 9,016,483 | B2 * | 4/2015 | Howley | A47F 1/126 211/59.3 |
| 9,038,804 | B1 * | 5/2015 | Nickell | B65G 13/11 193/35 R |
| 9,173,504 | B2 * | 11/2015 | Hardy | A47F 1/126 |
| 9,220,353 | B2 * | 12/2015 | Brugmann | B65G 1/023 |
| 9,266,678 | B2 * | 2/2016 | Nickell | B65G 13/11 |
| 9,375,098 | B2 * | 6/2016 | Sun | A47F 1/126 |
| 9,549,622 | B2 * | 1/2017 | Leahy | A47F 5/005 |
| 10,064,500 | B2 * | 9/2018 | Furui | A47F 1/12 |
| 10,159,359 | B2 * | 12/2018 | Borg | A47F 1/12 |
| 10,251,493 | B2 * | 4/2019 | Kim | A47F 1/12 |
| 2007/0187344 | A1 * | 8/2007 | Mueller | A47F 1/126 211/59.3 |
| 2010/0078402 | A1 | 4/2010 | Davis et al. | |
| 2010/0133214 | A1 * | 6/2010 | Evans | A47B 31/00 211/85.8 |
| 2010/0133219 | A1 | 6/2010 | Sun | |
| 2010/0206829 | A1 * | 8/2010 | Clements | A47F 1/12 211/162 |
| 2011/0174750 | A1 | 7/2011 | Poulokefalos | |
| 2011/0204012 | A1 * | 8/2011 | Eguchi | A47F 1/12 211/85.8 |
| 2012/0118840 | A1 | 5/2012 | Howley | |
| 2012/0217212 | A1 * | 8/2012 | Czalkiewicz | A47F 1/12 211/59.2 |
| 2012/0285916 | A1 * | 11/2012 | O'Quinn | A47B 96/021 211/151 |
| 2013/0200026 | A1 | 8/2013 | Bryson et al. | |
| 2014/0299560 | A1 | 10/2014 | Kim | |
| 2015/0359358 | A1 | 12/2015 | Miller, Jr. et al. | |
| 2018/0042401 | A1 * | 2/2018 | Sun | A47F 5/005 |
| 2018/0360236 | A1 * | 12/2018 | Kim | A47F 1/12 |

FOREIGN PATENT DOCUMENTS

| | | | | |
|---|---|---|---|---|
| FR | 3032872 | A1 * | 8/2016 | A47F 1/12 |
| FR | 3032872 | B1 * | 9/2017 | |
| GB | 2522779 | A * | 8/2015 | A47F 1/126 |
| JP | 2011115479 | A * | 6/2011 | A47F 1/12 |
| WO | WO-9930597 | A1 * | 6/1999 | A47F 1/12 |
| WO | WO-2015154067 | A1 * | 10/2015 | A47F 1/126 |

OTHER PUBLICATIONS

International Search Report dated Feb. 22, 2018 from corresponding International PCT Application PCT/US2017/057598, 5 pages.

Written Opinion dated Feb. 22, 2018 from corresponding International PCT Application PCT/US2017/057598, 10 pages.

* cited by examiner

100

105
110
130
180
181
182
183
184
191
192
195
196
197
220
221
222
223
224
225
230
231
D 120
130
A
105
140
120
130
121
120
130
132
B
131
110
182
133
181
180
B
184
510
133
520
530
481
B
130
131
480
530
120
182
510
133
520

522
510
521
520
540
560
531
522
550
481
531
490
131
480
510

140
B
120
130
180

110
420
610
650
660
182
181
620

600
130
180
A
A
120
130
190
120
140

630
640
620
184
640
630
620
610
184
450
120

A
B
110
120
130
140
181
410
420
430
440
610
620
650
660
710
720
730
740
750
760

170
840
830
1120
150
1120
130
810
B
840
830
1120
1110
150
1120
130
810
1100
1110
170
A 430
440
810
820
1140
1150
1110
1130
1111
1142
1122
1121

481
870
1160
1130
1040
1128
430
1140
1110
1111
1126
1127
1124
1122
1123
1125

440
1160
1127
1128
1124
1126
430
1140
1110
1123
1111
1125
1121
1122

1320
1810
1320
1633
1632
1632
1633

1633
1632
1632
1633
1710
1810
1810

1710
1940
B
1821
1820
1840
1830
1940
1320

DISCRETE GRAVITY FEED MERCHANDISE ADVANCEMENT SEATS AND ASSEMBLY COMBINATIONS

CROSS-REFERENCED APPLICATION

This application claims priority to U.S. Provisional Patent Application Ser. No.: 62/411,087, filed Oct. 21, 2016, to U.S. Provisional Patent Application Ser. No.: 62/460,208, filed Feb. 17, 2017, to U.S. Provisional Patent Application Ser. No.: 62/476,210, filed Mar. 24, 2017, and to U.S. Provisional Patent Application Ser. No.: 62/552,087, filed Aug. 30, 2017, the subject matters of which are incorporated herein in their entirety as if fully set forth verbatim herein.

BACKGROUND

1. Field of the Disclosure

The present disclosure relates generally to discrete gravity feed merchandise advancement seats as a mechanism for moving an item thereon via gravity, and methods for assembling the same. The present disclosure also relates to systems comprised of the discrete gravity feed merchandise advancement seats. The merchandise advancement seats and systems of the present disclosure can satisfy up to 80% of the existing needs for merchandise displayed on shelving, including for small to big, low to tall, thin to thick, single to multi-packs cases, boxed, canned and bottled, lightweight to heady duty, regular to complex shapes, standard to custom, and dry to refrigerated packages. Shelving systems on which the disclosed merchandise advancement seats can be used include display systems, gondola systems, rack systems, open air cooler systems, in-door cooler systems, whether on solid shelves or wire shelves. As such, the merchandise advancement seats and systems of the present disclosure provide capability and versatility for more than 80% of shelving needs. This "One-For-All" device has been looked for by industry since the gondola or rack shelving systems have become established. Moreover, the present disclosure related provides a large step as compared to standard devices, and can adapt to e-commerce, i.e., smart and/or artificial intelligent (AI) shelving systems allow for less staff or no-staff service combined with the state-of-the-art technologies such as chips, IOT, mobile devices and cloud environments.

More particularly, the present disclosure relates to discrete gravity feed merchandise advancement seats that comprise roller seats having rollers disposed therein or thereon, or gliding seats that have gliding mechanisms disposed therein or thereon, that can be designed and configured to be combined in any array of the discrete gravity feed merchandise advancement seats for any width or depth of existing or new shelf installations. As a result, the discrete gravity feed merchandise advancement seats provide flexibility in configuring a shelving installation to accommodate any arrangement of any type of packaging without needing to reconfigure the shelving installation. These gravity feed merchandise-advancement seats and systems have a surface configured to accept merchandise disposed thereon and provide a surface that allows the merchandise to advance by gravity, usually along shelf having a declined angle. The present disclosure also provides mechanisms to add declined angles to existing flat shelving systems.

2. Description of Related Art

Items, such as medicines, first aid items and health and beauty items packaged in boxes or bottles, and general merchandise such as coffee mugs, may be displayed in rows on a shelf having a mechanism that advances the items so that when one of the items is removed, another of the items is advanced and remains displayed. One such state-of-the-art configuration is a spring-pusher system that includes a spring-loaded pusher member. When an item within a row is removed, the spring-loaded pusher member urges the remaining items forward so that another item moves to the position of the removed item. Undesirably however, the force of the spring-loaded pusher member on the items often makes it difficult to remove the item from the front of the row and/or to insert items into the row (either by restocking or by a customer who has changed her/his mind) causing merchandise on the shelf to be chaotic and unsightly. The force of the spring-loaded pusher member in such systems can result in package damage, particularly when inserting packages and even more so for the front-most package in the row causing product and revenue loss, as well as causing difficulty in replacing packages by customers who change their minds in product selection. Also, some items do not have standard, or uniform, sizes such as the above-mentioned coffee mugs that may be wider at the top than at the bottom. With these items, a spring-loaded pusher member can cause such items to tip over either to the front or back. At the least, all of the foregoing problems leave packages in an untidy state. Also, undesirably, the cost of daily maintenance of such spring-loaded pusher member shelf systems is high, and these are deterrents for almost all potential customers (i.e., stores) to install these systems.

Another state-of-the-art configuration of advancement mechanism is a conventional gravity feed roller shelving system in the form of, e.g., a mat. Such conventional gravity feed roller shelving systems often have rollers loosely disposed on a base portion, with each roller in its own holding chamber or cut-out and a retainer strip placed over all of the rollers in a row in order to secure them to the base portion. Thus, if one roller needs to be removed and replaced, the retainer strip has to be removed, which frees all of the rollers from the base portion, allowing other rollers to accidentally dislodge from the base. Moreover, the retainer strip placed over the rollers is usually attached to the assembly via screws, and should one of the screws loosen all of the rollers can become misaligned, inhibiting or preventing rollers from rotating.

An improved state-of-the-art gravity feed roller shelving system having a simplified design and more efficient operation is described in U.S. Pat. No. 8,376,154 of the inventor of the present disclosure. However, as with most other gravity feed roller seats, the gravity feed roller system of U.S. Pat. No. 8,376,154 is in the form of continuous plastic mats placed on a supporting system such as wire grids, metal frames and sheet metal shelves. Continuous mats are integral, strong and of general purpose, but their cost is relatively high and some applications are difficult to accommodate due to constraints on some merchandise and packages. Also, the mechanisms require devices to drive the merchandise to the front along the inclined surface or to prevent merchandise from falling backward.

The present disclosure describes discrete gravity feed merchandise advancement seats and systems that overcome the above disadvantages while keeping the advantages of continuous mats. The present disclosure provides discrete gravity feed merchandise advancement seats and systems that may be thought of as similar to the basic units of continuous mats, but cannot be due to the presence of the disclosed G-driver and also because the discrete gravity feed roller seats are configured as different individual units that are combinable to accommodate any size merchandise and/or shelf configuration. As will be explained more fully in the detailed description that follows, the present disclosure relates to discrete gravity feed merchandise advancement seats and systems that can be combined to provide the benefits of continuous mats but avoid the shortcomings thereof. The present disclosure allows flexibility in arranging the discrete gravity feed merchandise advancement seats and systems such that the merchandise and package constraints of continuous mats are avoided. As noted above, the merchandise advancement seats and systems can comprise rollers as the gravity feed merchandise-advancement mechanism or gliding ribs as a merchandise-advancement mechanism for moving an item thereon via gravity.

SUMMARY

In the disclosure that follows, some features may be discussed or shown in separately, in one embodiment or in combination with another particular feature or features. One skilled in the art will appreciate that the embodiments and features disclosed herein may be applicable to other embodiments and/or combined with other embodiments or disclosed features. Thus, the particular environment in which any feature disclosed herein may be shown does not limit the feature to that particular embodiment. Those skilled in the art are capable of combining features or separating features from a combination, as desired.

One embodiment of the present disclosure relates to a discrete gravity feed merchandise advancement seat assembly comprised of: a base having a top, a bottom, a width having two sides, a length having two ends, a merchandise advancement mechanism retention element disposed on the top on each side along at least a portion of the length; a gravity feed merchandise-advancement mechanism having a surface configured to accept merchandise disposed in association with the retention elements; and at least one attachment element disposed on the bottom and located proximal at least one of the two ends. The merchandise advancement mechanism retention element can be a first and a second support bar, a first and a second base C-channel and any combinations of the foregoing. The gravity feed merchandise advancement mechanism can be a plurality of rollers, a gliding rib bed comprised of a plurality of gliding ribs, and any combinations of the foregoing. The at least one attachment element disposed on the bottom at least at one end of the base can be disposed and configured to attach to a connector element disposed proximal a front end or proximal a rear end of a shelf support. The discrete gravity feed merchandise-advancement seat assembly may have one attachment element disposed at each end of the base, with the attachment elements being disposed and configured so that the bottom of the base is symmetrical from front to back. The discrete gravity feed merchandise-advancement seat assembly may further comprise a divider. The divider may be fixedly attached to the base. The discrete gravity feed merchandise-advancement seat assembly may further comprise at least one divider receiving element. The at least one divider receiving element can be selected from at least one slot disposed on the top, at least one retaining or accepting element disposed on the bottom, and any combinations of the foregoing. The discrete gravity feed merchandise-advancement seat assembly may further comprise a divider that is removably and/or adjustably attached to the base with at least one divider attachment mechanism disposed and configured to matingly engage the at least one divider receiving element. When the at least one divider receiving element is at least one retaining element disposed on the bottom, the at least one retaining element and the at least one divider attachment mechanism provide lateral adjustable placement of the divider relative to the base. The discrete gravity feed merchandise-advancement seat assembly can further comprise at least one opening through the base from the bottom to the top. The at least one opening is preferably a plurality of openings. The opening(s) provide drainage for liquids and also allow for easier cleaning of the discrete gravity feed merchandise seat assembly. The discrete gravity feed merchandise-advancement seat assembly can further comprise a locator at least at one end. The locator assists in ensuring the correct placement of discrete gravity feed merchandise-advancement seat assembly in relation to the shelf support. Preferably, the discrete gravity feed merchandise-advancement seat assembly comprises a locator disposed at each end of the base, with the locators being disposed and configured so that the bottom of the base is symmetrical from front to back. The discrete gravity feed merchandise-advancement seat assembly may further comprise at least one landing zone at least at one end, and preferably at both ends. The landing zone(s) are elements that provide an area where heavy merchandise may be loaded onto the discrete gravity feed merchandise-advancement seat assembly and serve to protect the gravity feed merchandise-advancement mechanism from damage, particularly when the gravity feed merchandise-advancement mechanism comprises a plurality of rollers. Additional optional specifics and/or alternatives of the elements of the discrete gravity feed merchandise advancement seat assembly will be apparent to those of skill in the art from the following descriptions and the embodiments shown in the Figures and detailed description.

Another embodiment of the present disclosure relates to a merchandise gravity driver comprised of: a driver deck having a top, a bottom and two sides; a driver paddle or container with cap disposed on the top and above the driver deck; and two guide channels, wherein one guide channel is disposed on each side of the driver deck, wherein the bottom has a surface configured to contact a surface of a merchandise-advancement mechanism disposed in a merchandise retention element having two sides, and wherein one of each of the two guide channels is disposed and configured to surround one each of the two sides of the merchandise advancement mechanism retention element. The bottom of the driver deck preferably comprises a patterned surface disposed thereon. The patterned surface is designed and configured to reduce friction between the bottom of the driver deck and a top surface the gravity feed merchandise-advancement mechanism. Preferably, each of the first and second guide channels further comprises an edge element configured to engage a channel disposed along a length of each of the merchandise advancement mechanism retention elements. The guide channels and edge element provide vertical and horizontal stability to the driver in relation to the base. The merchandise guide can include an angled side configured to be disposed proximal merchandise. The merchandise guide can include a hollow portion configured to hold a weight.

Still another embodiment of the present disclosure relates to a merchandise advancement and display assembly comprising: a discrete gravity feed merchandise-advancement seat assembly comprised of: a base having a top, a bottom, a width having two sides, a length having two ends and a merchandise-advancement mechanism retention element disposed on each side along at least a portion of the length; a gravity feed merchandise-advancement mechanism having a surface configured to accept merchandise disposed in association with the retention elements; and a driver comprised of: a driver deck having a first side, a second side, a top and a bottom; a merchandise guide disposed above the driver deck; and a first and a second guide channel disposed on the first and second sides of the deck, respectively, wherein a bottom surface of the deck is disposed and configured to contact the surface configured to accept merchandise, and wherein one of each of the first and second guide channels is disposed and configured to interact with and preferably surround at least a portion of, one each of the two retention elements, so that the driver can reciprocally traverse the length. The driver works with gravity to keep merchandise moving forward as well as preventing merchandise from falling backwards due to the self-locking function of the guide channels. The merchandise advancement mechanism retention element can be a first and a second support bar, a first and a second base C-channel and any combinations of the foregoing. When first and second support bars, each has a plurality of spaced apart openings disposed therein, wherein preferably a spaced apart opening of the first support bar is disposed opposite a spaced apart opening of the second support bar. Preferably, oppositely disposed spaced apart openings of the first and second support bars are configured to receive connectors on either end of a roller or a tab on each of two sides of a gliding rib bed. When first and second base C-channels, preferably these are configured to receive connectors on either end of a roller or a tab on each of two sides of a gliding rib bed. The gravity feed merchandise advancement mechanism can be a plurality of rollers, a gliding rib bed comprised of a plurality of gliding ribs, and any combinations of the foregoing.

The bottom of the driver deck preferably comprises a patterned surface disposed thereon. The patterned surface is designed and configured to reduce friction between the bottom of the driver deck and a top surface the gravity feed merchandise-advancement mechanism. Preferably, each of the first and second guide channels further comprises an edge element configured to engage a channel disposed along a length of each of the merchandise advancement mechanism retention elements. The guide channels and edge element provide vertical and horizontal stability to the driver in relation to the base. The merchandise guide can include an angled side configured to be disposed proximal merchandise. The merchandise guide can include a hollow portion configured to hold a weight. The discrete gravity feed merchandise advancement seat can include an attachment mechanism at least at one end. The attachment mechanism can be a plurality of elements disposed on the base that are configured to mate with a plurality of elements disposed on a structure attached to a shelf support. The plurality of elements disposed on the base can be disposed substantially perpendicular to the top of the base. The plurality of attachment elements disposed on the structure attached to the shelf support can be disposed on a strip-like element on the structure. The plurality of attachment elements disposed on the base and the plurality of elements disposed on the structure attached to the shelf support can be both evenly spaced. The plurality of attachment elements disposed on the base and the plurality of elements disposed on the structure attached to the shelf support can each be a plurality of trapezoidal-like four-sided pyramids. The attachment mechanism can be a C-shaped element. The C-shaped element can be configured to mate with a rod-like element disposed on a structure attached to a shelf support. The attachment mechanism can be a tab-like structure disposed on the base that is configured to mate with spaced apart teeth on a rod-like structure disposed on a shelf support. The attachment mechanism may include downwardly facing flanges configured to surround and mate with retaining elements holding the rod-like structure.

The merchandise display assembly can further include a divider mechanism connected to the discrete gravity feed merchandise advancement seat. The divider mechanism can be fixedly connected to the discrete gravity feed merchandise advancement seat to form a unitary structure or removably and/or adjustably connected to the discrete gravity feed merchandise advancement seat. The divider mechanism can be removably connected to the discrete gravity feed merchandise advancement seat using a connection mechanism that mates with a cooperative receiving mechanism disposed on the discrete gravity feed merchandise advancement seat. The connection mechanism can be at least one tab-like element disposed along an edge of the divider strip and the receiving mechanism can be at least one slot disposed on the merchandise advancement mechanism retention element. The connection mechanism can be at least one foot-like element disposed perpendicularly to the divider strip and the receiving mechanism can be least one retaining element disposed on the bottom of the base. The divider mechanism can be affixed to a divider base and the divider base has an attachment mechanism at least at one end. the attachment mechanisms for the divider base can be the same as any of the attachment mechanisms referred to with respect to the discrete gravity feed merchandise advancement seat.

Preferably, the discrete gravity feed merchandise advancement seat has an attachment mechanism at least at one of the two ends. In one embodiment, the attachment mechanism comprises a plurality of merchandise advancement seat attachment elements that are configured to mate with a plurality of front panel attachment elements disposed on a front panel attached proximal a front edge the shelf support. The plurality of merchandise advancement seat attachment elements may be disposed substantially perpendicular or substantially parallel to the top of the merchandise advancement seat. Also, preferably, each of the plurality of merchandise advancement seat attachment elements is substantially evenly spaced, as are the plurality of front panel attachment elements disposed on the front panel attached to the shelf support. In a preferred embodiment, the plurality of merchandise advancement seat attachment elements comprises a plurality of trapezoidal-like four-sided pyramids, and the plurality of front panel attachment elements disposed on the front panel attached to the shelf support also comprises a plurality of trapezoidal-like four-sided pyramids. In another embodiment, the merchandise advancement seat attachment mechanism comprises a C-shaped element that is configured to mate with a rod-like element disposed on the front panel attached to the shelf support. In another embodiment, the attachment mechanism comprises a lock rod having a plurality of spaced-apart teeth on a side thereof. In this embodiment, the front panel (and optionally the rear panel) includes lock rod holders configured to accept the lock rod as well as to matingly engage with flange-like elements disposed on the bottom of the base. In this embodiment, a lock tab preferably is disposed on the bottom of the base and is configured to engage a space between the plurality of spaced-apart teeth when the lock rod holders are engaged with the flange-like elements disposed on the bottom of the base. Preferably, a locator that assists in positioning the base in relation to the front panel is disposed on at least one end of the base. More preferably, a locator, a lock tab and flange-like elements are disposed on both ends of the base so that the base is symmetrical and reversible end-to-end. In each configuration, the attachment mechanism at the first of the two ends of the discrete gravity feed merchandise advancement seat locks the discrete gravity feed merchandise advancement seat in position with respect to the front edge of the shelf support. In another preferred embodiment, discrete gravity feed merchandise advancement seat has an attachment mechanism at the second of the two ends that is configured to engage a space provided by a strip disposed proximal a rear edge of the shelf support. The attachment mechanism at the second of the two ends of the discrete gravity feed merchandise advancement seat locks the discrete gravity feed merchandise advancement seat in position with respect to the rear edge of the shelf support. The attachment mechanism at the end configured to be disposed at a front of a shelf support can be larger than the attachment mechanism at the end configured to be disposed at a rear of a shelf support. This ensures that an installer recognizes correct placement and locking of the discrete gravity feed advancement mechanism in position with respect to the shelf support.

As noted above, the discrete divider mechanism is connected to the discrete gravity feed merchandise advancement seat either integrally, removeably or adjustably. The discrete divider mechanism can also be a separate device that connects to a front wall and/or rear wall by attachment mechanisms as described above with respect to the merchandise advancement seats. For example, the discrete divider mechanism may be connected to the discrete gravity feed roller seat to form a unitary structure therebetween. Alternatively, the discrete divider mechanism may be a separate element that is removably or adjustably connected to the discrete gravity feed merchandise advancement seat. In the embodiment of the discrete divider mechanism is a separate element that is removably connected to the discrete gravity feed merchandise advancement seat, the discrete divider mechanism comprises a divider strip having a connection mechanism that mates with a cooperative receiving mechanism disposed on the top of the discrete gravity feed merchandise advancement seat. In this embodiment, preferably, the connection mechanism may be one or a plurality of tab-like elements disposed along one edge of the divider strip that are disposed and configured to mate with one or a plurality of slot-like elements disposed along the top of the discrete gravity feed merchandise advancement seat. In another embodiment of the discrete divider mechanism as a separate element that is adjustably connected to the discrete gravity feed merchandise advancement seat, the discrete divider mechanism comprises a divider strip having a connection mechanism that mates with a cooperative receiving mechanism disposed on the bottom of the base of the discrete gravity feed merchandise advancement seat. In this embodiment, preferably, the connection mechanism may be one or a plurality of feet-like elements disposed substantially perpendicularly along one edge of the divider strip that are disposed and configured to mate with one or a plurality of slot-like elements disposed on the bottom of the base of the discrete gravity feed merchandise advancement seat. In this latter embodiment of discrete divider mechanism, the one or a plurality of feet-like elements the feet-like elements may be configured to provide for lateral adjustment of the discrete divider with respect to its position relative to the merchandise advancement seat. That is, the discrete dividers may be adjustable to allow variations in the "width" of merchandise that can be placed on discrete gravity feed merchandise advancement seat. In another embodiment, the divider itself has a generally "flat" configuration and includes a plurality of ribs disposed along the length of the divider. The ribs are configured to protrude away from the divider in a direction toward merchandise to support merchandise vertically yet provide a small surface area of contact with merchandise so that friction between the divider and the merchandise is reduced. Also, alternatively, the discrete divider mechanism may be a separate element affixed to a discrete divider base. When the discrete divider mechanism is affixed to a discrete divider base, the discrete divider base preferably further comprises a divider attachment mechanism at least at one of the two ends of the discrete divider base. In one embodiment, the divider attachment mechanism comprises a plurality of elements that are configured to mate with a plurality of elements disposed on a front panel attached to the shelf support. The plurality of elements of the divider attachment mechanism may be disposed substantially perpendicular to, or substantially parallel to the top of the discrete gravity feed roller seat. Also, preferably, the plurality of elements of the divider attachment mechanism are substantially evenly spaced, as are the plurality of front panel attachment elements disposed on the front panel attached to the shelf support. In another embodiment, the divider attachment mechanism comprises a C-shaped element that is configured to mate with a rod-like element disposed on the front panel attached to the shelf support. The divider attachment mechanism at the first of the two ends of the discrete divider base locks the discrete divider base in position with respect to the front edge of the shelf support. In another preferred embodiment, the discrete divider base also has a divider attachment mechanism at the second of the two ends that is configured to engage a space provided by a strip disposed proximal a rear edge of the shelf support. The divider attachment mechanism at the second of the two ends of the discrete divider base locks the discrete divider base in position with respect to the rear edge of the shelf support.

When used, each roller comprises a cylinder portion having a diameter and a length and a connection element at each end of the length. Preferably, each cylinder portion has substantially the same diameter. Also, preferably, each connection element is configured to matingly engage one of a pair of oppositely disposed openings in the first and second roller support bars so as to allow the cylinder to freely rotate in the pair of oppositely disposed openings. Also, preferably, the configuration of the connection elements on each roller in association with the configuration of the oppositely disposed openings allows the roller to freely rotate without pulling away from or out of the oppositely disposed openings in the first and second roller support bars. Alternatively, to using rollers, the present disclosure also provides for using gliding rib inserts that are beneficial for some applications. When used, gliding rib inserts may be in the form of gliding rib beds. Gliding rib beds are preferably comprised of a plurality of evenly or unevenly spaced parallel ribs that are set in cross-members. Each parallel rib has a generally triangular shape or other shape and each parallel rib is disposed in the cross-members so that an apex or a top of each parallel rib is disposed above the upper surface of the cross-members. This configuration allows for G-driver and merchandise to glide along apexes or tops with minimal friction. Of course, gliding ribs can be made of a low-resistance "slippery" material such as Teflon® and the gliding ribs may not necessarily require any apex. As noted above, gliding rib beds can be inserted into roller support bars using tabs that are configured to fit in roller support bars in the same manner as the connection elements on the rollers. Of course, other structures of support bars can be used. The length of gliding rib beds can be adjusted as needed by breaking gliding rib beds at notches that can be provided along intervals of the length of the gliding rib beds.

Another embodiment of the present disclosure comprises an L-front stop comprised of a front panel and a front foot. The L-front stop is configured to connect to a front area of the shelf support. In this embodiment, the L-front stop comprises front panel that is a substantially rectangular shape and that is disposed in a direction substantially vertically away from the shelf support when the L-front stop is connected to the front area of the shelf support. The front panel includes a plurality of front panel attachment elements disposed along one edge of the substantially rectangular shape, proximal the shelf support and configured to mate with a plurality of attachment elements disposed on one end of the discrete gravity feed merchandise advancement seat. As noted above, the plurality of front panel attachment elements disposed along one edge of the front panel comprises elements disposed and configured on the front panel to matingly engage the plurality of discrete gravity feed merchandise advancement seat attachment elements disposed on the first of two ends of the discrete gravity feed roller seat. In this embodiment, the front foot also comprises a substantially rectangular shape and is attached to the substantially rectangular front panel at 90°. The front foot comprises openings disposed therein that are spaced to match openings on the shelf support and that are configured to accept attachment mechanisms for attaching the L-front stop to the shelf support. The front foot further comprises a recessed area disposed substantially along the length and width of the substantially rectangular front foot. One edge of the recessed area is configured to fit tightly between (1) a lock bar disposed on the bottom of the discrete roller seat and/or on the bottom of the discrete divider seat and (2) a grid-like arrangement of transverse ribs and longitudinal ribs disposed on the bottom of the discrete roller seat and/or on the bottom of the discrete divider seat.

Still another embodiment of the present disclosure comprises a front foot that is configured to accept (1) a separate front panel, such as those that may be currently used in the art, to create an L-front stop configuration, and (2) an acceptor strip. In this embodiment, the front foot comprises a U-channel configured to accept the separate front panel and a C-channel configured to accept the acceptor strip. The U-channel comprises a front wall and a rear wall and, preferably, disposed between the front wall and the rear wall a stop element. The stop element is disposed and configured to cooperate with a protrusion commonly found on separate front panels to provide a snap fit between separate front panel and the U-channel. The C-channel comprises a perpendicular portion disposed away from the rear wall in a direction away from the front wall, a first flange portion attached to the perpendicular portion and disposed substantially perpendicularly to the perpendicular portion in a direction toward the shelf support, and a raised portion disposed away from shelf support and toward the flange portion. The front foot further comprises a second flange portion disposed on a base of the front foot in a direction substantially perpendicularly away from the shelf support. The second flange portion is configured to fit tightly between (1) a lock bar disposed on the bottom of the discrete roller seat and/or on the bottom of the discrete divider seat and (2) a grid-like arrangement of transverse ribs and longitudinal ribs disposed on the bottom of the discrete roller seat and/or on the bottom of the discrete divider seat. The front foot further comprises openings disposed therein that are spaced to match openings on the shelf support and that are configured to accept attachment mechanisms for attaching the front foot to the shelf support.

Yet another embodiment of the present disclosure comprises a front foot that includes a front wall, rear wall, U-channel, protrusion, stop and second flange that are the same as described in the foregoing paragraph. In this embodiment, however, rear wall has disposed thereon a closed hollow member. The closed hollow member comprises two struts, a lower strut and an upper strut that are affixed to the rear wall. The lower strut and the upper strut project outwardly from the rear wall in a direction away from the front wall. The lower strut may be affixed to the base of the front foot and project upwardly away from the base. At distal ends of the lower strut and the upper strut away from rear wall is a curved portion. Also, disposed along the upper strut between the rear wall and the curved portion is a notch. Taken together, the lower strut, the upper strut, the curved portion and the notch replace acceptors or acceptor strip on the front foot. To allow the discrete gravity feed roller seat and/or the discrete divider seat to cooperatively engage the curved portion of the closed hollow member, disposed on the first of two ends of discrete gravity feed roller seat and/or discrete divider seat is an open curved portion. The open curved portion is designed and configured to substantially mate with the curved portion and the notch. The open curved portion comprises two lips, a lower lip and an upper lip. The lower lip and the upper lip are disposed and configured on the open curved portion to surround the closed hollow portion and contact or nearly contact the lower strut and the upper strut, respectively. In addition, the upper lip may be further configured to matingly engage the notch. By this configuration, the open curved portion lockingly engages the closed hollow portion tightly, yet at the same time allows for lateral movement of the discrete gravity feed roller seat and/or the discrete divider seat along the closed hollow portion. Alternatively, the positions of the closed hollow portion and the open curved portion may be reversed, i.e. the closed hollow portion may be disposed on the first of two ends of the discrete gravity feed roller seat or the discrete divider seat, and the open curved portion may be disposed along the rear wall. In most cases, the material of the open curved portion will be of the same plastic as that of the discrete gravity feed roller seat and/or the discrete divider seat. The closed hollow portion can be fabricated of aluminum, other metals, and any variety of plastic. The structure of the closed hollow portion can be solid or hollow. Of course, all the above disclosure relating to a front foot can be applied to a rear foot as well as will be appreciated by one of skill in the art. In another embodiment of the present disclosure comprises a front foot that includes a locking pin. In this embodiment, the locking pin is configured with a "flat" upper surface (i.e., the surface disposed in a direction toward merchandise and away from shelf) and with locking pin channels disposed and configured to accept a portion of an arm disposed on a bottom side of a front head or rear head attached to an end of a discrete gravity feed merchandise advancement seat. The locking pin may be integral with the front foot or a separate element attached to the front foot (or rear foot). In this embodiment, a locking panel maintains locking pin and the portion of arm in a locked position, and when the locking panel is released, the "locked" position is released. This embodiment allows for placement and locking of the discrete gravity feed merchandise advancement seat in any position laterally along the shelf since the upper surface of the locking pin is smooth, thus providing fine lateral adjustment of a discrete gravity feed merchandise advancement seat to accommodate any size merchandise package.

When the discrete gravity feed merchandise advancement seats of the present disclosure are to be used with a wire shelf installation, such as in refrigeration systems, a few modifications to the foregoing disclosure are made. One modification is that both front foot and rear foot can be provided with clips that clip onto each of two side stop wires that are generally disposed on the outer edges of a wire shelf. Another modification is that a middle locking bar seat can be provided. A middle locking bar seat helps to stabilize the merchandise advancement seat on the wire shelf. The middle locking bar seat is preferably configured to mate with a middle connector that joins two merchandise advancement seats.

Also, because wire shelves are generally used with merchandise that is relatively heavy, such as six-packs of soda or beer or other beverages, the discrete gravity feed merchandise advancement seats can be provided with a landing zone that is designed and configured to accept placement of such heavy merchandise, especially when stocking or returning undesired such merchandise. Landing zones are particularly desirable with discrete gravity feed roller seats to help avoid damage to the rollers. The landing zone comprises: a solid plate sized and configured to fit into the merchandise advancement mechanism retention element; and a plurality of curved ribs disposed on the solid plate that are sized and configured to allow merchandise to glide along a top surface of the plurality of curved ribs and meet the surface of the gravity feed merchandise-advancement mechanism.

In addition, in the embodiment for use with wire shelves, a panel clip can be provided that is used to lock a "wall" structure (e.g., front wall, front foot, rear wall or rear foot) to a wire(s) of a wire shelf. In general, the panel clip comprises: a base; a U-channel; a slot; an upper jaw; and a lower jaw, wherein the U-channel is sized and configured to provide sufficient depth to accommodate a cross-sectional dimension of a longitudinal wire of the wire shelf, wherein the slot is sized and configured to provide sufficient width to accommodate a cross-sectional dimension of a longitudinal wire of the wire shelf, wherein the upper jaw the lower jaw are sized and configured to grip front foot or rear foot with sufficient force so that front foot or rear foot is held laterally in position on the wire shelf.

In some installations, the shelves are deep and require a merchandise advancement seat that can accommodate the depth. In these situations, a seat connector can be used. In general, the seat connector, for connecting two discrete gravity feed merchandise advancement seats each having a bottom and as length with two ends together in an end-to-end configuration, comprises: a connector base having a length with two ends and a width; two transverse edges, wherein one transverse edge is disposed proximal each end; a T-rod disposed between the two transvers edges; and two sets of lock rod holders, wherein one each of the two sets of lock rod holders is disposed between a transverse edge and the T-rod, wherein each of the two transverse edges, the T-rod and each of the two sets of lock rod holders is disposed away from the connector base in the same direction, wherein each of the two transverse edges, each of the two sets of lock rod holders and the T-rod is sized and configured to mate/interact with the bottom of each of the two discrete gravity feed merchandise advancement seats, wherein the T-rod is sized and configured to provide a transverse channel across the width of the connector on each side of the T-rod, and wherein each of the two transverse channels is sized and configured to accept a locator on one each of the two discrete gravity feed merchandise advancement seats. The seat connector T-rod preferably comprises a relatively square upper section above a neck section, wherein the neck section is sized to provide the two transverse channels. The seat connector also preferably designed and constructed wherein one each of the two transverse edges are sized and configured to contact the bottom of each of the two discrete gravity feed merchandise advancement seats to provide support therefor and to limit flex thereof. Preferably, the seat connector comprises a T-rod that is sized and configured so that an upper surface of each of the two discrete gravity feed merchandise advancement seats to allow for smooth forward movement of merchandise across the connected discrete gravity feed merchandise advancement seats.

Also, because wire shelves are generally used in refrigeration systems for liquids, it is beneficial to provide drain holes or slots in the base of the discrete gravity feed merchandise advancement seats to allow liquid spillage to drain and avoid fouling of the advancement mechanisms.

Gravity feed merchandise-advancement mechanisms require pitch, and while a new shelf can be made with a designed pitch, the present disclosure provides a mechanism that creates pitch for existing shelves. The present disclosure provides angle converters that satisfy this desired pitch for gondolas comprising uprights that are vertically disposed from a base. Angle converters can be attached to the uprights and shelves can be attached to the angle converters to retrofit standard perpendicular shelves into pitched shelves for use with gravity-feed merchandise-advancement mechanisms.

Additional details of the rollers and the roller support bars are described in U.S. Pat. No. 8,376,154 having the same inventor as the present disclosure.

DETAILED DESCRIPTION OF PREFERRED EMBODIMENTS

Preferred embodiments of the present disclosure as well as options thereof will now be described in conjunction with the Figures, in which like numerals denote like elements.

Figures 1, 1A, 1B, 1C, 1D:
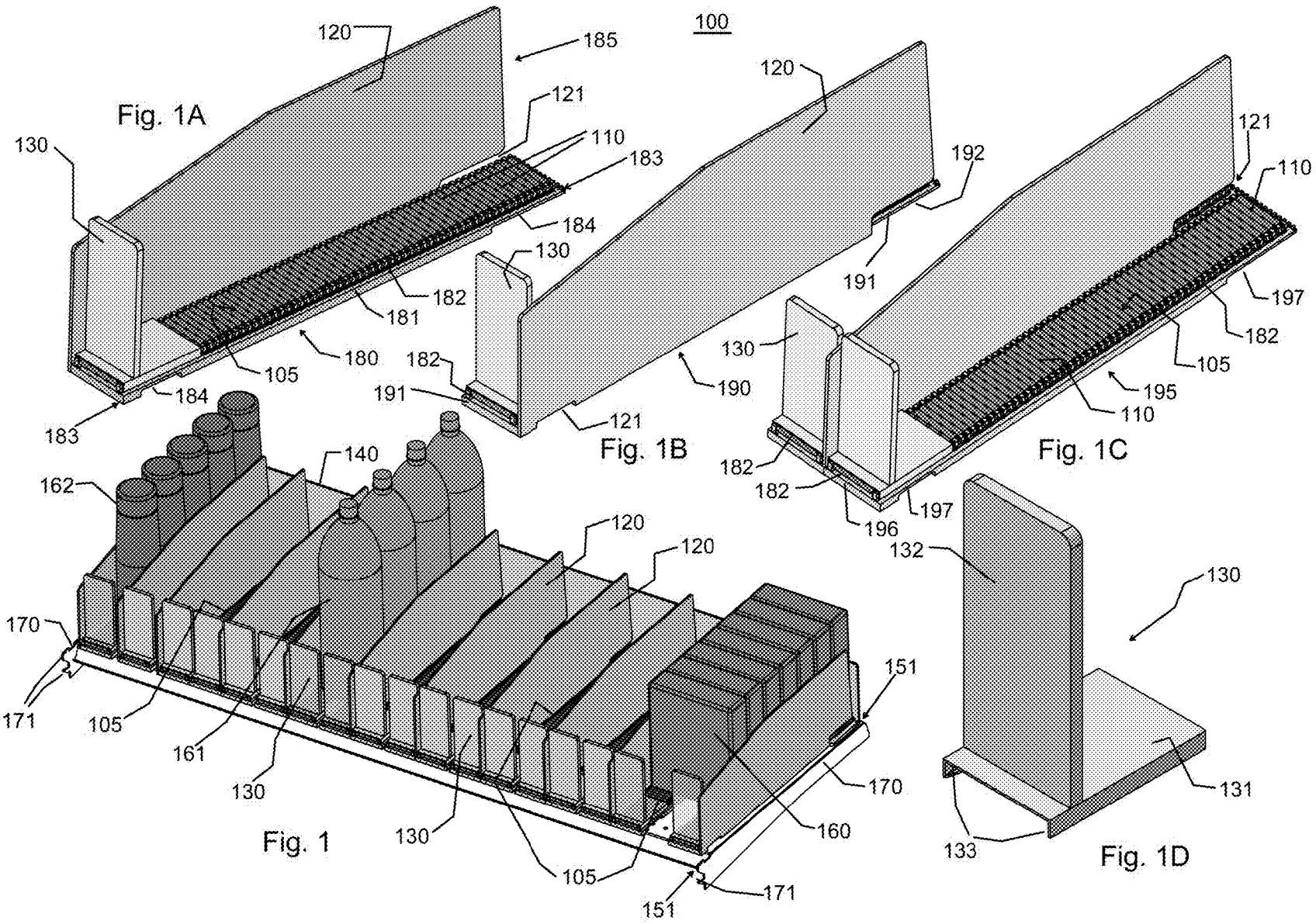
FIG. 1 is an overhead rear perspective view of a plurality of discrete gravity feed roller seats of the present disclosure combined to form a gravity feed shelving system.
FIG. 1A is an overhead rear perspective view of a right discrete gravity feed roller seat.
FIG. 1B is an overhead rear perspective view of a left discrete gravity feed roller seat.
FIG. 1C is an overhead rear perspective view of a T-discrete gravity feed roller seat.
FIG. 1D is an overhead rear perspective view of a G-pusher.

FIG. 1 shows a system 100 comprised of a plurality of discrete gravity feed roller seats 105 each comprised of a plurality of rollers 110, a plurality of dividers 120, a plurality of G-driver 130 and an L-front stop 140. System 100 is disposed on a shelf support 150. Shelf support 150 may be, for example, a sheet metal shelf as is known to those of skill in the art. One each of two brackets 170 is disposed at each end of shelf support 150 and each bracket 170 has bracket support(s) 171 configured to engage slots (not shown), such as are common in gondola shelving systems, also as is known to those of skill in the art. Also shown in FIG. 1 are merchandise packages 160, 161 and 162 of various dimensions. As shown in FIG. 1, merchandise package 160 is of a width such that merchandise package 160 is disposed partly on a right roller seat 180 and partly on a left roller seat 190 with a space therebetween, exposing shelf support 150, as indicated in FIG. 1. FIG. 1A shows a right roller seat 180 comprised of a right base panel 181, a plurality of rollers 110 disposed in two roller support bars 182 (one on each side of right base panel 181), G-driver 130 and divider 120. Right roller seat 180 shown in FIG. 1A is denominated a "right roller seat" because, when viewed from the front 185, i.e. proximal L-front stop 140, divider 120 is to the right of plurality of rollers 100. FIG. 1B shows a left roller seat 190 comprised of left base panel 191, a plurality of rollers 110 (obscured and not shown) disposed in two roller support bars 182 (again, one on each side of left base panel 191), G-driver 130 and divider 120. As with right roller seat 180, "left roller seat" is denominated as such because when viewed from front 185, again proximal L-front stop 140, divider 120 is to the left of plurality of rollers 100.

As can be seen in, for example, FIGS. 1A and 1B, dividers 120 are disposed along a length 183 of right base panel 181 or left base panel 191, as the case may be. Dividers 120 can be made of any suitable material, e.g., plastic or metal, and are affixed to right base panel 181 or left base panel 191 by any appropriate method. For example, when dividers 120 are made of plastic, dividers 120 may be affixed to base panels 181, 191 by ultrasonic welding, adhesive or by appropriate tooling for fabrication of base panels 181, 191 having dividers 120. Preferably, when dividers 120 are made of plastic, they are affixed to base panels 181, 191 by ultrasonic welding. Alternatively, dividers 120 may be made of metal in which case dividers 120 may be affixed to base panels 181, 191 by adhesive or by use of appropriately configured support brackets (see, e.g., FIG. 2). FIG. 1C shows a T-roller seat 195 comprised of T-base panel 196 having two sets of roller support bars 182, two pluralities of rollers 110 (only one visible), two G-drivers 130 and divider 120 disposed between two sets of roller support bars 182. Each of right base panel 181, left base panel 191 and T-base panel 195 has a length 183 along a longitudinal side beginning at front 185 and toward G-driver 130. Length 183 is selected such that right base panel 181, left base panel 191 and T-base panel 195 fit onto shelf support 150 within a length 151 (see, FIG. 1) of shelf support 150. More than one of right base panel 181, left base panel 191 and T-base panel 195 may be connected to each other at one end of length 183 so that different lengths 151 of shelf support 150 can be accommodated. The connection of right base panel 181, left base panel 191 and T-base panel 195 to each other at one end of length 183 can be achieved by any suitable mechanism, and is not critical to the present disclosure. As can be seen in each of FIGS. 1A, 1B and 1C, each divider 120 has cutout areas 121. Similarly, as can be seen in FIGS. 1A and 1C, each of right base panel 181 and T-base panel 196 has cutout areas 184 and 197, respectively. Although not clearly visible in FIG. 1B, left base panel 191 also has cutout areas 192. The function of cutout areas 184, 192 and 197 will be explained in more detail in conjunction with other Figures. FIG. 1D shows G-pusher 130 which is comprised of a pusher deck 131, a pusher paddle 132 and two C-channels 133 which will be described in more detail in conjunction with other Figures. Referring back to FIG. 1, it will be appreciated by those of skill in the art that any sizes or combinations of merchandise packages 160, 161 and 162 may be accommodated by system 100 depending upon placement of right roller seat(s) 180, left roller seat(s) 190 and/or T-roller seat(s) 195. The positions and numbers of right roller seat(s) 180, left roller seat(s) 190 and/or T-roller seat(s) 195, as well as connections of each to another at one end of length 183, depends upon the merchandise planogram (POG).

Figures 2, 2A, 2B, 2C, 2D:
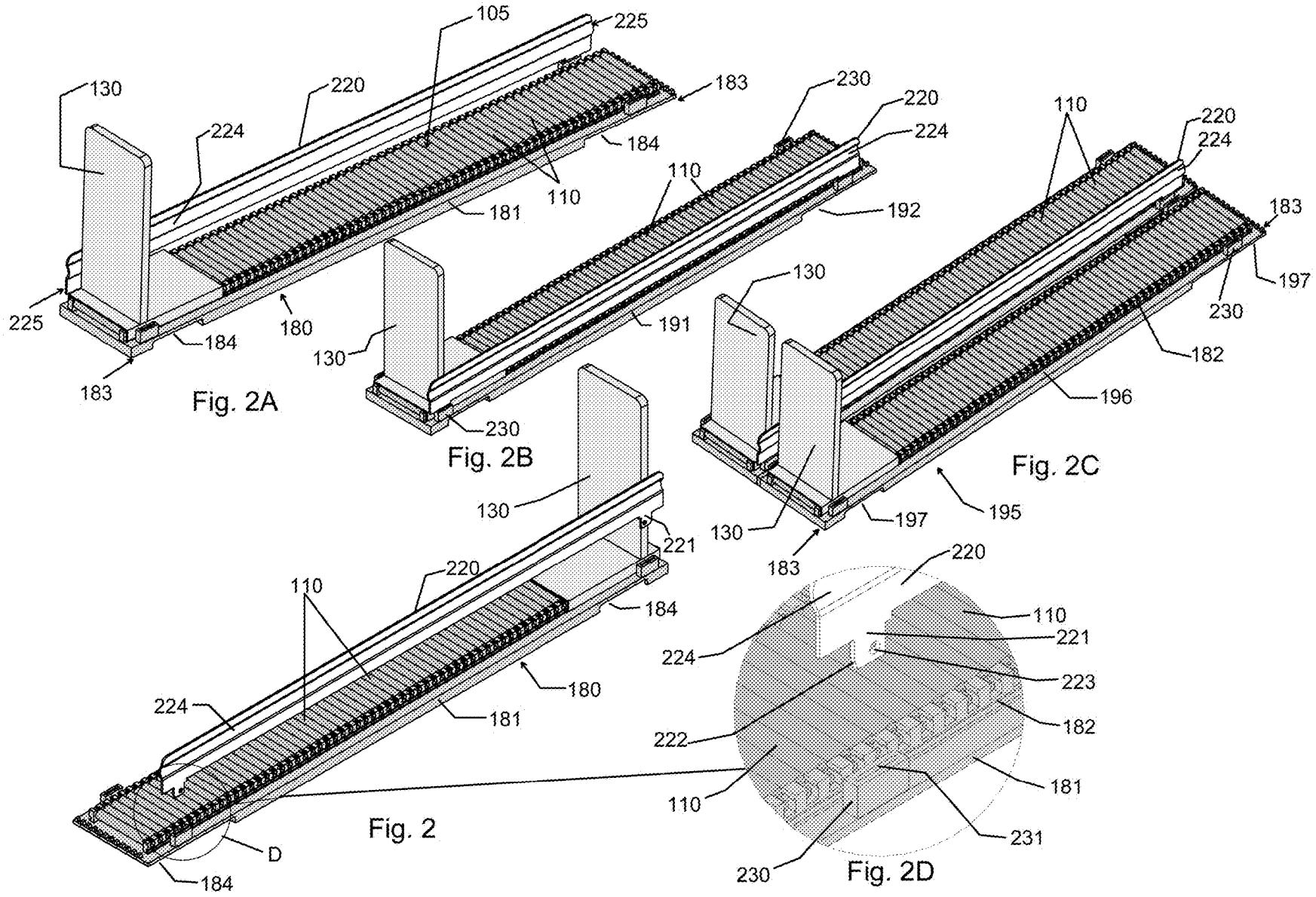
FIG. 2 is an overhead partially exploded front perspective view of a right discrete gravity feed roller seat having an alternate divider structure.
FIG. 2A is an overhead rear perspective view of the assembled discrete gravity feed roller seat of FIG. 2.
FIG. 2B is an overhead rear perspective view of a left discrete gravity feed roller having the alternate divider structure.
FIG. 2C is an overhead rear perspective view of a T-discrete gravity feed roller seat having the alternate divider structure.
FIG. 2D is a detail view of section "D" of FIG. 2.

FIGS. 2A-2D show alternative configurations of right roller seat 180, left roller seat 190 and T-roller seat 195 when a divider 220 is configured to fit into a bracket 230. As can best be seen in FIGS. 2 and 2D, divider 220 has a tab 221 disposed proximal each end of divider 220. Each tab 221 as shown in FIG. 2A is disposed below each end of divider 220. In the embodiment shown in FIG. 2A, tab 221 has a beveled portion 222 and an opening 223. Beveled portion 222 allows tab 221 to be more easily inserted into bracket 230. Opening 223 is merely an expedient for holding divider 220 during powder coating, if performed, and is, and is not critical to the present disclosure. Bracket 230 is disposed on a top surface of right base panel 181 and has a receiver 231 configured to accept tab 221. Divider 220 also has a protrusion 224 disposed along a length 225 of divider 220. The purpose of protrusion 224 is to keep merchandise packages 160, 161 and 162 properly aligned while, at the same time, reducing the surface of divider 220 that is in contact with merchandise 160, 161 and 162, thereby reducing friction between divider 220 and merchandise 160, 161 and 162. Protrusion 224 also provides longitudinal stiffness to divider 220 to prevent deformation of divider 220 by contact with merchandise packages 160, 161 and/or 162. Divider 120 of, e.g., FIGS. 1-1C does not need additional longitudinal stiffness provided by a structure such as protrusion 224 since divider 110 is affixed along length 183 of base panels 181, 191 and/or 196. Divider heights and other dimensions depend on the size of merchandise packages 160, 161 and 162. For example, divider heights can range from 1" to 5". Also, the number of protrusions 224 can vary, depending on the specific application and/or divider height and, for example, there can be 1, 2 or 3 protrusions 224.

Figures 3, 3A, 3B, 3C:
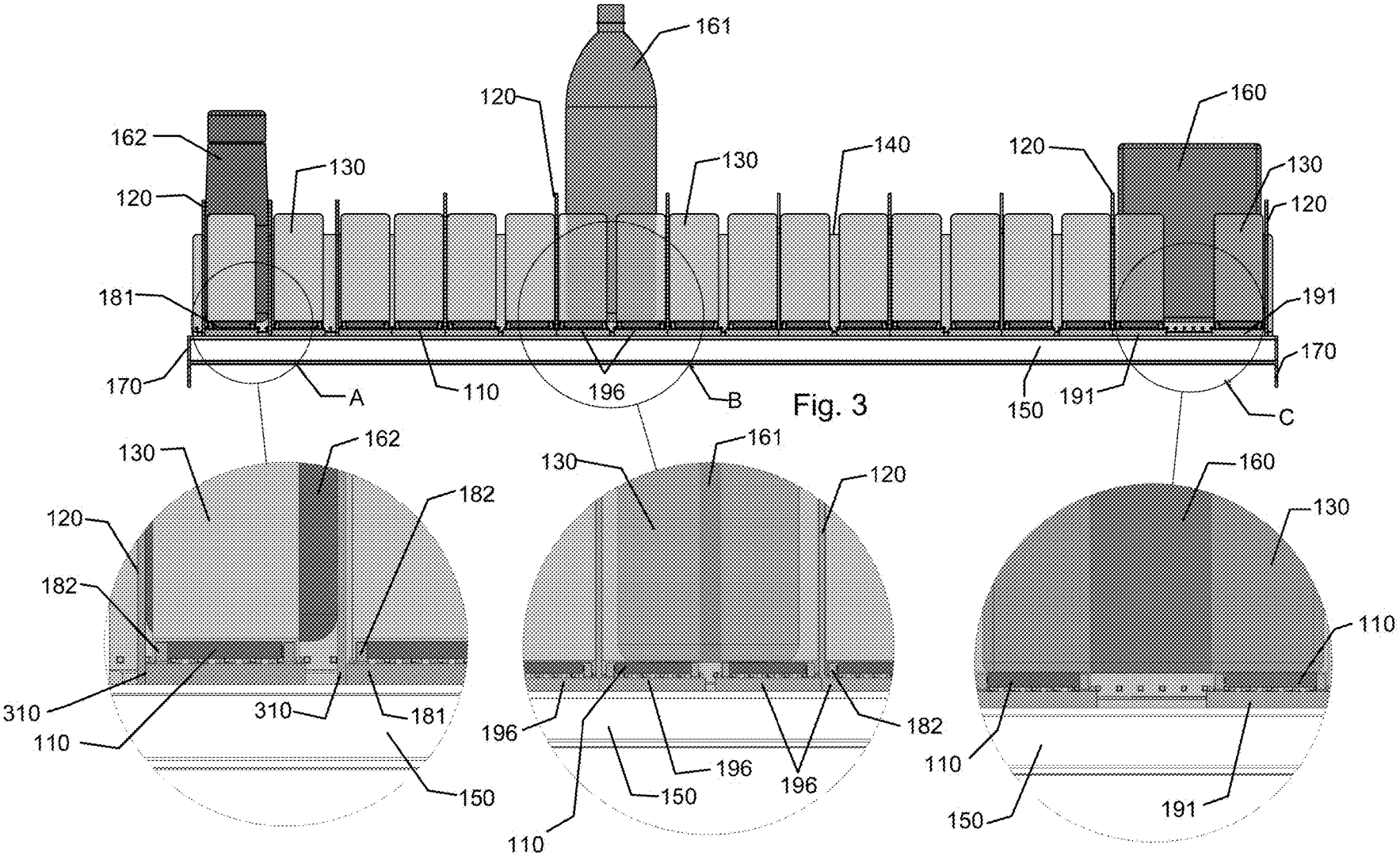
FIG. 3 is a rear view of the discrete gravity feed roller seat shown in FIG. 1 of the present disclosure.
FIG. 3A is a detail view of section "A" of FIG. 3.
FIG. 3B is a detail view of section "B" of FIG. 3.
FIG. 3C is a detail view of section "C" of FIG. 3.

FIG. 3 shows a rear view of system 100 shown in FIG. 1. FIGS. 3A, 3B and 3C show in detail views of sections "A", "B" and "C", respectively of FIG. 3. In FIGS. 3A and 3C, dividers 120 are affixed to a longitudinal edge 310 of right base panel 181 and left base panel 191, respectively, by ultrasonic welding, proper tooling and other methods known to those of skill in the art. In FIGS. 3B and 3C, dividers 120 are affixed to T-base panel 196 by insertion between adjacent roller support brackets 182. Dividers 120 can be affixed between adjacent roller support brackets 182 by ultrasonic welding or, alternatively, by adhesive or merely a close fit between adjacent roller support bars 182 that can be accomplished during tooling for T-base panel 196.

Figure 4A:
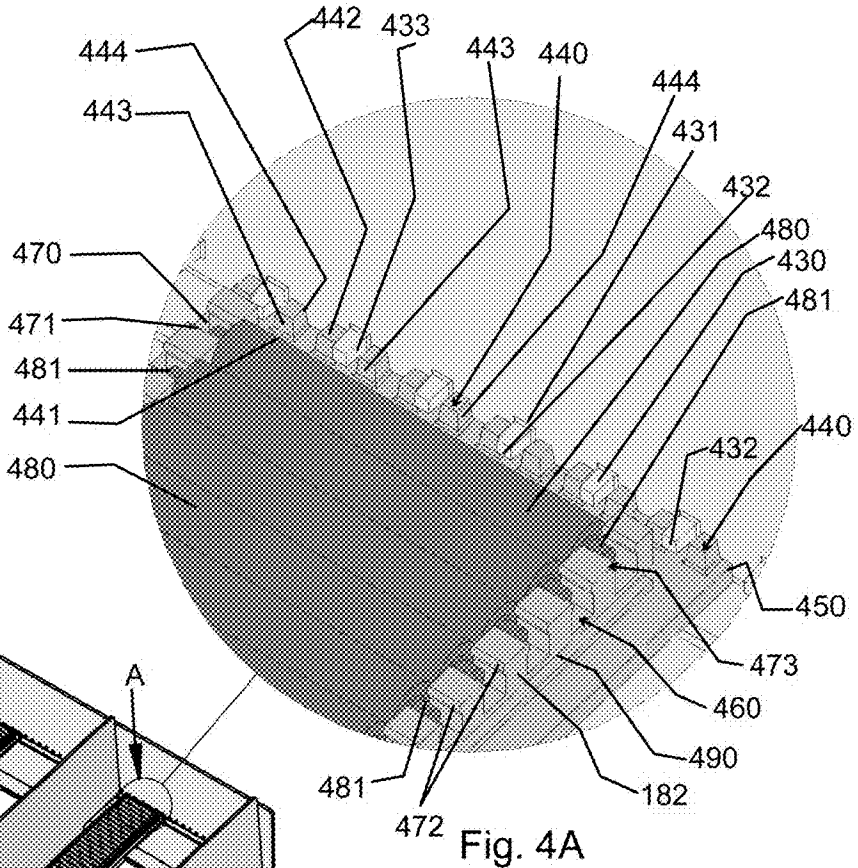
FIG. 4A is a detail view of section "A" of FIG. 4.
Figure 4:
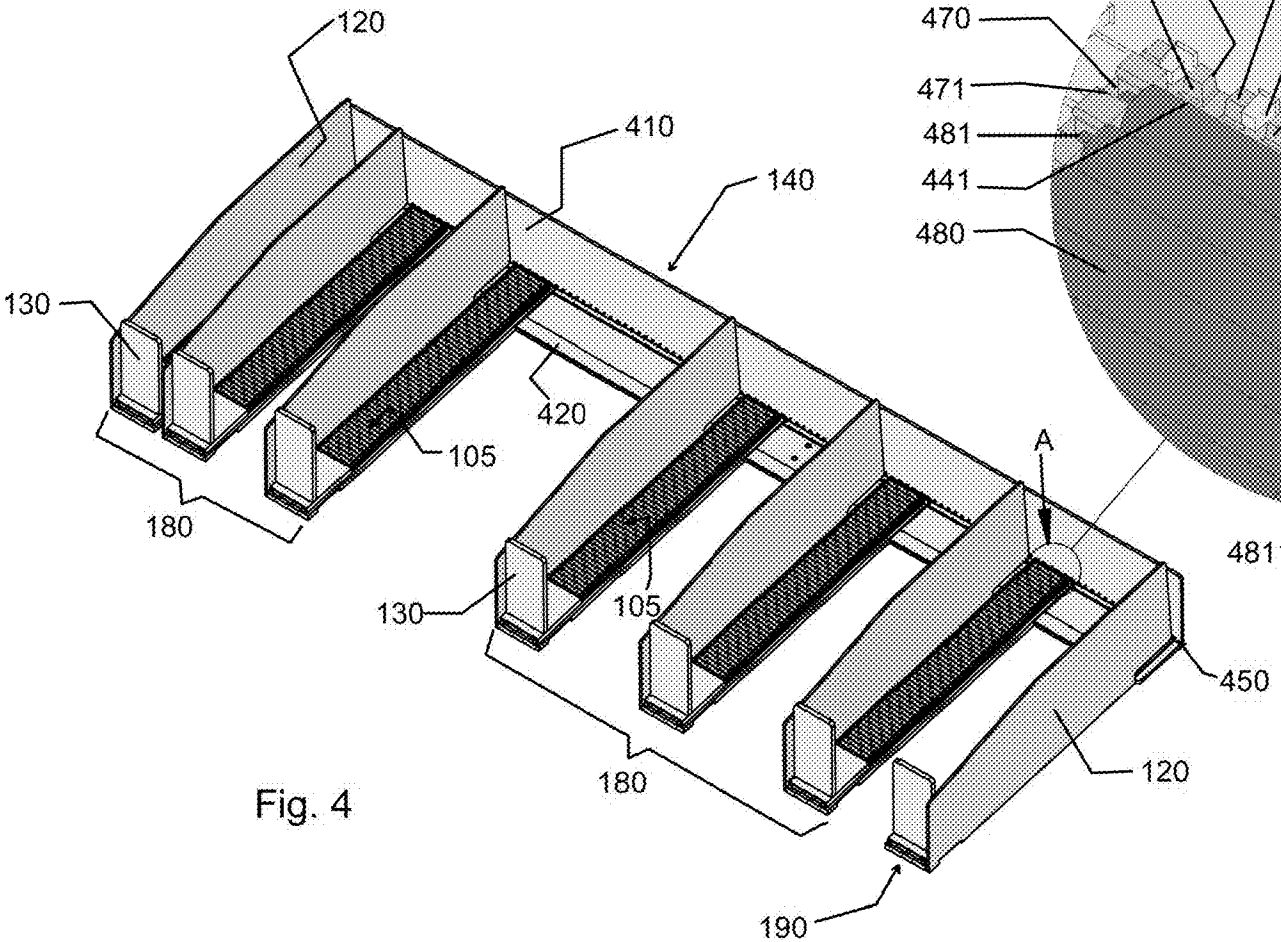
FIG. 4 is a rear perspective view of a partly assembled discrete gravity feed roller seat of the present disclosure.

FIG. 4 shows system 100 having six (6) right roller seats 180 and one (1) left roller seat 190. Also shown in FIG. 4, similarly to FIG. 1, are gravity feed roller seats 105, dividers 120, G-pushers 130 and L-front stop 140. L-front stop 140 comprises a front panel 410 and a front foot 420. The angle between front panel 410 and front foot 420 is 90°. Front panel 410 and front foot 420 can each be made as one integral unit either by tooling or welding, such as by ultrasonic welding using an ultrasonic generator, or other methods. FIG. 4A shows the detail of section "A" of FIG. 4. FIG. 4A shows a plurality of acceptors 430 disposed on a side of front panel 410 that is configured to be adjacent to right base panel 181 and a plurality of snap-in teeth 440 disposed along a front edge 450 of right base panel 181 that is configured to be adjacent to front panel 410. As will be understood, acceptors 430 are disposed proximal an edge 450 of front panel 410 adjacent front foot 420. Accepters 430 and snap-in teeth 440 are disposed and configured so as to interlock with one another. The shapes of accepters 430 and snap-in teeth 440 are designed for tight interlocking mating. In the embodiment shown in FIG. 4A, acceptors 430 and snap-in teeth 440 have the general configuration of four sided pyramids with a flat top. In more detail, acceptors 430 have a generally square four-sided base 431 that gradually tapers to a generally square flat end 432. The taper of acceptors 430 results in all sides 433 of acceptors 430 having a generally trapezoidal-like shape. Also in the embodiment shown in FIG. 4A snap-in teeth 440 have a trapezoidal-shaped base 441 and a trapezoidal-shaped top 442. In the embodiment shown in FIG. 4A, trapezoidal-shaped base 441 and trapezoidal-shaped top 442 gradually taper inwardly from a side 443 distal front panel 410 to a side 444 proximal front panel 410. The complementary configurations of acceptors 430 and snap-in teeth 440 provide a tight fit between the two. For assembly of roller seats 180, 190 and 195 to front panel 410, roller seats 180, 190 and 195 are slid toward front panel 410 so that snap-in teeth 440 engage acceptors 430 by a tight fit. Of course, other configurations and/or designs of acceptors 430 and snap-in teeth 440 will be apparent to those of ordinary skill in the art based on the foregoing descriptions. For example, acceptors 430 could merely be openings of a desired shape, such as circular or square disposed in front panel 410 while, in such a configuration, snap-in teeth 440 could be pins having a mating size and shape to the openings. The density of snap-in teeth 440 can vary, but primarily is determined by considerations of merchandise spacing, the strength of L-stop 140 and others. The length of snap-in teeth can vary as well, as required. For example, 2 mm snap-in teeth 440 may be used. And, as described above, the size of acceptors 430 is determined according to the size and configuration of snap-in teeth 440 to provide tight matching.

FIG. 4A also shows a detail of plurality of rollers 110 and roller support bars 182 of FIG. 1. FIG. 4A shows a portion of roller support bars 182 and a portion of plurality of rollers 110. As can be seen in FIG. 4A, roller support bars 182 have a plurality of substantially evenly spaced side openings 460, a plurality of substantially evenly spaced top openings 470 and, disposed near the upper edge 471 of top openings 470, a pair of oppositely disposed protrusions 472. Each of the plurality of rollers 110 comprises a cylindrical portion 480 having a length and a connector 481 at each end of the length. Each of the plurality of rollers 110 can be inserted into roller support bars 182 by aligning connectors 481 above top openings 470 and pressing downwardly. Connectors 481 are of a size slightly greater than a space 473 between adjacent protrusions 472 such that pressing downwardly on each of the plurality of rollers 110 causes connectors 481 to pass by protrusions 472 and be seated properly into openings 460. Protrusions 472, in the embodiment shown in FIG. 4A, have a rounded configuration such that connectors 481 may pass more easily downwardly therebetween for insertion into openings 460. The connection or fit between connectors 481 and protrusions 472 is of a "snap-fit" nature. Openings 460 are provided through roller support bars 182 so that a tool of suitable size and material may be inserted therein so as to pass under connector 481 and exert an upward force thereon to "pop" connector 481 upwardly past protrusions 472 for removal of any of plurality of rollers 110 from roller support bars 182, such as for replacement of a broken roller 110. While connectors 481 are of a dimension slightly greater than the distance 473 between adjacent protrusions 472, connectors 481 are of a dimension less than openings 460. By this cooperative dimensional relationship between connectors 481, space 473 and openings 460, each of plurality of rollers 110 is assured of being held securely in roller support bars 182 so as to prevent each of plurality of rollers 110 from disengaging out of position in roller support bars 182, yet allow each of plurality of rollers 110 to rotate freely when placed in position in roller support bars 182. Roller support bars 182 also have an undercut slot 490 the function of which will be explained in more detail in conjunction with FIG. 5C, below.

Figures 5, 5A, 5B, 5C:
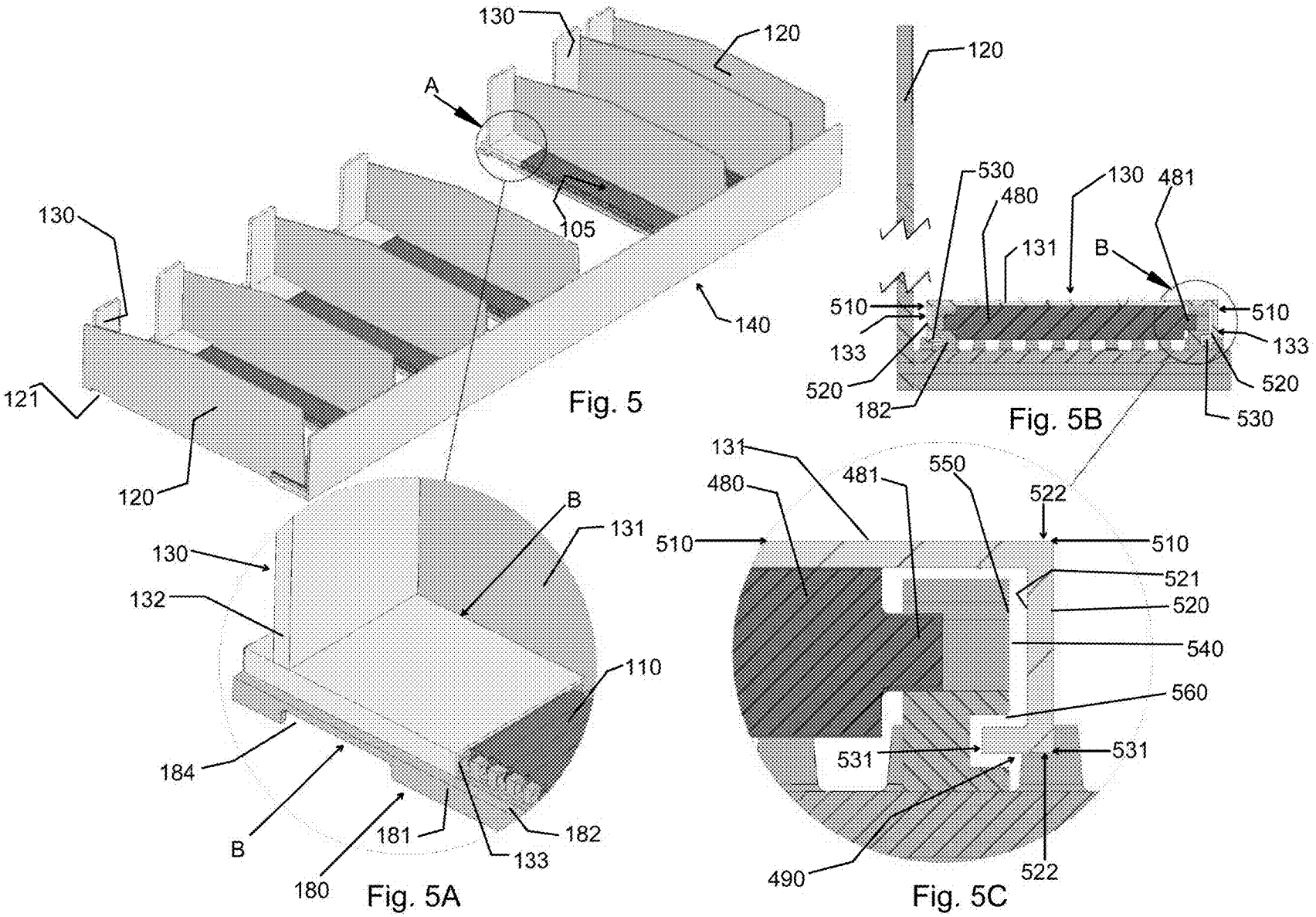
FIG. 5 is a front perspective view of the partly assembled discrete gravity feed roller seat of the present disclosure shown in FIG. 3.
FIG. 5A is a detail view of section "A" of FIG. 5.
FIG. 5B is a cross-sectional view through line "B"-"B" of FIG. 5A.
FIG. 5C is a detail view of section "C" of FIG. 5B.

FIG. 5 shows a front perspective view of system 100. FIG. 5A shows a detail view of section "A" of FIG. 5. FIG. 5B is a cross-sectional view through line "B"-"B" of FIG. 5A. FIG. 5C is a detail view of section "B" of FIG. 5B. FIG. 5C shows details of the structural relationship between driver deck 131, C-channels 133, plurality of rollers 110 and rollers support bars 182. As can be seen in FIGS. 5B and 5C, driver deck 131 has a dimension 510 that is sufficient to cover and extend beyond the dimension of the combination of rollers 110 and roller support bars 182. By having appropriately selected dimension 510, the bottom side of driver deck 131 contacts rollers 110. C-channels 133 are comprised of vertical portions 520 and offset portions 530. Vertical portions 520 are disposed perpendicularly downwardly in relation to dimension 510 of driver deck 131, while offset portions 530 are disposed perpendicularly in relation to vertical portions 520 and parallel in relation to dimension 510 of driver deck 131. Dimension 510 is selected so that vertical portions 520 pass adjacent to roller support bars 182 leaving a small gap 540 between outer edge 550 of roller support bars 182 and inside surface 521 of vertical portions 520. Vertical portions 520 also have a length 522 such that a small gap 560 is provided between offset portions 530 and roller support bars 182. Offset portions 530 have a length 531 that is sized and configured such that offset portions 530 sufficiently engage undercut slot 490 of roller support bars 182 so that offset portions 530 prevent driver deck 131 from lifting off from contact with rollers 110 while, at the same time preferably, not making direct contact with any surface forming undercut slot 490. The foregoing configuration of driver deck 131 and C-channels 133 allows for driver deck 131 to substantially contact only rollers 110. As such, the foregoing configuration minimizes the amount of friction between driver deck 131 and C-channels 133 and roller support bars 182 while, at the same time, appropriately securing driver 130 in place.

Figures 6A, 6B, 6C, 6D:
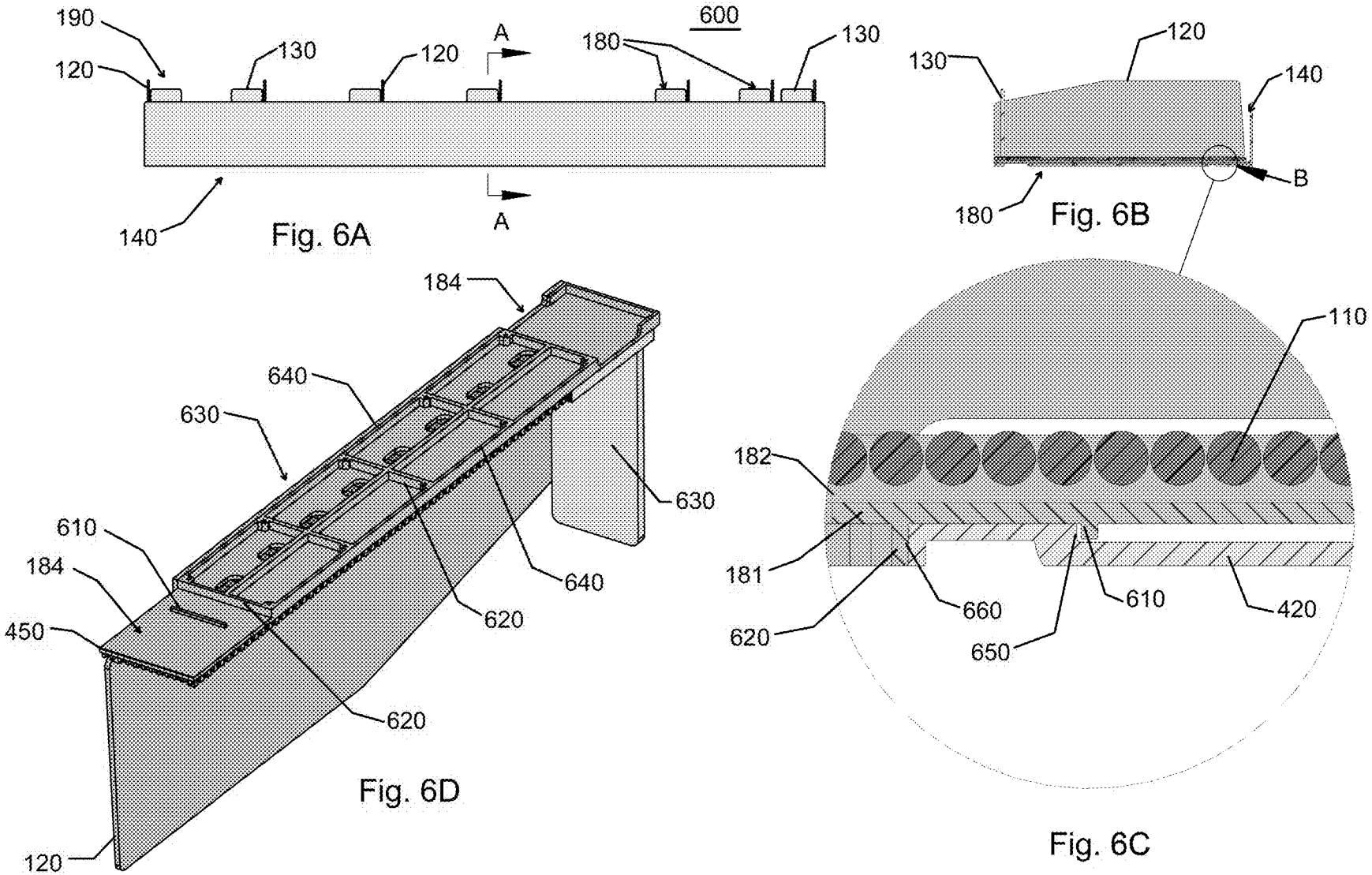
FIG. 6A is a front view of plurality of discrete gravity feed roller seats of the present disclosure.
FIG. 6B is a cross-sectional view through line "A"-"A" of FIG. 6A.
FIG. 6C is a detail view of section "B" of FIG. 6B.
FIG. 6D is a bottom view of a discrete gravity feed roller seat.

FIG. 6A shows a front view of a system 600 showing six (6) right roller seats 180, one (1) left roller seat 190, L-front stop 140 and seven (7) driver panels 130. FIG. 6B shows a cross-sectional view through line "A"-"A" of FIG. 6A. FIG. 6B shows right roller seat 180, L-front stop 140, G-driver 130 and divider 120. FIG. 6C shows a detail view of section "B" of FIG. 6B. FIG. 6C shows the structural relationship of plurality of rollers 110, roller support bar 182, a lock bar 610, front foot 420, right base panel 181 and a transverse rib 620 (see, FIGS. 6D and 7E). FIG. 6D shows a bottom view of right roller seat 180. FIG. 6D shows that the bottom of right base panel 181 (and the same applies generally to left base panel 191 and T-base panel 196) has a base grid 630 comprised of a plurality of longitudinal ribs 640 and a plurality of transverse ribs 620 that serve to increase the stiffness/strength of right base panel 181 (similar comments apply of course to left base panel 191 and T-base panel 196). Disposed on the bottom of right base panel 181 and proximal front edge 450 of right base panel 181 is lock bar 610. Lock bar 610 mates against a first raised portion 650 of front foot 420 (see, e.g., FIGS. 6C and 7E) to matingly engage right base panel 191 with front foot 420. Also, transverse rib 620 that is most proximal front edge 450 and lock bar 610 matingly engages with a second raised portion 660 of front foot 420. Combined with the mating engagement of acceptors 430 and snap-in teeth 440, transverse rib 620 and lock bar 610 that matingly engage with raised portions 650, 660 of front foot 420 serve to enhance stability and tightness of the completely assembled system(s) 100, 600 and, in particular, provide a tight and strong engagement between roller seats 180, 190 and 195 and L-front stop 140. Of course, any one or more of acceptors 430, snap-in teeth 440, transverse rib 620 and lock bar 610 may be omitted and system(s) 100, 600 will still function for their intended purposes.

Figures 7A, 7B, 7C, 7D, 7E:
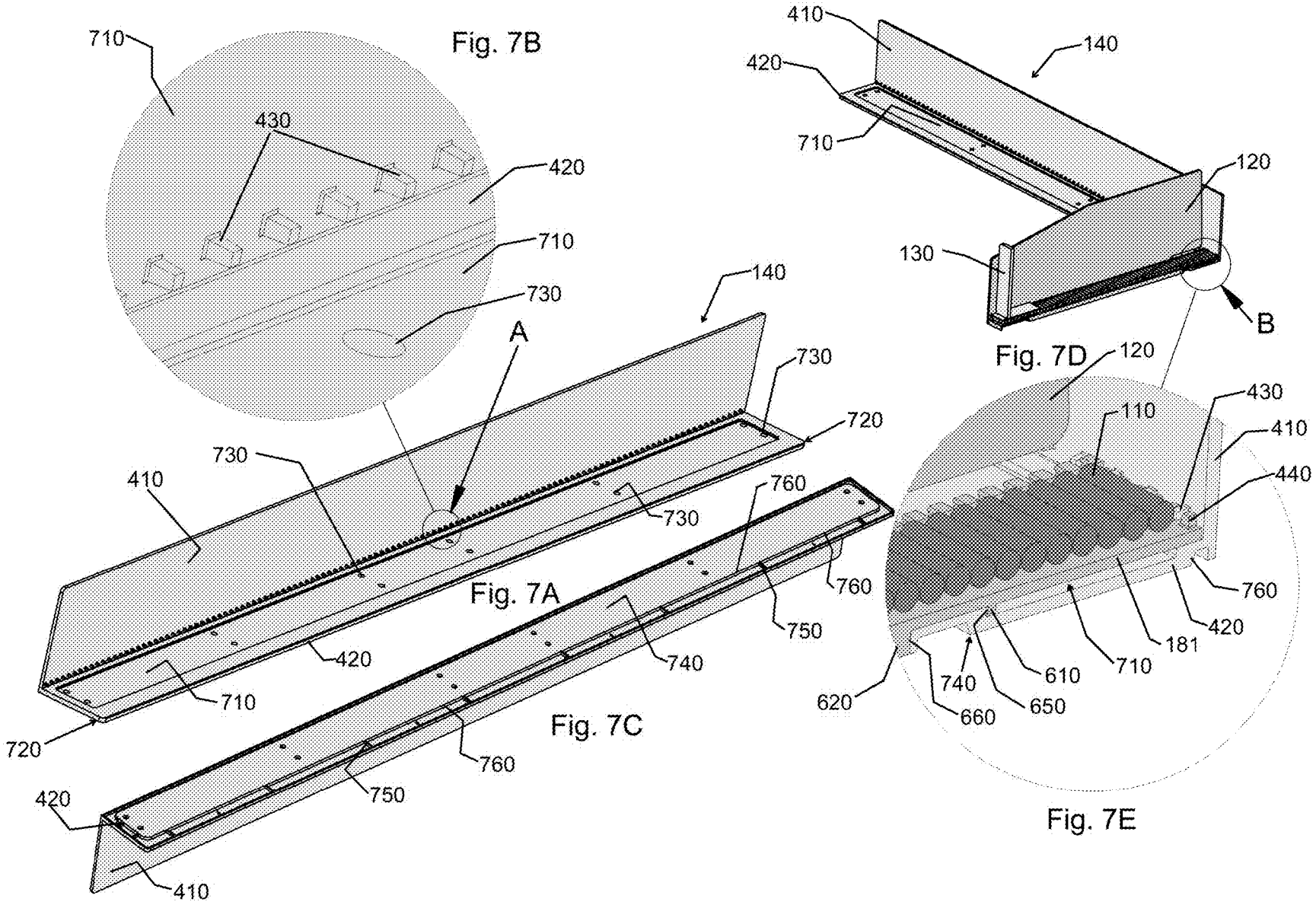
FIG. 7A is a top rear perspective view of an L-front stop to which a plurality of discrete gravity feed roller seats of the present disclosure attaches at a front end.
FIG. 7B is a detail view of section "A" of FIG. 7A.
FIG. 7C is a bottom rear perspective view of the L-front stop of FIG. 7A.
FIG. 7D is a rear perspective view of a discrete gravity feed roller seat attached to L-front stop.
FIG. 7E is a detail view of section "B" of FIG. 7D.

FIG. 7A shows a top rear perspective view of L-front stop 140 comprising front panel 410 and front foot 420 which, as described above in conjunction with e.g., FIGS. 4A and 6C, serve to secure right roller seats 180, left roller seats 190 and T-roller seats 195 to L-front stop 140 and provide structural strength to, e.g., system(s) 100, 600. FIG. 7A shows that there is a sunken area 710 in front foot 420 that extends nearly the entire length 720 of front foot 420. The purpose of sunken area 710 is to allow space to countersink a plurality of push-pin caps 1130 (see, e.g., FIGS. 11B and 11C) into a plurality of openings 730 through front foot 420 and into mating openings (not shown) disposed in shelf support 150. Sunken area 710 allows push-pin caps to mate openings 730 and openings disposed in shelf support sufficiently below bottom surfaces of left roller seats 180, right roller seats 190 and T-roller seats 195 so as not to interfere with the placement of left roller seats 180, right roller seats 190 and T-roller seats 195 in position on shelf support 150. It should be noted here that cut out area 184 disposed proximal front edge 450 right base panel 181 adjacent to front panel 410 allows for right base panel 181 to seat properly over front foot 420 and, inter alia, allow for push-pin caps 1130 (see, e.g., FIGS. 11B and 11D) to fit in sunken area 710. Similar comments apply to cut out areas 121, 192 and 197. FIG. 7B shows a detailed view of section "A" of FIG. 7A. FIG. 7B shows the "connection area" between front panel 410 and front foot 420, including accepters 430 on front panel 410, sunken area 710, and holes 730 on front foot 420. FIG. 7C shows a bottom view of FIG. 7A, and the embossed underside 740 of sunken area 710 and front foot ribs 750 of front foot 420. Embossed underside 740 is offset below front foot by approximately the depth 760 of sunken area 710. Both embossed underside 740 and front foot ribs 750 serve to provide greater stiffness to front foot 420 for purposes of weight support. FIG. 7D shows right roller seat 180 with right divider 120 that perpendicularly meets L-front stop 140. FIG. 7E shows a detailed view of section "B" of FIG. 7D. FIG. 7E shows the structural relationship and mating between acceptors 430, snap-in locks 440, lock bar 610, transverse rib 620, first raised portion 650, second raised portion 660 and sunken area 710. As shown in, e.g., FIG. 7E lock bar 610 and transverse rib 620 are separated so as to correctly meet first raised portion 650 and second raised portion 660, respectively. As a result of the foregoing preferred structural relationship and mating, the front and rear sections of right roller seat 180 are firmly locked onto L-front stop 140.

Figures 8, 8A, 8B, 8C, 8D:
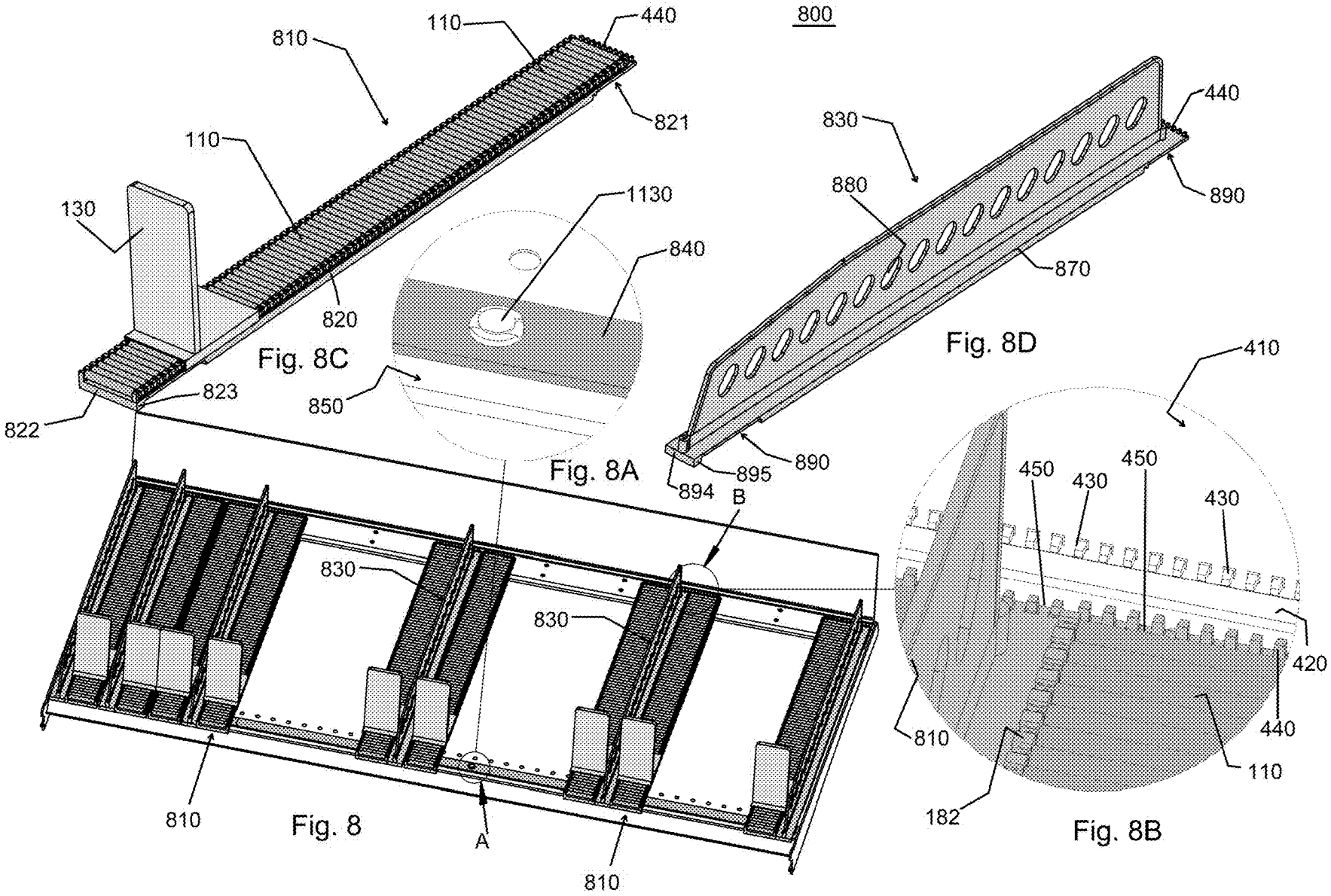
FIG. 8 is an elevated rear view of a plurality of discrete gravity feed roller seats of the present disclosure disposed on a shelf support.
FIG. 8A is a detail view of section "A" of FIG. 8.
FIG. 8B is a detail view of section "B" of FIG. 8.
FIG. 8C is a rear perspective view of an alternate embodiment of a roller seat of a discrete gravity feed roller seat of the present disclosure.
FIG. 8D is a side perspective view of an alternate divider seat of the present disclosure.

An optional configuration of a system 800 according to the present disclosure is shown in FIGS. 8-8D. FIG. 8 shows a rear perspective view of system 800 that includes a plurality of individual discrete gravity feed roller seats 810 having pushers 130 and discrete base panels 820, discrete dividers 830, one L-front stop 140 and one rear cleat strip 840. As can best be seen in FIG. 8C, discrete base panel 820 has cut out areas 821 similar to cut out areas 184, 192 and 197 discussed above with respect to FIG. 7A. As with previous Figures, L-front stop 140 is disposed proximal the front edge of shelf support 150, secured with push-pin caps 1130. FIG. 8 also shows a plurality of discrete dividers 830 disposed between discrete gravity feed roller seats 810. FIG. 8A shows a detailed view of section "A" of FIG. 8. FIG. 8A shows how rear cleat strip 840 secures to the rear edge of shelf support 150, also with push-pin caps 1130. Cut out areas 821 disposed near rear edge 822 of discrete base panels 820 (see, FIG. 8C), similarly to rear cut out areas 184, 192 and 197, have two functions. One function is to allow for space below bottom of discrete base panels 820 to accommodate rear cleat strip 840 and push-pin caps 1130, and a second function is to provide a rear lip 823 that fits into a space 850 between rear cleat strip 840 and rear edge of shelf support 150. Rear cleat strip 840, attached by push-pin caps 1130, is used to provide space 850 for attachment of rear lips of right base panels 181, left base panels 191, T-base panels 196, discrete base panels 820 and discrete divider seats 870 at a location proximal rear edge of shelf support 150 in all embodiments of the present disclosure. Of course, the dimension of rear cleat strip 840 and space 850 can be varied as needed to accommodate the size of the rear lips which may vary (compare, e.g., the rear lips of right base panels 181, left base panels 191 and T-base panels (FIGS. 1-7) to the rear lips 823, 895 of discrete base panels 820 and discrete divider seats 870, respectively (FIGS. 8-12)). It should be noted here that cut out areas 121, 184, 192, 197, 821 and 890 disposed proximal a rear edge of divider 120, right base panel 181, left base panel 191, T-base panel 196, discrete base panel 820 and discrete divider seat 870 allow for divider 120, right base panel 181, left base panel 191, T-base panel 186, discrete base panel 820 and discrete divider seat 870 to seat properly over rear cleat strip 840 and, inter alia, allow for push-pin caps 1130 (see, e.g., FIGS. 11B and 11D) to fit thereunder. FIG. 8B shows a detailed view of section "B" of FIG. 8. FIG. 8B shows accepters 430 of front panel 410 that interlock with snap-in teeth 440 of discrete base panels 820 and snap-in teeth 440 of discrete divider seats 870. Discrete dividers 830 include holes 880 therein to reduce weight. FIG. 8C shows gravity feed roller seat 810, which comprises G-pusher 130 and plurality of rollers 110 on discrete base panel 820. FIG. 8D shows a discrete divider 830 comprised of one discrete divider panel 831 and one discrete divider seat 870 having a grid 1010 (see, FIG. 10B) on the underside. The longitudinal edges 890 along the sides of the discrete divider seat 870 retain merchandise at the correct distance from the discrete divider 831. FIG. 8D shows that discrete dividers 831 also have cut out areas 890 that serve the same purposes as cut out areas 184, 192, 197 and 821, and discrete divider openings 880 that reduce weight. FIG. 8D also shows near a rear edge 894 and a rear lip 895 that fits into space 850 between rear cleat strip 840 and rear edge of shelf support 150. The optional configuration of system 800 shown in FIGS. 8-8D provides flexibility of configuring system 800 in that, for example, system 800 is not bound by size constraints as may be system(s) 100 and 600 that have dividers 120 or 220 affixed to, or have dedicated positions therefor on, right roller seat 180, left roller seat 190 and T-roller seat 195.

Figures 9A, 9B:
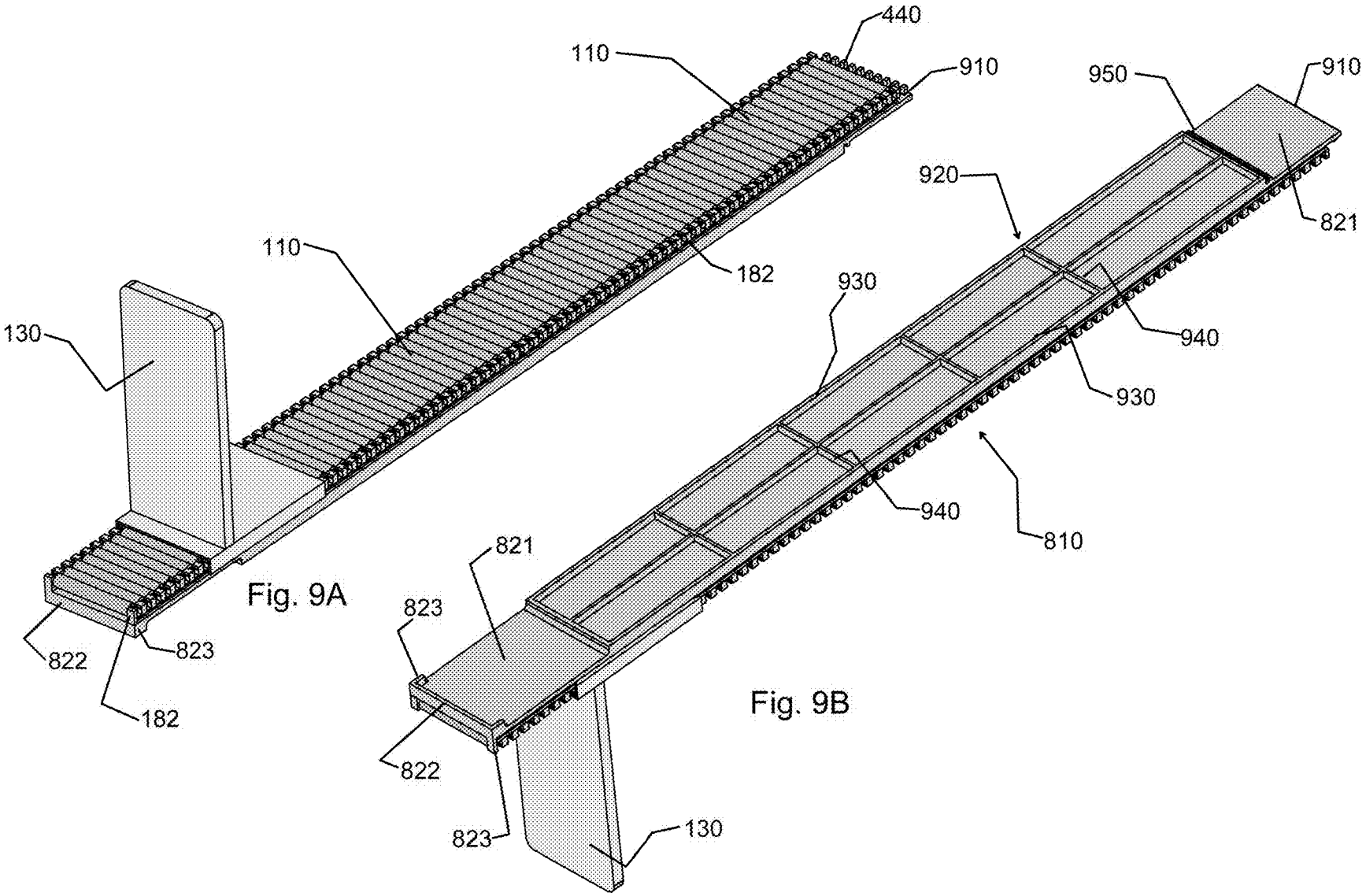
FIG. 9A is a rear perspective view of a roller seat of a discrete gravity feed roller seat of the present disclosure, with the G-driver shown in ghosted view.
FIG. 9B is a bottom view of the roller seat shown in FIG. 9A.

FIGS. 9A and 9B show a top rear perspective view and bottom rear perspective view of individual discrete gravity feed roller seat 810, respectively. FIG. 9A shows a front edge 910 of individual discrete gravity feed roller seat 810 having a plurality of snap-in teeth 440 evenly spaced thereon which serve the same purpose as snap-in teeth 440 as discussed in detail in, e.g. FIG. 4A. FIG. 9B shows an underside of individual discrete gravity feed roller seat 810 having disposed thereon a base grid 920 comprised of longitudinal ribs 930 and transverse ribs 940 that serves the same purpose and has the same function as base grid 630 discussed in conjunction with FIG. 6D. FIG. 9B also shows a lock bar 950. It will be noted that lock bar 950 is disposed closely to base grid 920. The reason for this is that the embodiment of discrete gravity feed roller seat 810 shown in FIGS. 9A-9B, as well as the embodiment of discrete divider 830 shown in FIGS. 10A-10B, each is configured to cooperatively mate with the flange of the configuration of extruded aluminum foot 1120 discussed in detail in FIGS. 11-11D. Lock bar 950 serves the same purpose and has same function as lock bar 610 discussed in conjunction with FIG. 6D.

Figures 10A, 10B:
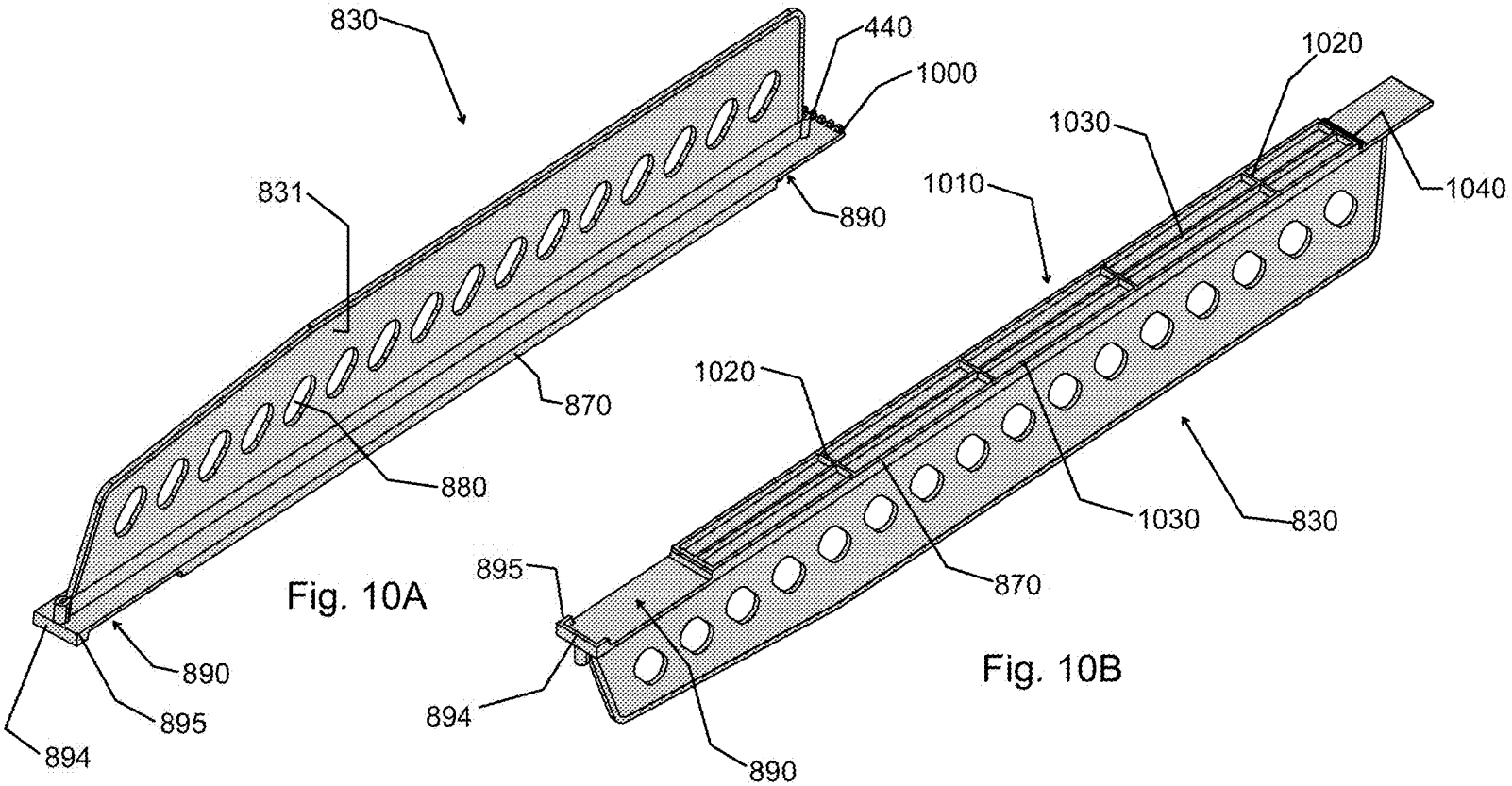
FIG. 10A is a rear perspective view of an alternated divider seat showing one divider of a discrete gravity feed roller seat of the present disclosure.
FIG. 10B is a bottom perspective view of the divider seat of FIG. 10A.

FIGS. 10A and 10B show a top rear perspective view and bottom perspective view of discrete divider 830, respectively. FIG. 10A shows a front edge 1000 of discrete divider 830 having a plurality of snap-in teeth 440 evenly spaced thereon which serve the same purpose as snap-in teeth 440 as discussed in detail with respect to, e.g. FIG. 4A. FIG. 10B shows an underside of discrete divider seat 870 having disposed thereon a base grid 1010 comprised of transverse ribs 1020 and longitudinal ribs 1030 that serves the same purpose as a second function as base grid 630 discussed in conjunction with FIG. 6D. FIG. 10B also shows a lock bar 1040 that serves the same purpose and has the same function as lock bar 950 discussed in conjunction with FIG. 9B.

Figures 11, 11A, 11B, 11C, 11D:
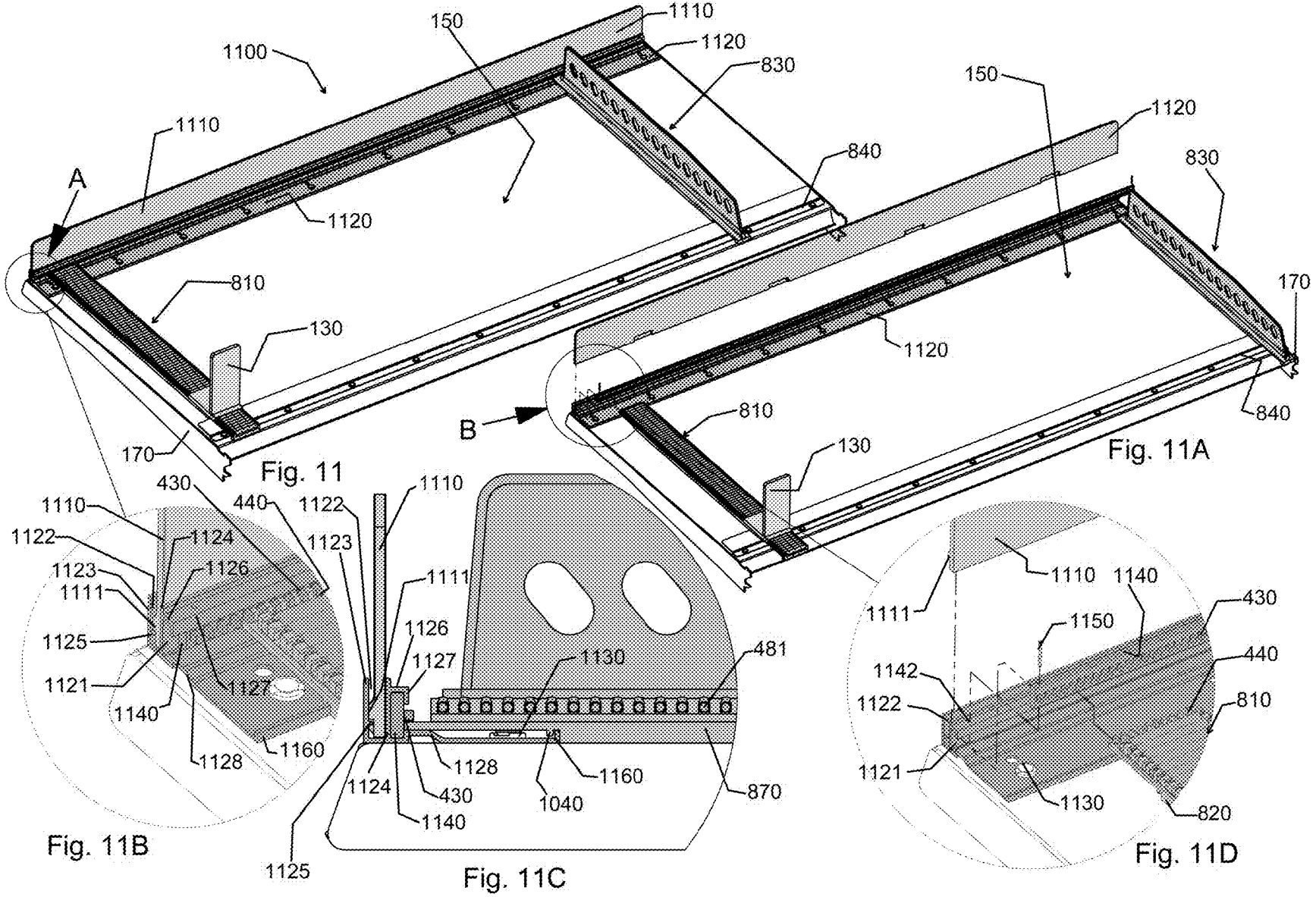
FIG. 11 is a rear perspective view of a discrete gravity feed roller seat and discrete divider of the present disclosure in place on a shelf support.
FIG. 11A is a partly exploded view of the discrete gravity feed roller seat of FIG. 11.
FIG. 11B is a detail view of section "A" of FIG. 11.
FIG. 11C is a detail view of FIG. 11B.
FIG. 11D is a detail view of section "B" of FIG. 11A.

FIG. 11 shows a rear perspective view of discrete gravity feed roller seat 810 and discrete divider 830 of the present disclosure in place on shelf support 150. Also shown in FIG. 11 are brackets 170, bracket supports 171 and G-pusher 130. All of discrete gravity feed roller seat 810, discrete divider 830, shelf support 150, brackets 170, bracket supports 171 and G-driver 130 have been discussed in detail in conjunction with preceding Figures, and that discussion will not be repeated here. FIG. 11 also shows an alternate embodiment of an L-front stop 1100 of the present disclosure. L-front stop 1100 is comprised of an extruded front panel 1110 and an extruded aluminum front foot 1120. Front panel 1110 can be made of extruded aluminum or plastic. FIG. 11A shows a partly exploded view of the discrete gravity feed roller seat 810, discrete divider 830, front panel 1110 and extruded aluminum front foot 1120 of FIG. 11 which will be discussed in more detail in conjunction with FIG. 11D. FIG. 11B is a detail view of section "A" of FIG. 11. FIG. 11B shows front panel 1110 and an acceptor strip 1140 (see also, FIG. 11D). Front panel 1110 is of a configuration of front panel 1110 that is presently used with existing shelving systems. Acceptor strip 1140 can be molded or extruded and, different than acceptors 430 disposed on front panel 410 (see, FIG. 4), allows the use of existing front panels 1110 with extruded aluminum front foot 1120. Extruded aluminum front foot 1120 is affixed to shelf support 150 using push-pins 1130 in the same manner as discussed above conjunction with FIGS. 7A and 8C. Extruded aluminum front foot 1120 comprises a flange 1160 that is disposed generally perpendicularly away from shelf support 150. Flange 1160 is disposed and configured to perform the same function as both first raised portion 650 and second raised portion 660 of front foot 420 discussed in conjunction with FIGS. 6A-6D. Extruded aluminum front foot 1120 also comprises a C-channel 1121 and a U-channel 1122. U-channel 1122 comprises two walls, a forward wall 1123 and a rear wall 1124. Forward wall 1123 and rear wall 1124 are each disposed generally perpendicularly to shelf support 150. In the embodiment shown in FIG. 11B, forward wall 1123 and rear wall 1124 are of approximately the same length, but this configuration is not necessary. All that is required is that front wall 1123 and rear wall 1124 are of sufficient dimension to retain front panel 1110. Also, forward wall 1123 and rear wall 1124 are separated by a space that is sized and configured to accept front panel 1110. Forward wall 1123, in the embodiment shown in FIG. 11B, also comprises a stop 1125 that is disposed on forward wall 1123 between forward wall 1123 and rear wall 1124. Stop 1125 is sized and configured to meet a protrusion 1111 that is generally provided on front panels 1110. Together, protrusion 1111 and stop 1125 form a "snap-fit" connection between front panels 1110 and aluminum front foot 1120. Of course, it will be understood that stop 1125 can be omitted since protrusion 1111 may provide a tight fit between existing wall panel 1110 and the dimension of the space between front wall 1123 and rear wall 1124, but this configuration is not preferred. C-channel 1121 is comprised of (1) a generally perpendicular portion 1126 disposed substantially perpendicularly from rear wall 1124 in a direction away from front wall 1123, (2) a flange 1127 disposed generally perpendicularly to perpendicular portion 1126 in a direction toward shelf support 150 and (3) a raised portion 1128 disposed away from shelf support 150 and toward flange 1127. In combination, generally perpendicular portion 1126, flange 1127 and raised portion 1128 form a generally rectangular "C" configuration for C-channel 1121. The configuration of C-channel 1121 is such that it provides a tight fit for acceptor strip 1140 while, at the same time providing an open area (i.e., the "open" portion of the "C" configuration) to expose acceptors 430 on acceptor strip 1140 so that acceptors 430 on acceptor strip 1140 can properly mate with snap-in teeth 440. The configuration of extruded aluminum front foot 1120 and its cooperative relation with front panel 1110 and acceptor strip 1140 can be more clearly seen in FIG. 11C. FIG. 11C is a side view of FIG. 11B, showing the cooperative structural arrangements between the elements described with respect to FIG. 11B. Of note, FIG. 11C shows that the close spatial arrangement of lock bar 1040 to base grid 1020 provides for the correct spacing to accept flange 1160 by discrete divider base 1010 and lock bar 1040. FIG. 11D is a detail view of section "B" of FIG. 11A. As can be seen in FIG. 11D, the assembly of discrete gravity feed roller seat 810, discrete divider 830 and acceptor strip 1140 into and with extruded front foot 1120 is straightforward. First, front panel 1110 is inserted vertically downward into U-channel 1122 until protrusion 1111 meets stop 1125, if present. Otherwise, front panel 1110 is merely inserted into U-channel 1122 until the bottom of front panel 1110 abuts the bottom of U-channel 1122. Second, acceptor strip 1140 is slidably inserted into C-channel 1121, and through-holes 1141 on acceptor strip 1140 are aligned with through-holes 1142 of C-channel 1121. Third, push pins 1150 are inserted into through-holes 1142 and into through-holes 1141. Push pins 1150 serve to affix and maintain connector strip 1140 in position so that acceptors 430 are correctly seated to mate with snap-in teeth 440. Finally, discrete gravity feed roller seat 810 and discrete divider 830 are seated so that snap-in teeth 440 mate with acceptors 430 and lock bars 950 and 1040, respectively, are seated against both sides of flange 1160. Attachment of the rear lips 823, 895 of discrete gravity feed roller seat 810 and discrete divider 830 are performed as discussed previously.

Figures 12, 12A, 12B, 12C:
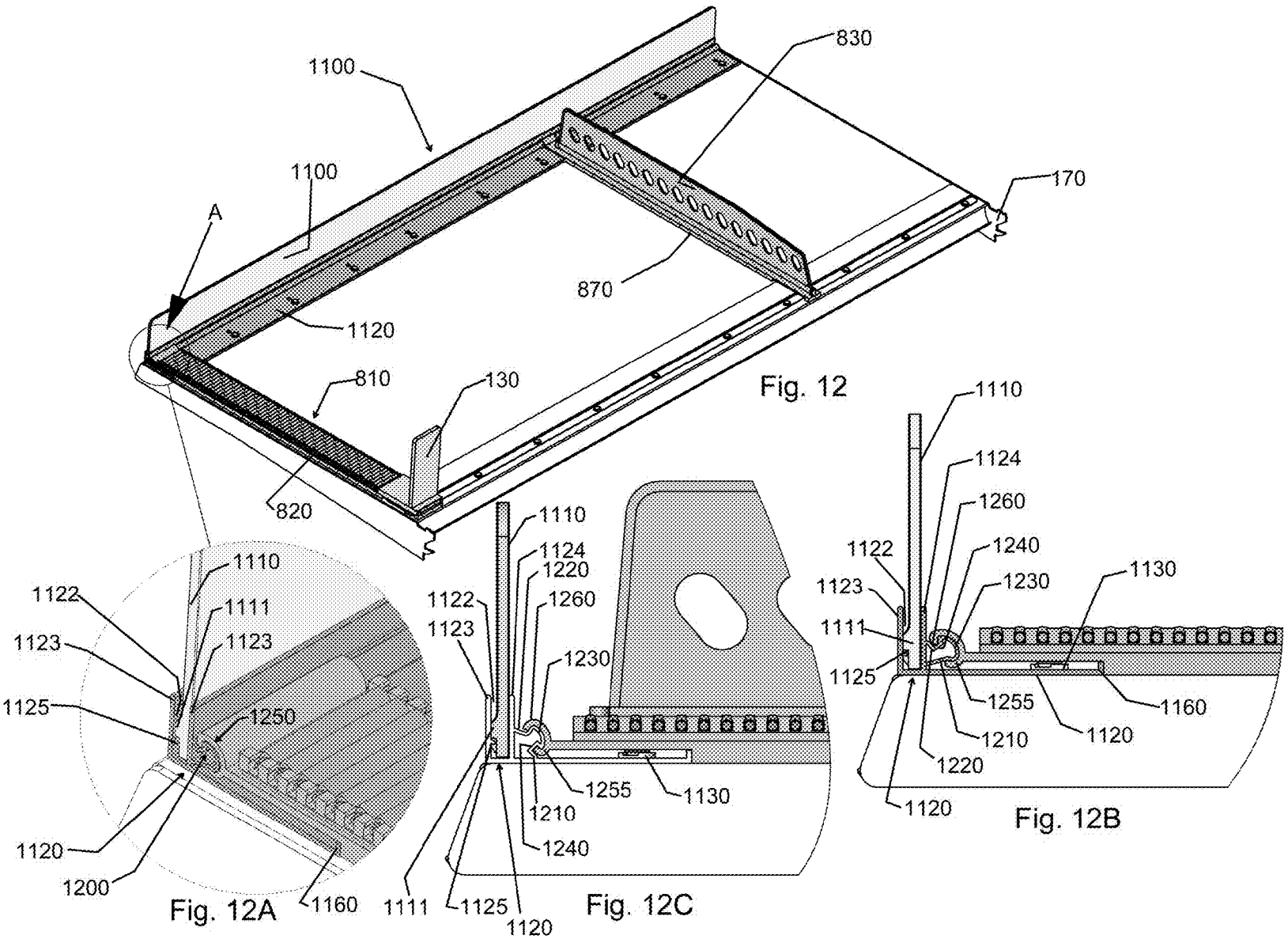
FIG. 12 is a rear perspective view of a discrete gravity feed roller seat and discrete divider seat of the present disclosure having an alternate locking mechanism in place on a shelf support.
FIG. 12A is a detail view of section "A" of FIG. 12.
FIG. 12B is a cross-sectional view of FIG. 12A.
FIG. 12C is a cross-sectional view of an alternate locking mechanism to that shown in FIG. 12B.

FIG. 12 is a rear perspective view of another alternate embodiment of an L-front stop 1100 of the present disclosure that can be used with discrete gravity feed roller seat 810 and discrete divider seat 870. The alternate embodiment of L-front stop 1100, discrete roller base panel 820 and discrete divider seat 870 provide alternate attachment elements. Besides the locking system embodiments that use accepters 430 and snap-in teeth 440, the alternative embodiment shown in FIGS. 12-12C uses a snap-in "C-front" on discrete roller base panel 820 and discrete divider seat 870 that mate with, e.g., a matching "rod-like" element disposed on extruded front foot 1120. This configuration allows discrete roller base panel 820 and discrete divider seat 870 to be placed without limitation along the matching "rod-like" element. This configuration also allows discrete roller base panel 820 and discrete divider seat 870 to be arranged along the front of shelf support 150 without being limited to the placement of acceptors 430 and snap-in teeth 440. Consequently, this allows discrete roller base panel 820 and discrete divider seat 870 to adapt to any merchandise POG more efficiently. Referring to FIG. 12A, extruded front foot 1120 includes front wall 1123, rear wall 1124, U-channel 1121, protrusion 1111, stop 1125 and flange 1160 that are the same as shown in FIG. 11B. In FIG. 12A, rear wall 1124 has disposed thereon a closed hollow member 1200. Referring to FIG. 12B, closed hollow member 1200 comprises two struts, a lower strut 1210 and an upper strut 1220 that are affixed to rear wall 1124. Lower strut 1210 and upper strut 1220 project outwardly from rear wall 1124 in a direction away from front wall 1123. At distal ends of lower strut 1210 and upper strut 1220, i.e., away from rear wall 1124, is a curved portion 1230. Disposed along upper strut 1220 between rear wall 1123 and curved portion 1230 is a notch 1240. In combination, lower strut 1210, upper strut 1220, curved portion 1230 and notch 1240 replace acceptors 430 on extruded front foot 1120. Disposed on front edge 450 of discrete roller base panel 820 is an open curved portion 1250. Open curved portion 1250 is designed and configured to substantially mate with curved portion 1230 and notch 1240 as can be more clearly seen in FIG. 12B. Referring to FIG. 12B, the cooperative configuration of closed hollow portion 1200 and open curved portion 1250 is shown in side view in conjunction with discrete divider seat 870. As shown in FIG. 12B, open curved portion 1250 comprises two lips, a lower lip 1255 and an upper lip 1260. Lower lip 1255 and upper lip 1260 are disposed and configured on open curved portion 1250 to surround closed hollow portion 1200 and contact lower strut 1210 and upper strut 1220, respectively. In addition, upper lip 1260 is further configured to matingly engage notch 1240. By this configuration, open curved portion 1250 engages closed hollow portion 1200 tightly, yet allows for lateral movement of discrete roller base panel 820 and/or discrete divider seat 870 along closed hollow portion 1200. This can most easily be accomplished by lifting discrete base panel 820 and/or discrete divider seat 870 slightly upwardly at the rear end thereof. As can be appreciated, this also allows for fine positional placement of discrete roller base panel 820 and/or discrete divider seat 870 along closed hollow portion 1200. At the same time, the configuration of open curved portion 1250 that engages closed hollow portion 1200 provides for a "locking action" between the two. As will be further appreciated, the positions of closed hollow portion 1200 and open curved portion 1250 may be reversed, i.e. closed hollow portion 1200 may be disposed proximal front edge 450 of discrete roller base panel 820 or discrete divider seat 870 and open curved portion 1250 may be disposed along rear wall 1124. Accordingly, closed hollow portion 1200 of extruded front foot 1120 acts like a "sliding rod", allowing fine positional placement of discrete roller base panel 820 and/or discrete divider seat 870 there along. FIG. 12C is similar to FIG. 12B except that lower strut 1210 connects to the bottom of extruded front foot 1120 rather than rear wall 1124, notch 1240 is disposed in lower strut 1210 and lower lip 1255 is designed and configured to engage notch 1240. As will be apparent to those of skill in the art, while specific configurations of closed hollow portion 1200 and open curved portion 1250 have been described with respect to FIGS. 12-12C, closed hollow portion 1200 and open curved portion 1250 will be designed and configured to match each other to the extent desired for any particular installation. The possible varieties of designs for these elements and their lateral movement and locking and unlocking functions are constrained only by space limitations of any particular installation. In most cases, the material of open curved portion 1250 will be the same plastic as that of discrete roller base panel 820 and/or discrete divider seat 870. Closed hollow portion 1200 can be fabricated of aluminum, other metals, and any variety of plastic. Other materials can be used as well. The structure of closed hollow portion 1200 can be solid or, as exemplified, hollow. An advantage of the embodiment shown in FIGS. 12-12C, as noted, is that discrete roller base panels 820 and/or discrete divider seats 870 are essentially unlimited in lateral movement so as to adapt to the merchandise POG. Regarding the rear sections of discrete roller base panel 820 and/or discrete divider seat 870, these will be attached similarly to the embodiment as shown in FIG. 8, in order to move and hold discrete roller base panel 820 and/or discrete divider seat 870 in accordance with the front positions of discrete roller base panels 820 and/or discrete divider seats 870.

Figures 13, 13A, 13B, 13C, 13D:
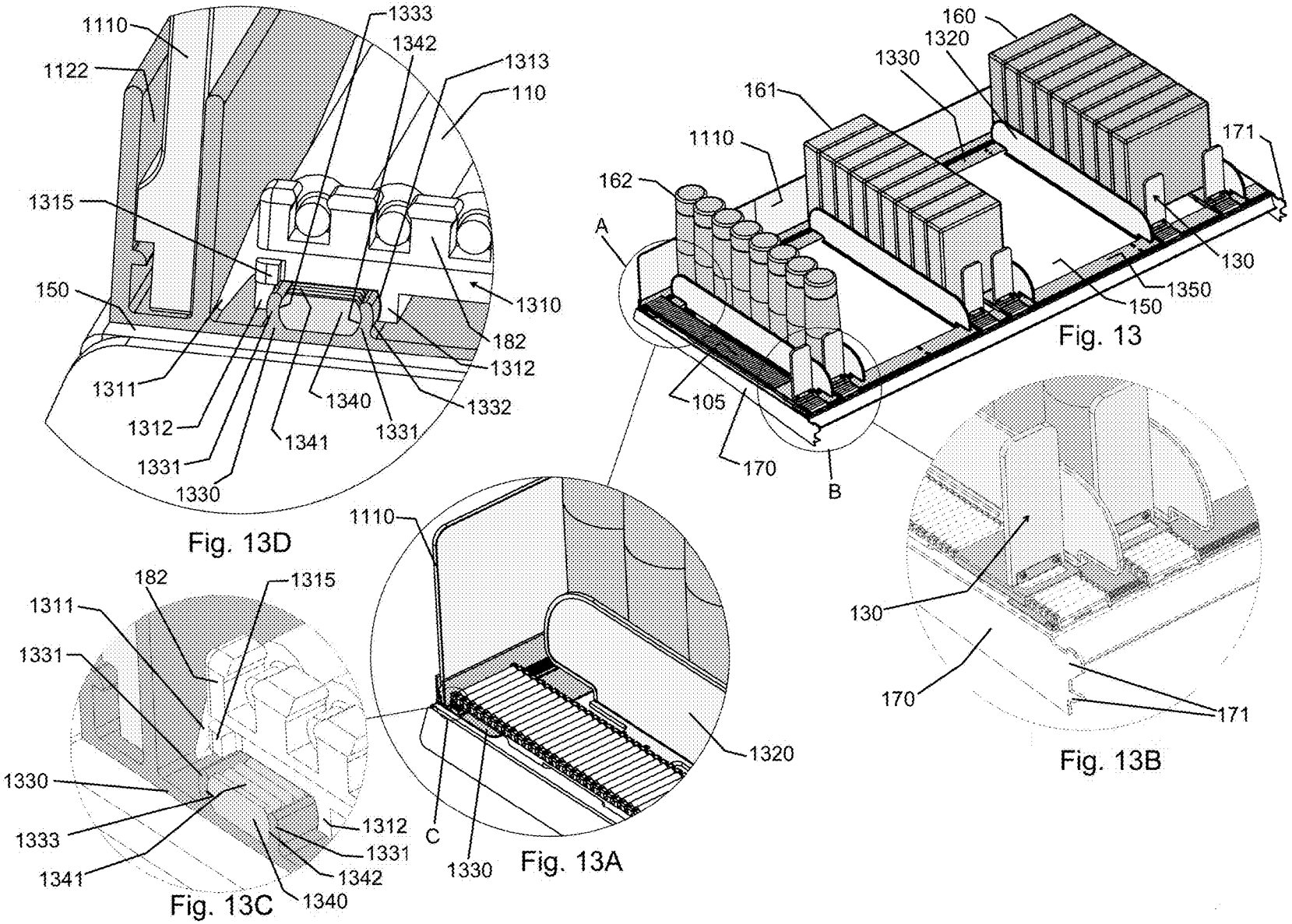
FIG. 13 is a left side rear perspective view of an embodiment of the discrete gravity feed roller seat and adjustable divider of the present disclosure having an alternate locking mechanism in place on a shelf support.
FIG. 13A is a detail view of section "A" of FIG. 13.
FIG. 13B is a detail view of section "B" of FIG. 13.
FIG. 13C is a detail view of section "C" of FIG. 13A.
FIG. 13D is a side view of FIG. 13C.

FIG. 13 shows an embodiment of the discrete gravity feed roller seat and adjustable divider of the present disclosure having an alternate locking mechanism in place on a shelf support. In FIG. 13, roller seats 105, rollers 110, G-pushers 130, shelf support 150, merchandise packages 160, 161 and 162, brackets 170, bracket supports 171, roller support bars 182, and front panel 1110 are the same as described with respect to previous Figures. Differences between the embodiment shown in FIG. 13 and those in previous Figures reside in a snap-in roller seat 1310, an adjustable divider 1320, an extruded front foot 1330, a lock rod 1340 (rather than acceptor strip 1140) and rear lock strip 1350. In more detail, snap-in roller seat 1310 has a length with two ends. Integral with each end is a locator 1311, the function of which is to ensure correct placement of snap-in roller seat 1310 in relation to extruded front foot 1330, as will be described in more detail below. Also, integral with each end is a pair of locking flanges 1312 that are disposed and configured to matingly engage a pair of lock rod holders 1331 that are integral with extruded front foot 1330 as will be described below. Proximal each end is a stop protrusion 1315 that serves to limit the forward and rearward movement of G-driver. As a result of having locators 1311 and locking flanges 1312 proximal each end of snap-in roller seat 1310, snap-in roller seat 1310 is symmetrical and reversible end-to-end. Extruded front foot 1330 comprises a U-channel 1122 that is the same as discussed in conjunction with, e.g., FIG. 11. Extruded front foot 1330 differs from extruded front foot 1120 in that extruded front foot 1330 does not include C-channel 1121 but, rather, comprises a pair of lock rod holders 1331 that are disposed and configured to (1) matingly engage locking flanges 1312 and (2) hold lock rod 1340. Lock rod holders 1331 are disposed on extruded front foot 1330 in a direction away from shelf support 150. Lock rod 1340 comprises a plurality of teeth 1341 that are disposed and configured to matingly engage a lock tab 1610 (see, FIG. 16) disposed on the bottom of snap-roller seat 1310, as will be discussed in conjunction with Figures that follow and, in particular, FIG. 16. The plurality of teeth 1341 are, preferably, uniformly spaced along a surface of lock rod 1340 that is disposed away from shelf support 150. The slot or "gap" between two adjacent teeth of the plurality of teeth 1341 are disposed and configured to matingly engage lock tab 1610 in a manner that allows for discrete lateral movement and location of snap-in roller seat 1310 so as to accommodate different sized and placed merchandise packages 160, 161 and 162 on snap-in roller seat 1310. In the embodiment shown in FIGS. 13C and 13D, locking flanges 1312 have a slightly concave inner surface 1313 that is configured to matingly engage and surround a slightly convex outer surface 1332 of lock rod holders 1331. Also in the embodiment shown in FIGS. 13C and 13D, the lock rod holders 1331 have a slightly concave inner surface 1333 that is configured to accept a slightly convex surface 1342 of lock rod 1340. The particular configurations of locking flanges 1312, lock rod holders 1331 and lock rod 1340 shown in FIGS. 13C and 13D are of no particular import and can be varied and adjusted to accommodate any particular design choice or manufacturing need. All that is required is that the mutual configurations of locking flanges 1312, lock rod holders 1331 and lock rod 1340 are such that they do not easily separate in a vertical direction, i.e. in a direction away from shelf support 150. At this point, it should be noted that extruded front foot 1330 is, or can be, connected to shelf support 150 using push pin caps 1130 in the same manner as front foot 1120, as discussed above conjunction with FIGS. 11 and 12.

Figure 14A:
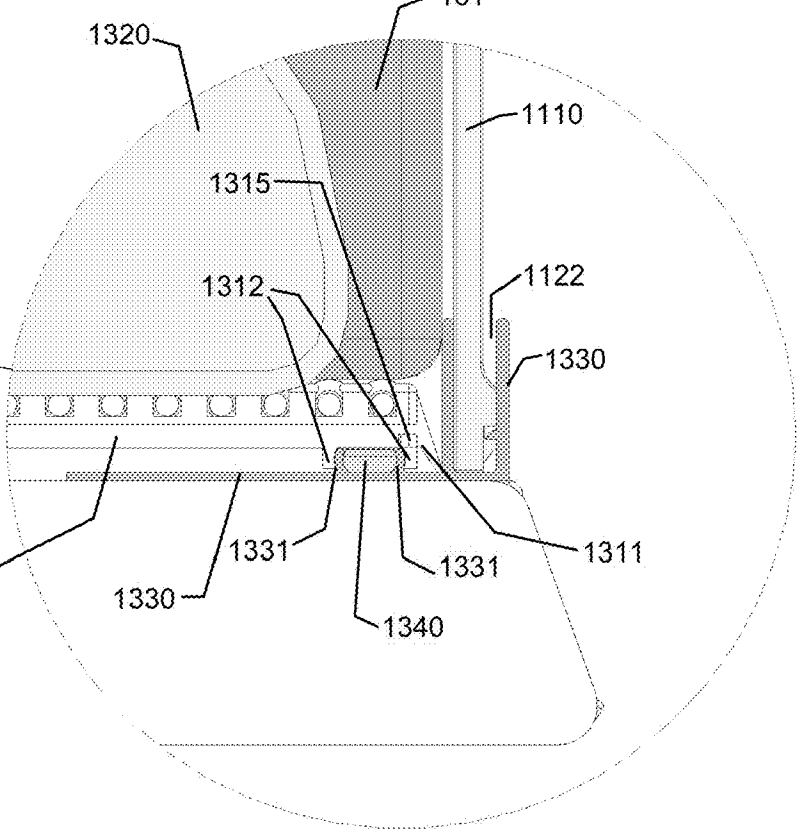
FIG. 14A is a detail view of section "A" of FIG. 14.

Rear lock strip 1350, as will be appreciated due to the fact that snap-in roller seat 1310 is symmetrical, also comprises lock rod holders 1331 that are disposed and configured similarly to those elements on extruded front foot 1330. Also, similar to rear cleat 840, rear lock strip 1350 is, or can be, connected to shelf support 150 using push pin caps 1130 in the same manner as rear cleat 840. In more detail, referring to FIGS. 14-14B, a side view of snap-in roller seat 1310 and adjustable divider 1320 is shown. As will be appreciated, adjustable divider 1320 is, similar to snap-in roller seat 1310, symmetrical. The import of the symmetrical shape of adjustable divider will be discussed in conjunction with Figures that follow. FIG. 14A shows a detail view of section "A" of FIG. 14. In FIG. 14A, the elements indicated have already been described as shown in FIG. 14B, due to the symmetrical nature of snap-in roller seat 1310, lock rod holders 1331 and lock rod 1340 associated with rear lock strip 1350 are the same as disposed on or in relation with extruded front foot 1330. The difference between FIGS. 14A and 14B resides in the fact that, with respect to rear lock strip 1350, locator 1311 does not contact any structural element. Lock rod holders 1331, as will be appreciated, run the entire width of extruded front foot 1330 and rear lock strip 1350.

Figure 15:
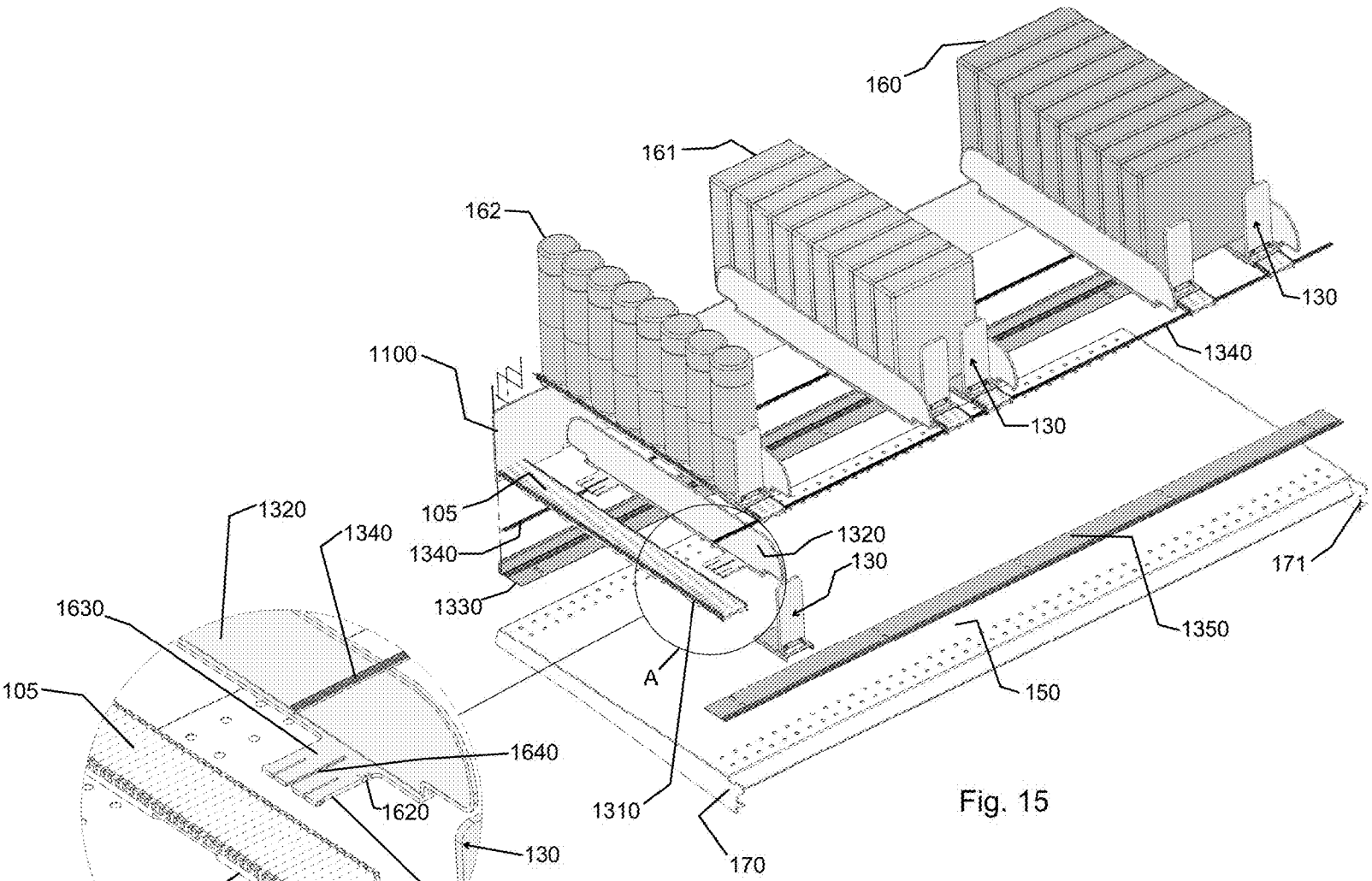
FIG. 15 is an exploded view of the discrete gravity feed roller seat and adjustable divider of FIG. 13.
Figure 15A:
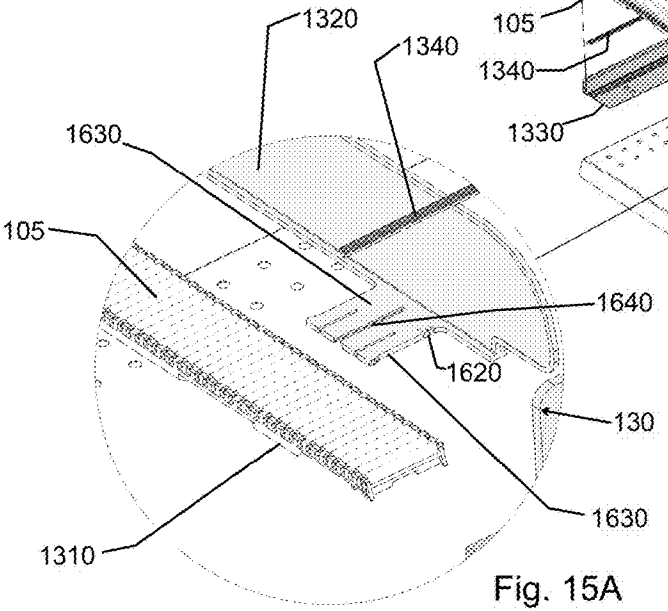
FIG. 15A is a detail view of section "A" of FIG. 15.

FIG. 15 shows an exploded view of the discrete gravity feed roller seat and adjustable divider of FIG. 13, and FIG. 15A shows a detailed view of section "A" of FIG. 15. As can be seen in FIG. 15, the assembly of snap in roller seat 1310, adjustable divider 1320 and lock rod 1340 into and with extruded front foot 1330 is straightforward. First, front panel 1110 is inserted vertically downward into U-channel 1122 until protrusion 1111 meets stop 1125, if present, as discussed above. Otherwise, front panel 1110 is merely inserted into U-channel 1122 until the bottom of front panel 1110 abuts the bottom of U-channel 1122. Second, lock rod 1340 is slidably inserted into lock rod holders 1331, and through-holes on lock rod 1340 (not shown, but similar to through-holes 1141 on acceptor strip 1140, discussed in conjunction with FIG. 11) are aligned with through-holes on extruded front foot 1330 and/or on lock rod holders 1331 (not shown, but similar to through-holes 1142 of C-channel 1121, also discussed in conjunction with FIG. 11). Diameters of pins and holes are preferably designed to tighten with each other. Third, push pins 1150 are inserted into through-holes which serve to affix and maintain lock rod 1340 in position so that teeth 1341 are firmly seated so as to mate with lock tab 1610. Finally, the front section of snap-in roller seat 1310 sits firmly on the shelf by first placing "front" lock tab 1610 (the word "front" is used herein to denote the lock tab 1610 nearest the "front" of the shelf, it being understood that snap-in roller seat 1310 is symmetrical and reversible) into the gap between two selected teeth 1341 on the "front" lock rod 1340 and then by securing locking flanges 1312 onto lock rod holders 1331 by pressing downwardly. The two locking steps are to ensure that the "front" section of snap-in roller seat 1310 is held securely. Similarly, the "rear" section of snap-in roller seat 1310 is seated firmly on the shelf by attaching to "rear" lock rod 1340 of rear lock strip 1350. The two-step locking mechanisms for both the "front" and "rear" of snap-in roller seat 1310 is necessary to secure snap-in roller seat 1310 firmly to the shelf because the height of snap-in roller seat 1310 from shelf surface 150 to the top of rollers 110 is generally required to be less than ½ inch. Also shown in FIGS. 15 and 15A are a scale 1620, fastening seats 1630, and guide slot 1640 of adjustable divider 1320 which will be discussed in more detail in conjunction with FIG. 16.

Figures 16, 16A:
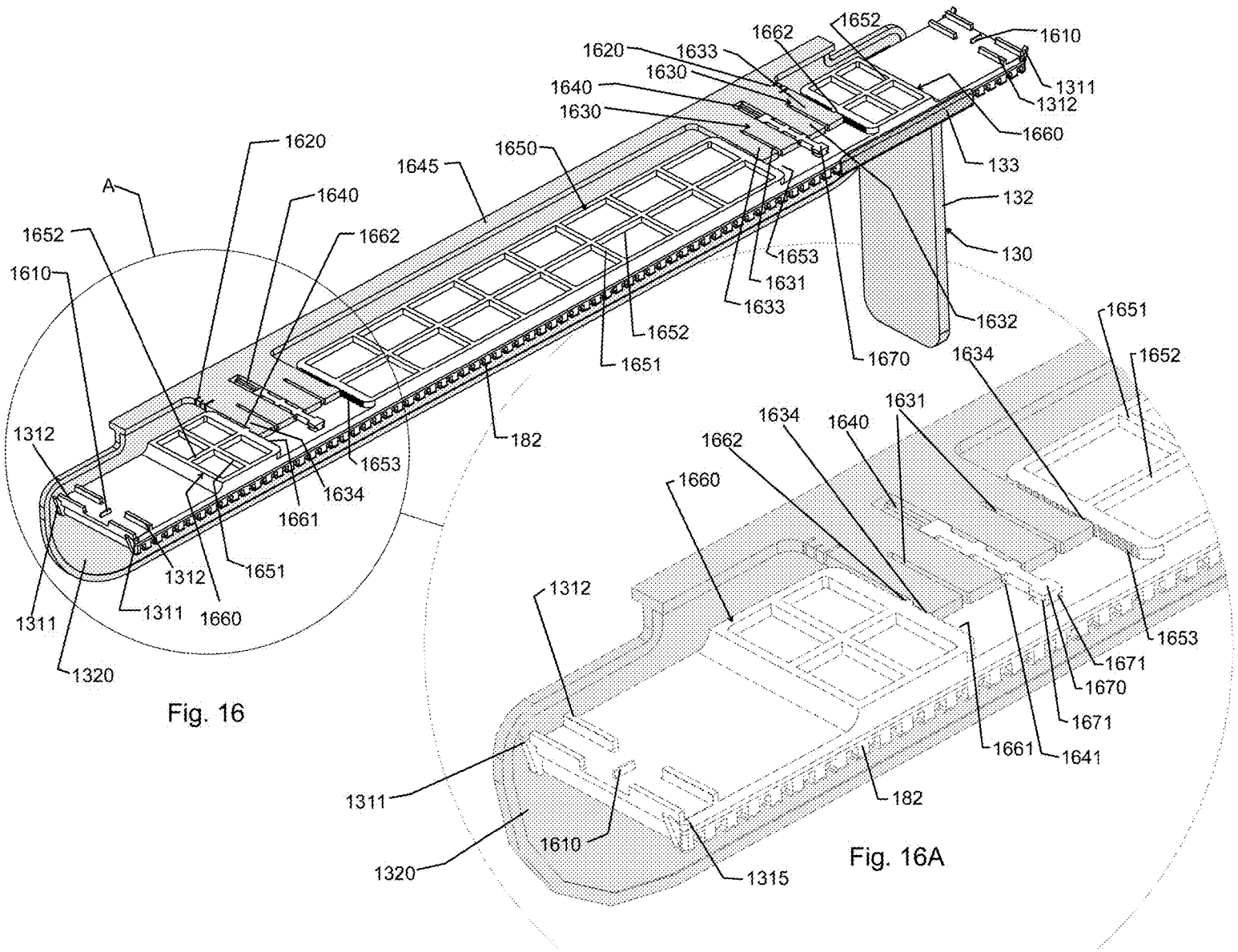
FIG. 16 a bottom view of the discrete gravity feed roller seat and adjustable divider of FIG. 13.
FIG. 16A is a detail view of section "A" of FIG. 16.

FIG. 16 shows details of the underside of snap-in roller seat 1310 having a plurality of structural features and the underside of adjustable divider 1320, likewise having a plurality of structural features. Turning first to the underside of adjustable divider 1320, each end of adjustable divider 1320 has a scale 1620, a pair of fastening seats 1630, with each pair of fastening seats 1630 including a flex space 1631 disposed therebetween, a guiding slot 1640, and a longitudinal base rib 1645 to which adjustable divider 1320 is affixed. Each pair of fastening seats 1630 is also affixed to longitudinal base rib 1645. Longitudinal base rib 1645 imparts longitudinal stability to adjustable divider 1320, as well as lateral stability to each pair of fastening seats 1630. Each pair of fastening seats 1630 comprises a first arm 1632 disposed proximal to guiding slot 1640 and a second arm 1633 disposed distal from guiding slot 1640. Each first arm 1632 also has a saw tooth protrusion 1634 disposed on second arm 1633 distal from flex space 1631, as well as distal from adjustable divider 1320/longitudinal base rib 1645. A detail of saw tooth protrusion 1634 is seen more clearly in FIG. 16A. Guiding slot 1640 has a pair of flanges 1641 disposed therein, with flanges 1641 being disposed adjacent the bottom surface of snap-in roller seat 1310 when adjustable divider 1320 is disposed in place attached to snap-in roller seat 1310. As noted, FIG. 16 also shows the underside of snap-in roller seat 1310 having a plurality of structural features. The bottom side of snap-in roller seat 1310 has a middle grid 1650, two end grids 1660, with each of middle grid 1650 and end grids 1660 comprised of a plurality of transverse ribs 1651 and longitudinal ribs 1652, and two snap bars 1670. Middle grid 1650 has two saw tooth ends 1653, one each disposed proximal to a saw tooth protrusion 1634. Each end grid 1660 has a saw tooth end 1661 disposed toward middle grid 1650 and proximal to a saw tooth protrusion 1634. Each saw tooth end 1661 has a detente protrusion 1662 disposed along saw tooth end 1661, preferably in the middle thereof. Each snap bar 1670 includes an undercut 1671 that is disposed and configured to mate with one of the pair of flanges 1641 of guiding slot 1640 when adjustable divider 1320 is disposed in place attached to snap-in roller seat 1310.

Adjustable divider 1320 is placed into position on snap-in roller seat 1310 as follows. First, snap bars 1670 are aligned with guiding slots 1640, while ensuring that flanges 1641 coincide with undercuts 1671. Second, fastening seats 1630 are inserted into the spaces between saw-toothed ends 1653 and 1661. Third, the position of adjustable divider 1320 is adjusted laterally by using scales 1620 (or by some other means). One inserted to the desired lateral depth, adjustable divider 1320 should now be properly aligned in relation to snap-in roller seat 1310 as desired to accommodate the merchandise packages 160, 161 and 162 and the merchandise POG. Flanges 1641 coinciding with undercuts 1671 ensures that adjustable divider 1320 does not tilt out of position once in place. Saw tooth ends 1653 and 1661, in combination with saw tooth protrusions 1634, provide frictional resistance, thereby providing lateral stability to the alignment of adjustable divider 1320 with snap-in roller seat 1310. Also, the détente protrusion 1662 provides further resistance and a "locking type" feature in that, as saw tooth protrusion 1634 passes over detente protrusion 1662, flexible space 1631 is slightly compressed. Once saw tooth protrusion 1634 passes over détente protrusion 1662, saw tooth protrusion 1634 "snaps back" against saw tooth ends 1653 and 1661. This configuration assists in keeping the adjustable divider in place while still allowing it to be removed if sufficient force is applied. All the foregoing structures in combination provide frictional resistance and allow fastening seats 1630 to snap into and be maintained in the proper position. Once adjustable divider 1320 is installed, the above structures work to stabilize the position. If necessary, fastening seats 1630 may be removed and/or adjusted if pulled out with sufficient force. However, casual force, such as by restocking shelves, removing/replacing merchandise 160, 161 and 162 by customers, or other types of day-to-day forces will not dislodge adjustable divider from its position attached to snap-in roller seat 1310. It will be appreciated from what is shown in FIGS. 15-16C that adjustable divider 1320 is symmetrical as is snap-in roller seat 1310 and can be inserted from either side of snap-in roller seat 1310.

Figures 17, 17A, 17B, 17C:
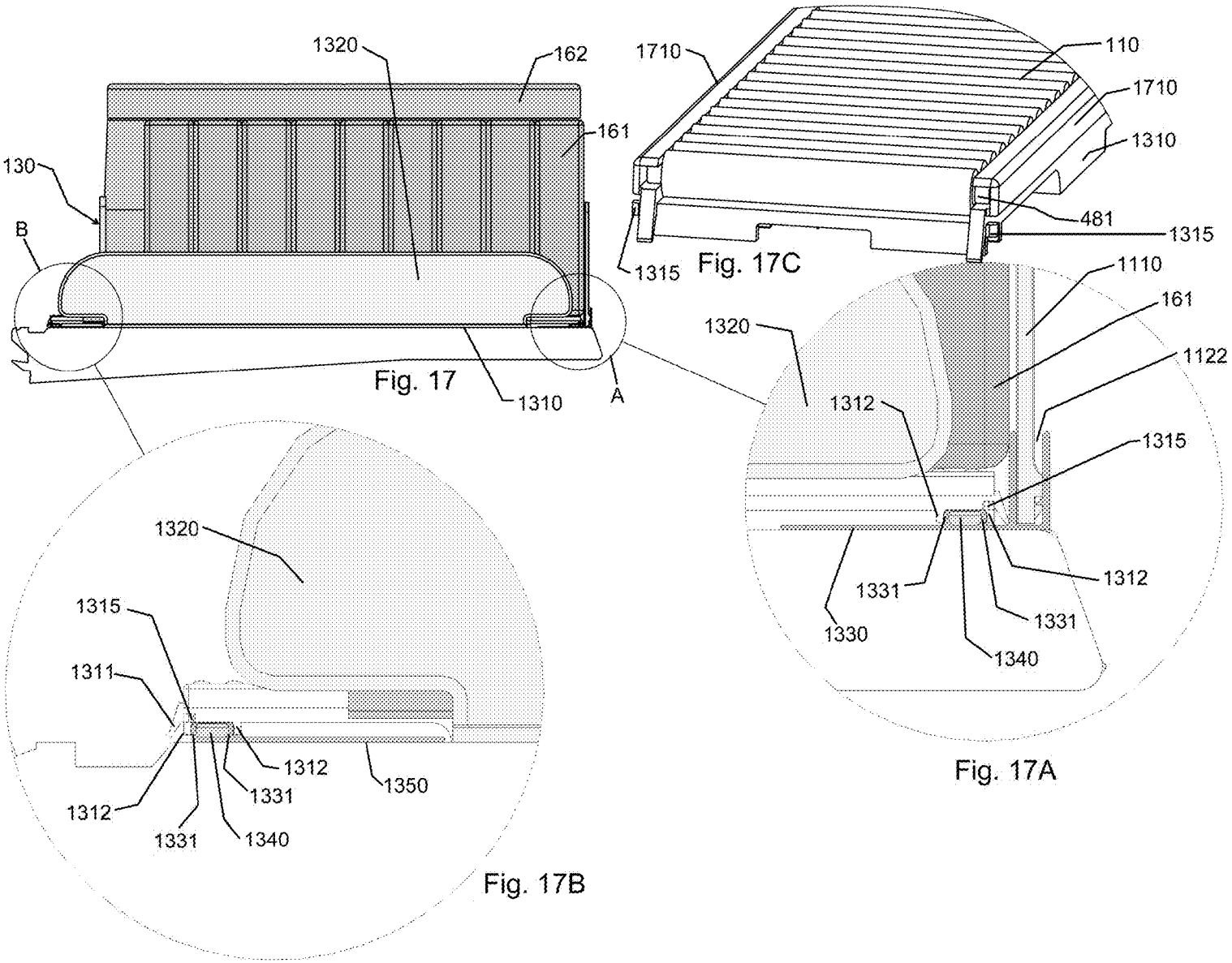
FIGS. 17, 17A and 17B are views of a discrete gravity feed roller seat and adjustable divider similar to that shown in FIGS. 14, 14A and 14B but having a U-channel roller seat as shown in FIG. 17C.

FIGS. 17-17C show snap-in roller seat 1310 and adjustable divider 1320 of the present disclosure used in conjunction with an alternative roller configuration/structure. FIGS. 17, 17A and 17B are similar to FIGS. 14, 14A and 14B. In the embodiment shown in FIGS. 17-17C, a different roller configuration is shown in FIG. 17C. In FIG. 17C, the base of snap-in roller seat 1310 is identical to that shown in the preceding Figures. However, in FIG. 17C, rather than using roller bars 182 to retain rollers 110 by holding connectors 481 of each roller in roller bar 182, in the embodiment shown in FIG. 17C, connectors 481 are disposed in C-channels 1710 disposed on each side of snap-in roller seat 1310. As noted, however, the base of snap in roller seat 1310 is identical to the embodiment described in, e.g., FIG. 16, and can accommodate adjustable divider 1320.

Figures 18, 18A, 18B:
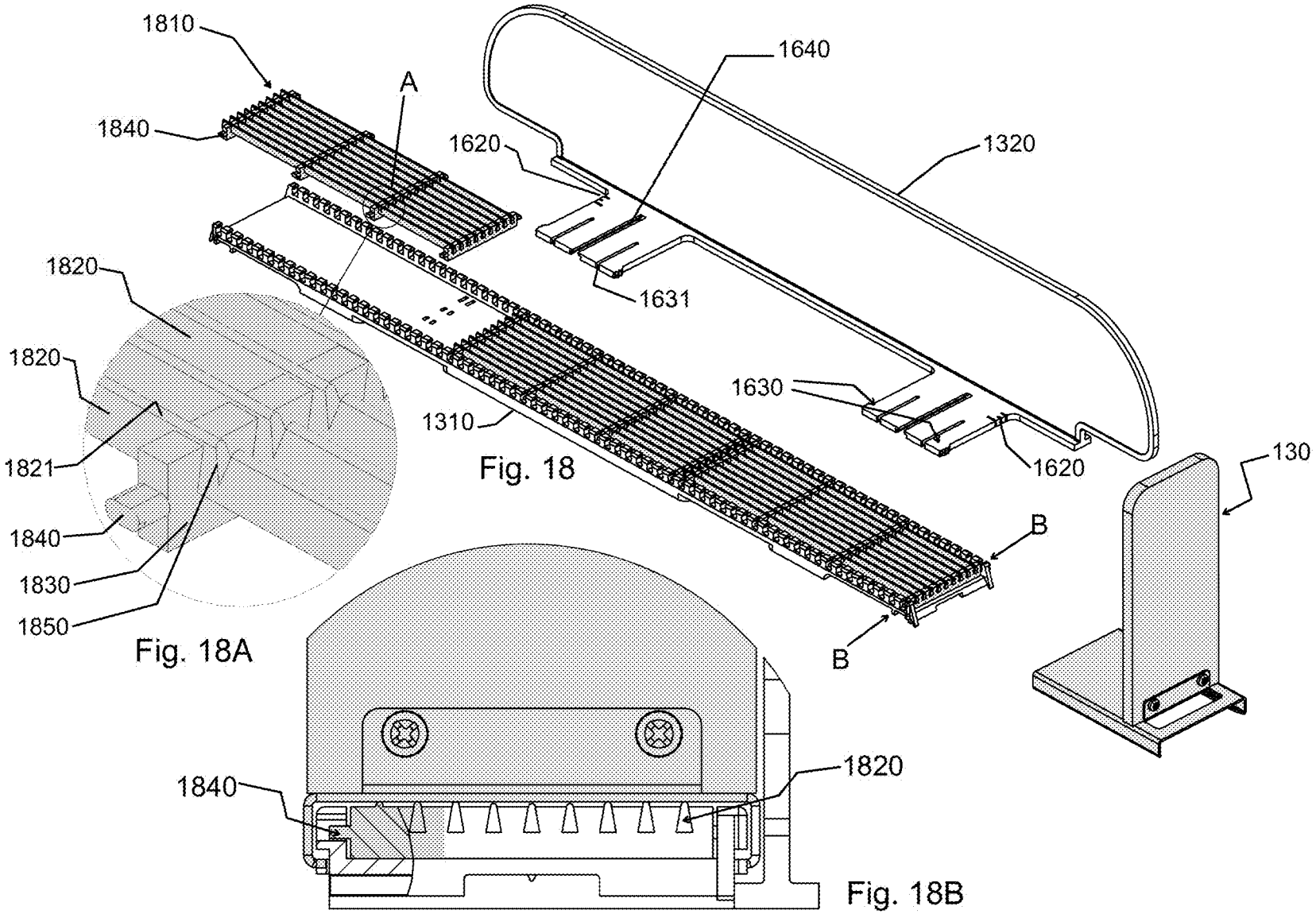
FIG. 18 is an exploded view of another by of discrete gravity feed roller seat and adjustable divider according to an alternate embodiment of the present disclosure that includes the present disclosure using a gliding seat.
FIG. 18A is a detail view of section "A" of FIG. 18.
FIG. 18B is a cross-sectional view through line "B" of FIG. 18 (with the discrete gravity feed roller seat and adjustable divider of FIG. 18 assembled).

FIGS. 18-18B show another configuration of snap-in roller seat 1310 and adjustable divider 1320 of the present disclosure used in junction with a second alternative merchandise-advancement mechanism. In FIG. 18, snap-in roller seat 1310 and adjustable divider 1320 are identical to those shown in, e.g., FIGS. 16-16A. However, in FIG. 18, gravity feed roller seats 105 comprised of a plurality of rollers 110 are replaced by gliding rib beds 1810. Gliding rib beds 1810 are comprised of a plurality of evenly spaced parallel ribs 1820 that are set in cross-members 1830 as shown in FIG. 18A. Each parallel rib 1820 has a generally triangular shape as shown in FIG. 18B, but of course can be other shapes. Each parallel rib 1820 is set into cross-member 1830 so that an apex 1821 or a top of each parallel rib 1820 is disposed above the upper surface of cross-member 1830, as shown in FIG. 18B. This configuration allows for G-driver 130 and for merchandise 160, 161 and 162 to glide along apexes 1821 (or other tops) with minimal friction. Gliding rib beds 1810 are inserted into roller support bars 182 using tabs 1840 that are configured to fit in roller support bars 182 in the same manner as connectors 481 on rollers 110. The length of gliding rib beds 1810 can be adjusted as needed by breaking gliding rib beds 1810 at notches 1850 as shown in FIG. 18A. Otherwise, since snap-in roller seats 1310 and adjustable divider 1320 are identical to those previously described with respect to, inter alia, FIGS. 15 and 16, the assembly of the embodiment of the present disclosure shown in FIGS. 18-18B is identical to that previously described with respect to FIG. 15. Of course, the design of the spacing of the ribs in gliding rib beds 1810 need not be evenly spaced parallel, and can be unevenly depending on applications.

Figures 19, 19A, 19B:
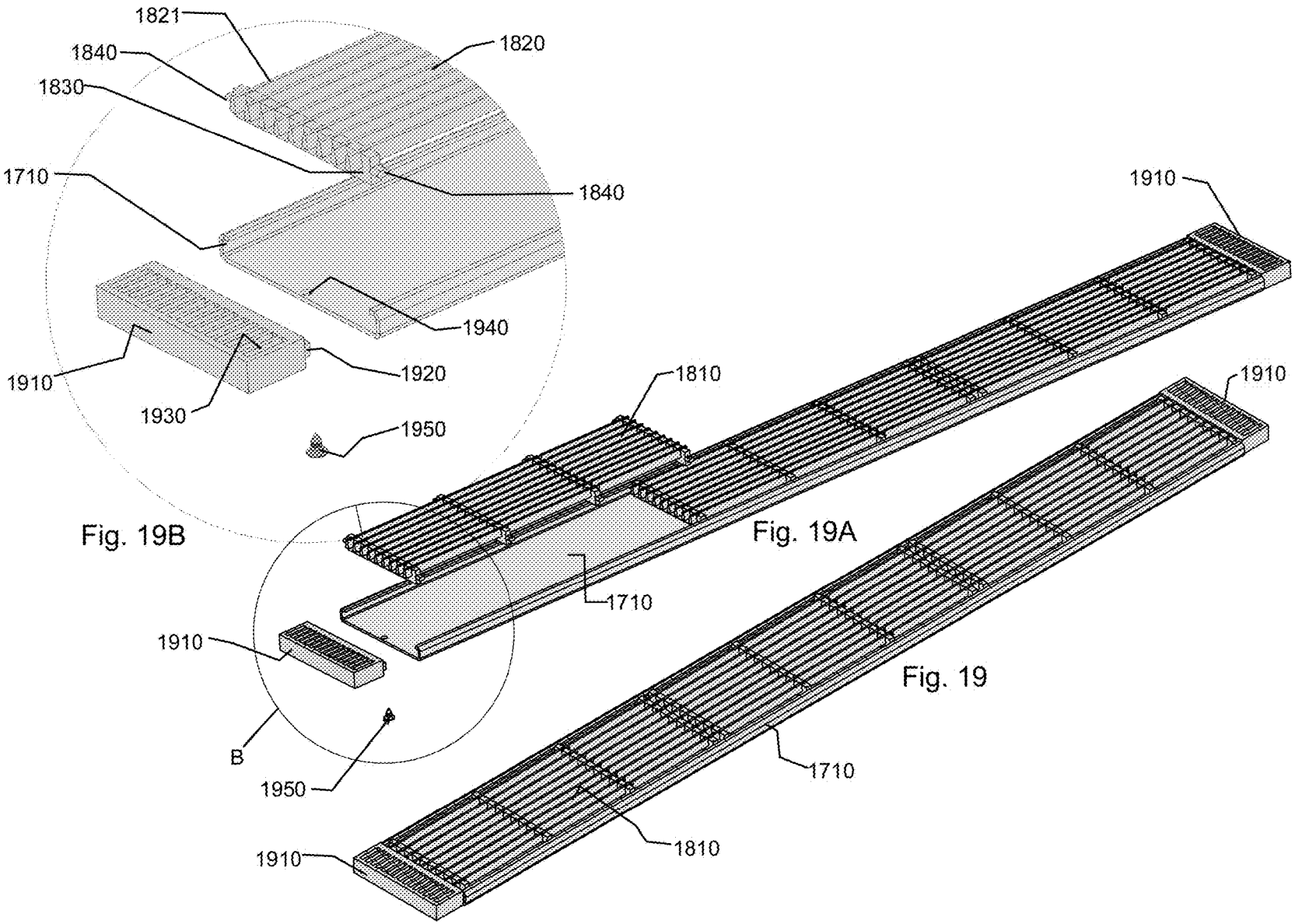
FIG. 19 is a top perspective view of a gliding seat inserted into a U-channel base and having front and rear divider inserts.
FIG. 19A is a partially exploded view of the gliding seat of FIG. 19.
FIG. 19B is a detail view of section "B" of FIG. 19A.

FIG. 19 shows an alternative embodiment of gliding rib beds 1810, as shown in FIG. 18 disposed in C-channels 1710, as shown in FIG. 17C. Omitted in FIG. 19 is the base of snap-in roller seat 1310. The alternative embodiment shown in FIG. 19 can be used to accept an alternative embodiment of a divider (not shown in FIG. 19). FIG. 19 also shows a front and rear divider inserts 1910. FIG. 19A shows a partially exploded view of FIG. 19. FIG. 19B is a detail view of section "B" of FIG. 19A. As seen in FIG. 19B, divider inserts 1910 include an adapter 1920 that is disposed and configured to fit into C-channels 1710. Also, divider inserts 1910 include a plurality of slots 1930 that are configured to accept elements disposed on a bottom portion of a divider (not shown in FIG. 19). By inserting elements disposed on the bottom portion of the divider into slots 1930 of front and rear divider inserts 1910, dividers other than the adjustable divider 1320 of the present disclosure may be used. The base of C-channels 1710 also includes a hole 1940 that is adapted to accept a set screw 1950 therethrough that holds front and rear divider inserts 1910 firmly in place.

Figures 20, 20A, 20B:
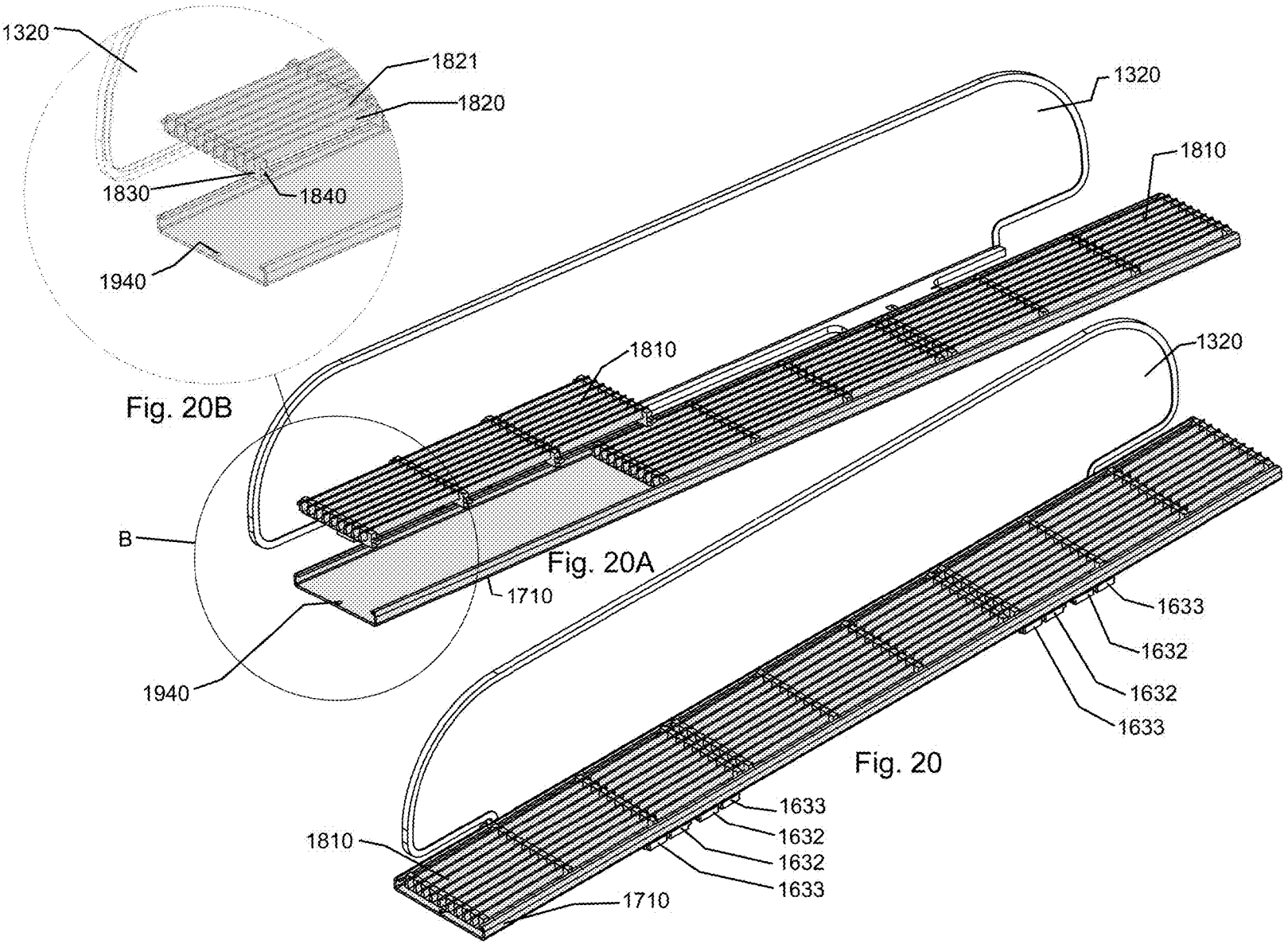
FIG. 20 shows gliding seats inserted into U-channel base with two divider foot receivers on the bottom similar to that shown in FIG. 16, and an adjustable divider inserted into the bottom of U-channel base.
FIG. 20A is a partially exploded view of FIG. 20.
FIG. 20B is a detail view of section "B" of FIG. 20A.

FIGS. 20, 20A and 20B are essentially identical to FIGS. 19, 19A and 19B, except that divider inserts 1910 are omitted and adjustable divider 1320 is used instead, as described with respect to the foregoing Figures. In the configuration shown in FIG. 20-20B, the front and rear locking systems can be the same or similar to those shown used in conjunction with the C-channel base, or can be adapted depending on whether the C-channel base is made of metal or plastic. For example, if the C-channel is made of a plastic, the integral base shown in FIG. 16 is suitable. On the other hand, if the C-channel base is made of a metal, a separate base as shown in, e.g., FIG. 16 can be fabricated and added to the metal C-channel.

Figures 21, 21A, 21B:
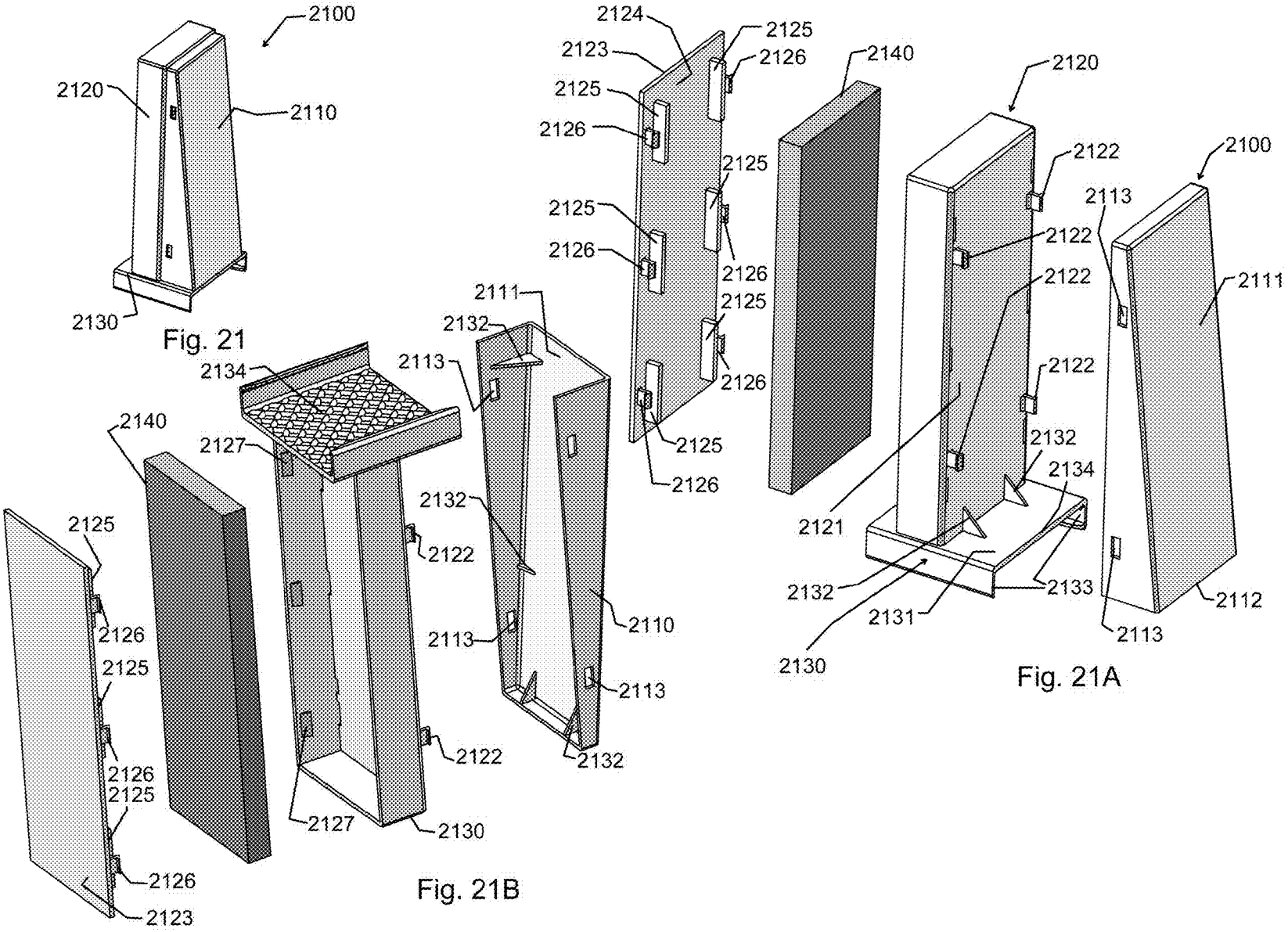
FIG. 21 shows an embodiment of a G-driver according to the present disclosure.
FIG. 21A shows a front right perspective exploded view of the G-driver of FIG. 21.
FIG. 21B shows a bottom view of the G-driver of FIG. 21A.

FIG. 21 shows an alternate G-driver 2100 according to the present disclosure. G-driver 2100 includes a cap 2110, a container box 2120, and a driver deck 2130. FIG. 21A shows an exploded view of G-driver 2100. In FIG. 21A, cap 2110 includes a front 2111, a front bottom edge 2112, and a plurality of locking slots 2113. G-driver 2100 also includes container box 2120 mounted on driver deck 2130. A front surface 2121 of container box 2120 includes a plurality of hooks 2122, each of which is disposed and configured to engage locking slots 2113. Disposed between front surface 2121 and a top surface 2131 of driver deck 2130 are a pair of mounting supports 2132 that provide reinforcing support and stability to the combination of cap 2110, container box 2120, and driver deck 2130. Driver deck 2130 also includes two C-channels 2133 that serve the same purpose as the C-channels discussed above in conjunction with other Figures. Container box 2120 is hollow so that it can accommodate a weight 2140 placed therein. Weight 2140 is shown as a single piece, but it will be appreciated that weight 2140 can be several pieces and can be flat, cylindrical or any shape that best suits the performance of G-driver 2100. Container box 2120 includes a back panel 2123 to enclose weight 2140 in the hollow of container box 2120. On the interior surface 2124 of back panel 2123 is a plurality of raised tabs 2125, each raised 2125 having associated it with a hook 2126. Hooks 2126 are disposed and configured to engage tabs 2127 in the hollow of container box 2120 (see, FIG. 21B) so as to lock back panel 2123 into position on container box 2120. Raised tabs 2125 serve to provide strength and flexural support to hooks 2126 so that hooks 2126 do not overly flex and possibly break when engaging tabs 2127. FIG. 21B is a bottom view of G-driver 2100 shown in FIG. 21A. Cap 2100 also includes a plurality of mounting supports 2132 that also provide reinforcing support and stability to the combination of cap 2110, container box 2120, and driver deck 2130. As shown in FIG. 21B, driver deck 2130 includes a gridded bottom 2134. Gridded bottom 2134 reduces the friction between driver deck 2130 and a top surface 105 of a roller seat 810 or 1310, or a gliding rib bed 1810 as surface of a gliding seat 1310 of the present disclosure (see, e.g., FIGS. 8,13 and 18). Referring back to FIG. 21, it can be seen that front bottom edge 2112 and a front edge 2134 of driver deck 2130 coincide and, coupled with the slightly inclined front 2111, are designed to reduce any possible backward tumbling of merchandise disposed on the shelf. Preferably, the angle between the vertical container box 2120 and the inclined surface 2111 of cap 2100 is between about 3-10 degrees, which have been found to best match.

One challenge for wire shelving systems is the divider installation and labor consumption caused by such depths as 36", 48", 60" or even 72". Another challenge is to find a general solution for the variety of wire shelving systems, including structures, layouts and dimensions. The following description of this additional embodiment of the present disclosure satisfies those challenges.

Figure 22:
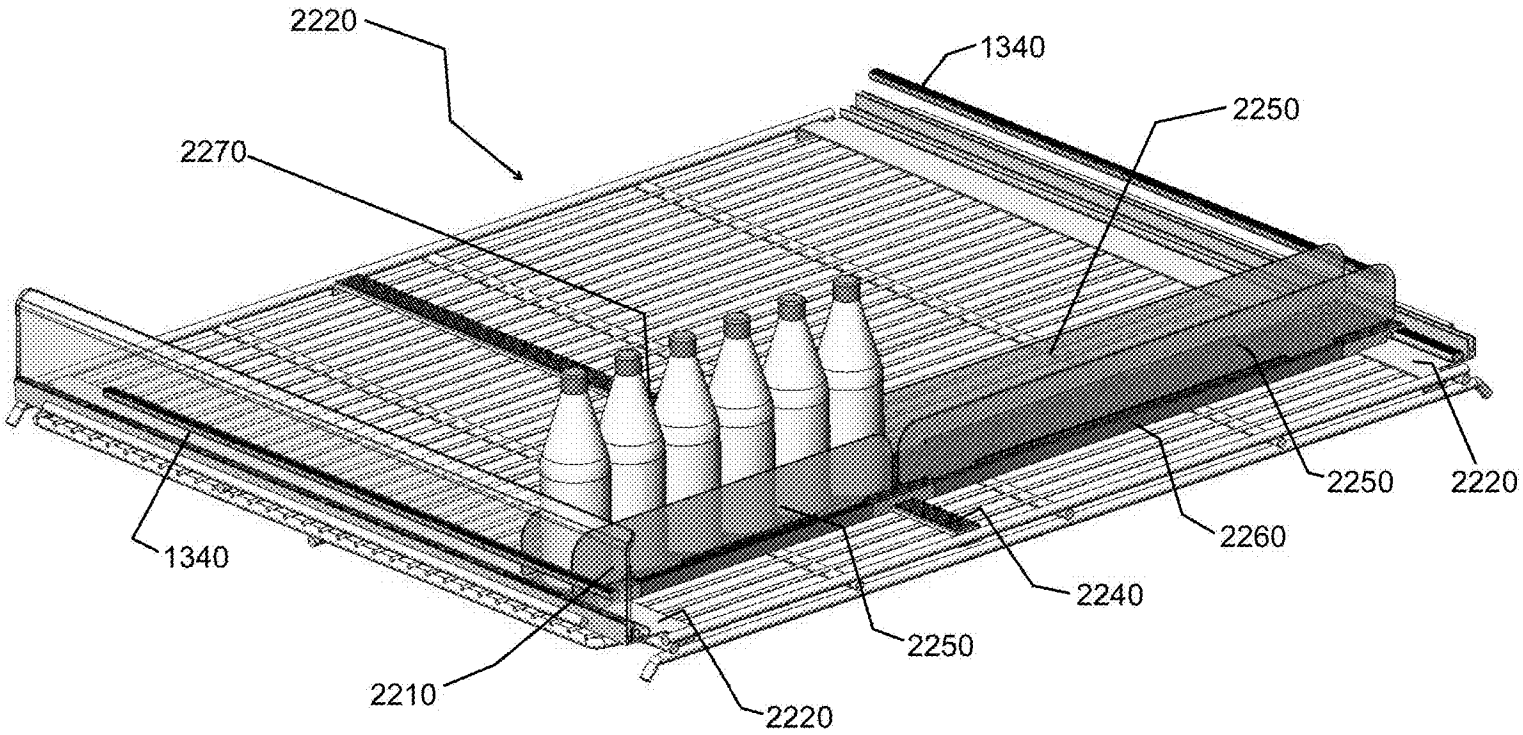
FIG. 22 shows a left front perspective view of a gliding seat system for a wire shelf according to the present disclosure.
Figure 23:
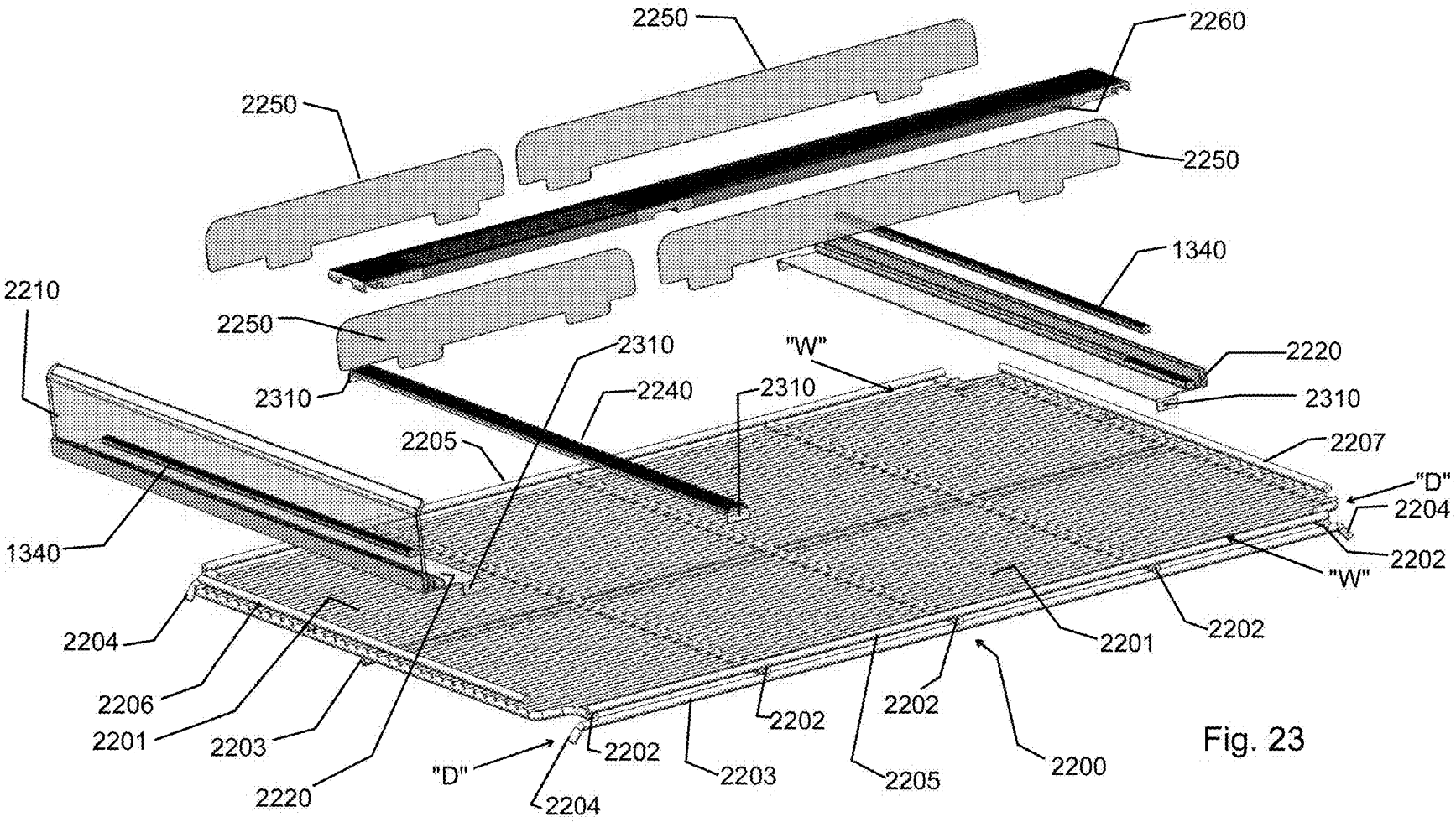
FIG. 23 shows an exploded view of the gliding seat for a wire shelf of FIG. 22.

FIG. 22 shows an overview of a complete gliding seat system for a wire shelf according to the present disclosure without a G-driver and FIG. 23 shows an exploded view of FIG. 22. FIG. 22 shows a wire shelf 2200 and a gliding seat assembly including a front rail 2210, a front foot and a rear foot 2220, a front locking rod 1340 and a rear locking rod 1340 (see, FIG. 13 and related description thereof), a middle bar locking seat 2240, a plurality of dividers 2250, a gliding seat 2260 and merchandise 2270. Each of the elements of the gliding seat assembly shown in FIG. 22 will be discussed in more detail in Figures that follow. FIG. 23 shows an exploded view of FIG. 22. As noted, front rail 2210, front foot and rear foot 2220 and front locking rod 1340 and rear locking rod 1340 will be described more fully in conjunction with FIGS. 24 and 25. Middle bar locking seat 2240 will be described more fully in conjunction with FIG. 28. Plurality of dividers 2250 and gliding seat 2260 will be discussed more fully conjunction with FIGS. 26 and 27. The gliding seat system shown in FIGS. 22 and 23 generally is adapted to be disposed on a shelf with a declined pitch (from rear to front) such as 5° to 6°. Also, although the gliding seat system shown in FIGS. 22 and 23 can be employed in any merchandise shelving/display assembly having wire shelves 2200, wire shelves 2200 are commonly used in refrigerated cabinets, such as those found in, it e.g., gas service stations or other convenience stores.

As shown more clearly in FIG. 23, wire shelf 2200 generally has three levels of wire comprising its structure: upper longitudinal wires 2201 along a depth "D" of the top of wire shelf 2200, lateral wires 2202 across a width "W" of wire shelf 2200 that are disposed below upper longitudinal wires 2201, and lower longitudinal wires 2203 also disposed along a depth "D" of wire shelf 2200 but below lateral wires 2202. Weight of merchandise loaded on upper longitudinal wires 2201 is borne by those wires, then is transferred to lateral wires 2202, and finally transfers to lower longitudinal wires 2203. There are four lower longitudinal wire hooks 2204 that are a continuation of lower longitudinal wires 2203 which, in turn, transfers the weight load on wire shelf 2200 to the uprights of the rack system (not shown) that holds the wire shelves. The diameter of the upper longitudinal wires 2201 is smaller than that of lateral wires 2202, while the diameter of lower longitudinal wires 2203 is not less than that of lateral wires 2202. Also, as shown more clearly in FIG. 23, wire shelf 2200 also typically comprises four stop wires, i.e., two side stop wires 2205, a front stop wire 2206 and a rear stop wire 2207. Side stop wires 2205 are disposed on exposed ends of lateral wires 2202. Side stop wires 2205 strengthen and improve the stiffness of wire shelf 2200 as well as prevent merchandise 2270 from falling from wire shelf 2200. Front stop wire 2206 and rear stop wire 2207 prevent merchandise on wire shelf 2200 from falling or crossing the stops. The price strip is usually placed on front stop wire 2206.

Referring back to FIG. 22, front foot and rear foot 2220 are disposed on wire shelf 2200 by abutting against front stop wire 2206 and rear stop wire 2207, respectively. As shown in FIG. 23, both front foot and rear foot 2200 include clips 2310 that clip onto each of two side stop wires 2205. Similarly, middle locking bar seat 2240 includes clips 2310 that clip onto each of two side stop wires 2205. As a result, in the embodiment shown in FIG. 23, there are three pairs of clips 2310 that secure front foot and rear foot 2220, and middle locking bar seat 2240, to wire shelf 2200. While front foot and rear foot 2220 are shown as being identical in FIGS. 22 and 23, it will be appreciated that rear foot 2220 does not need to be identical to front foot 2220 but, rather, rear foot 2220 need only include a locking panel 2510 as will be discussed in conjunction with FIG. 25 with respect to front foot 2220. Front foot and rear foot 2220 are only identical in those instances where it is desired to include a "rail", similar to front rail 2210, in rear foot 2220. FIG. 22 also shows gliding seat 2260 secured to wire shelf 2200. Merchandise 2270 disposed on gliding seat 2260 between dividers 2250 moves forward under gravity. Also, as shown in FIG. 22, gliding seat 2260 is secured to front foot and rear foot 2220. Furthermore, gliding seat 2260 is secured to middle bar locking seat 2240 that additionally secures gliding seat 2260 and dividers 2250 between front foot and rear foot 2200 and prevents dividers 2250 from being displaced by heavy merchandise 2270 moving on a deep shelf. The position for placement of middle bar locking seat 2240 is determined according to the size of wire shelf 2200. When gliding seat 2260 is secured to front foot 2220, the rear of gliding seat 2260 will be automatically disposed in alignment with rear foot 22200, to the depth of wire shelf 2200 such as 36" or 48", or more. This solves many problems commonly associated with ensuring accurate installation, and requires less time and labor.

Figure 24:
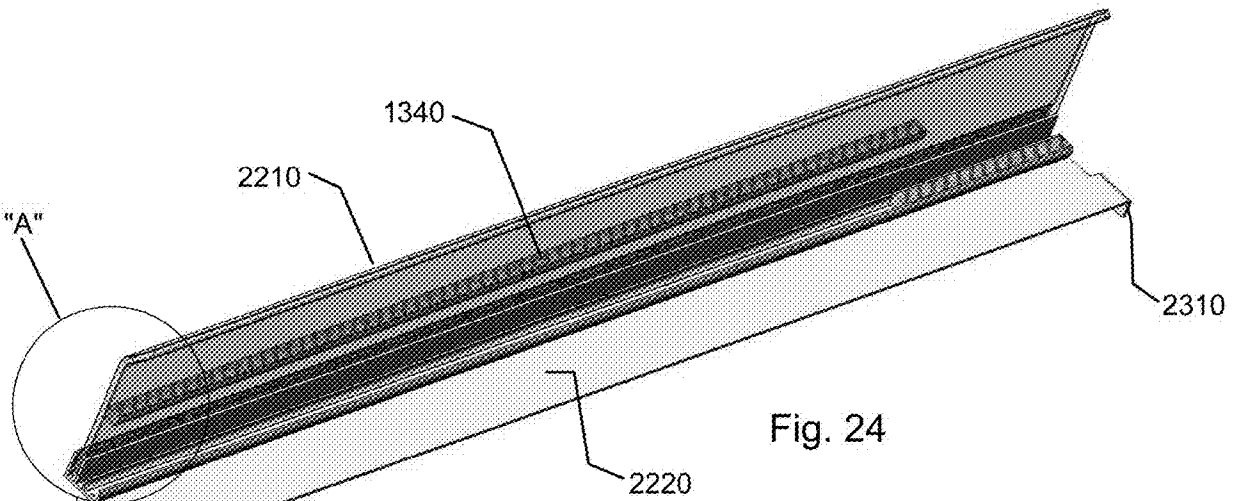
FIG. 24 shows a front stop and front locking system for a wire shelf according to the present disclosure.
Figure 24A:
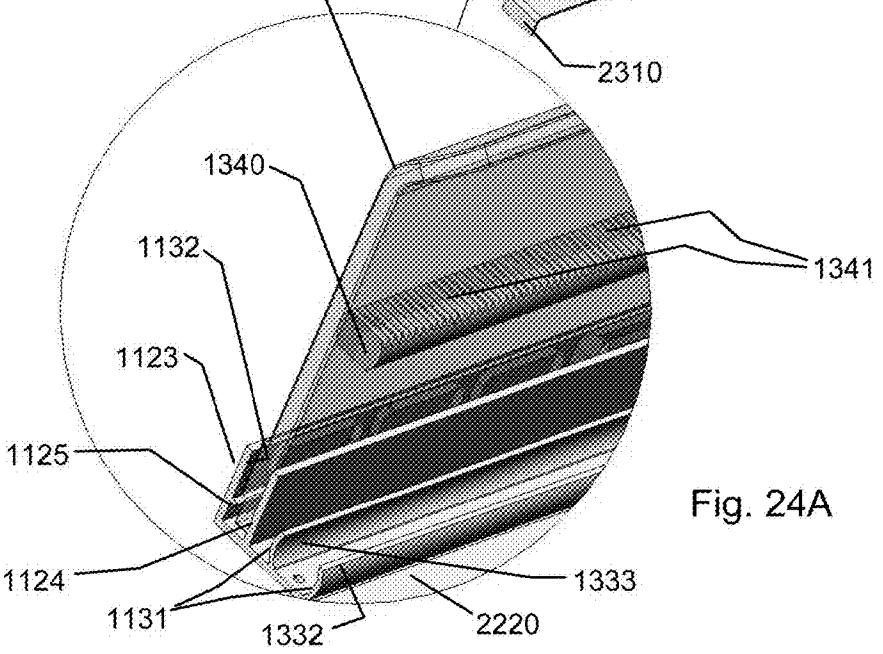
FIG. 24A shows a detail view of section "A" of FIG. 24.

FIG. 24 shows front foot 2220, front rail 2210, clips 2310 and locking rod 1340. Front foot 2220 is similar in structure and function to front foot 1330, described in detail above in conjunction with FIG. 13. That detailed description will not be repeated here. The main difference between front foot 1330 and front foot 2220 is that front foot 1330 is attached to shelf 150 using push-pin caps 1130, while front foot 2220 is attached to wire shelf 2200 using clips 2310 that engage one each of two side stop wires 2205, as shown in FIG. 22. FIG. 24A shows an enlarged view of section "A" of FIG. 24. FIG. 24A shows that front foot 2220 includes U-channel 1122 that comprises two walls, a forward wall 1123 and a rear wall 1124, as described in conjunction with FIG. 11. In addition, front foot 2220 includes a pair of lock rod holders 1331 having a pair of convex outer surfaces 1332 and concave inner services 1333 designed and configured to accommodate locking rod 1340 that has a plurality of teeth 1341, as described in conjunction with FIG. 13. Front rail 2210 differs from front panel 410 in a number of respects that will be discussed more fully in conjunction with FIG. 25.

Figures 25, 25A:
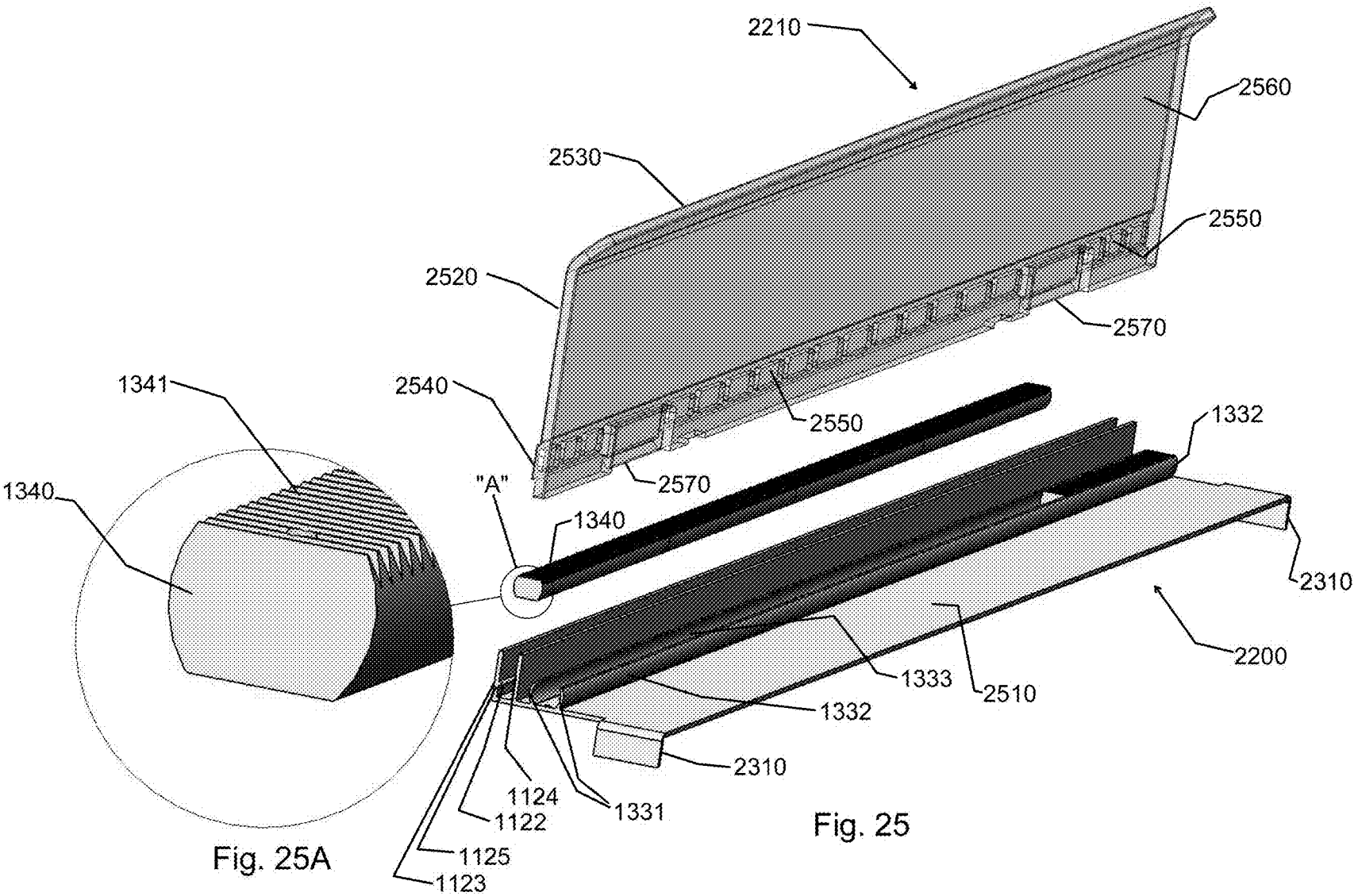
FIG. 25 shows an enlarged exploded view of the front stop and front locking system of FIG. 24.
FIG. 25A shows a detail view of section "A" of FIG. 25.

FIG. 25 shows an exploded view of FIG. 24, and FIG. 25A shows a detail of section "A" of FIG. 25. All of the elements shown in FIGS. 25 and 25A have previously been described in detail in conjunction with other Figures and that description will not be repeated here. Shown in FIG. 25 is a portion of front foot 2220 that is indicated as a locking panel 2510 that has been mentioned above in conjunction with FIG. 22. As noted above, although front foot 2220 and rear foot 2220 are shown as being identical in the embodiment shown in FIG. 22, in most instances, rear foot 2220 will comprise only locking panel 2510. Locking panel 2510 includes clips 2310 and a pair of lock rod holders 1331 having a pair of convex outer surfaces 1332 and concave inner services 1333 designed and configured to accommodate locking rod 1340 that has a plurality of teeth 1341. Thus, locking panel 2510 serves to lock itself onto wire shelf 2200 by engaging one each of two side stop wires 2205 with clips 2310, and serves to lock gliding seat 2260 at front and rear positions on wire shelf 2200 by engaging a pair of locking flanges 1312 that are integral with each of front head 2610 and rear head 2650 (see, FIG. 27). In most applications, these two locking functions are all that is required of rear foot 2220 which, then, can comprise locking panel 2510 alone. As also shown in FIG. 25, front rail 2210 includes a generally rectangular panel 2520 and, disposed along an upper edge of rectangular panel 2520 is an angled plate 2530. Angled plate 2530 is used to reduce the impact caused by tall and heavy merchandise package disposed on the front surface of front rail 2210 proximal the bottom is a protrusion 2540 that traverses the length, i.e. the long dimension, of front rail 2210. Protrusion 2540 is disposed and configured to abut protrusion 1125 disposed in U-channel 1122. Along the length of protrusion 2540 is a plurality of recessed areas 2550. Recessed areas 2550 are present merely for purposes of material savings, whether front rail 2210 is extruded plastic or metal. Also disposed along the bottom edge of front rail 2210 are two snap clips 2570 that secure front rail 2210 into U-channel by sliding below protrusion 1125 to lock snap clips 2570 into place when front rail 2210 is inserted onto U-channel.

Figure 26:
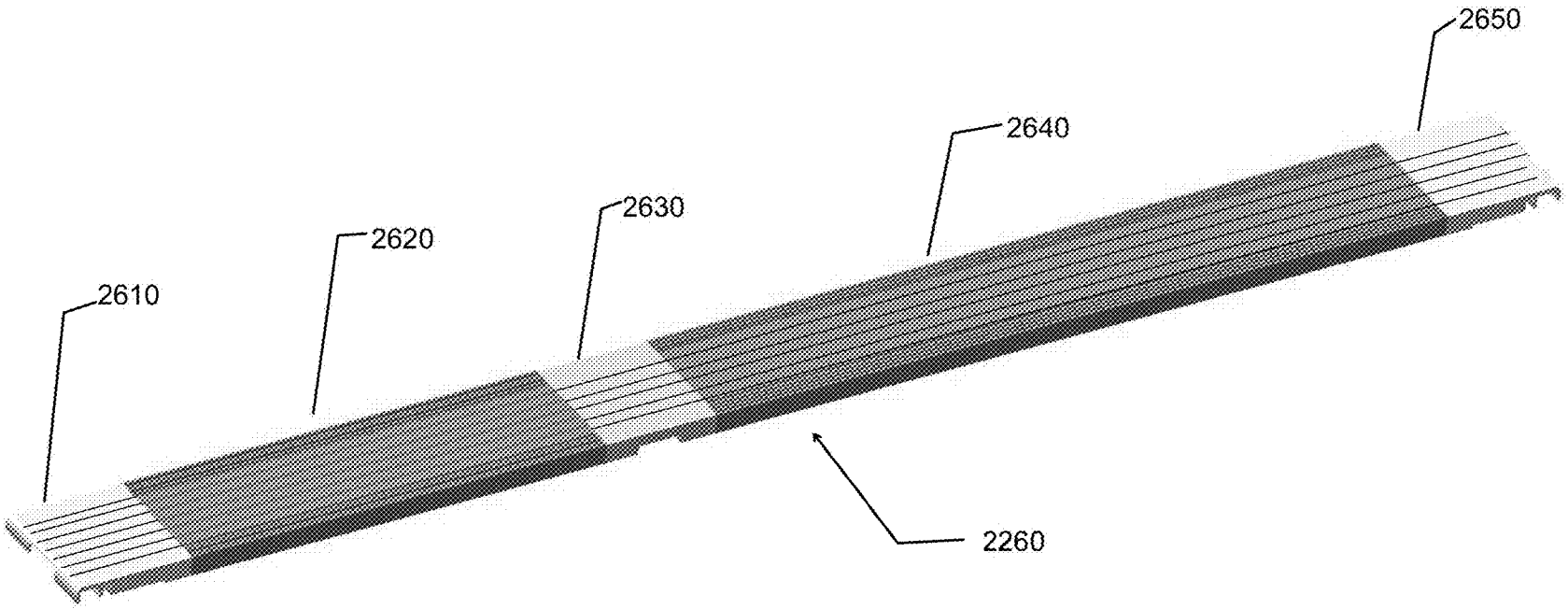
FIG. 26 shows a top perspective view gliding seat for use with wire shelving according to the present disclosure.

FIG. 26 shows various sections of gliding seat 2260. Gliding seat 2260 includes front head 2610, first section 2620, middle connector 2630, second section 2640 and rear head 2650, each of which will be discussed in more detail in conjunction with FIGS. 27-27D.

Figures 27, 27A, 27B, 27C, 27D:
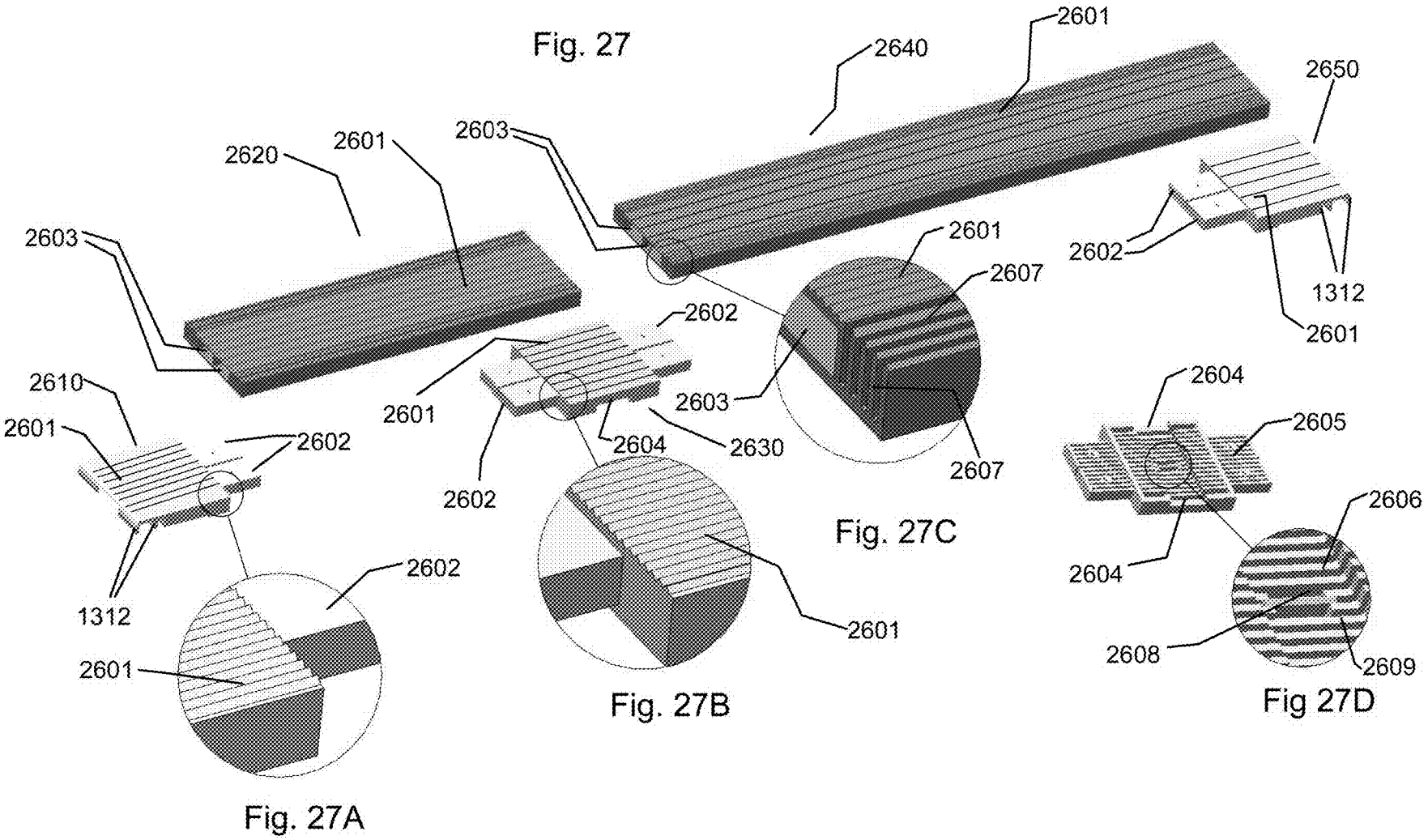
FIGS. 27-27D show exploded and detail views of the gliding seat of FIG. 26.

FIG. 27 shows an exploded view of gliding seat 2260. Initially, it should be noted that front head 2610 and rear head 2650 in the embodiment shown in FIG. 27 are identical in design and structure. Similarly, except for differences in length in the embodiment shown in FIG. 27, first section 2620 and second section 2640 are identical in design and structure, but possibly different in length. Each of front head 2610, first section 2620, middle connector 2630, second section 2640, and rear head 2650 includes a plurality of longitudinal gliding ribs 2601 that can be seen more clearly in, e.g. FIGS. 27A-27C. Gliding ribs 2601 are similar in structure and function to parallel ribs 1820 described in detail in conjunction with FIG. 18, none of the details of which will be repeated here. Integral with each of front head 2610 and rear head 2650 is a pair of locking flanges 1312, described more completely in conjunction with FIG. 13, that are disposed and configured to matingly engage lock rod holders 1331 on front foot and rear foot 2220, or front foot 2220 and locking panel 2510, as the case may be. Each of front head 2610 and rear head 2650 includes a pair of feet 2602 that are disposed and configured to insert into one each of longitudinal slots 2603 disposed in each end of first section 2620 and second section 2640. Each of first section 2620 and second section 2640 is formed from a two-channel rectangular tube (one longitudinal slot per channel) which provides sufficient rigidity and strength to each. FIG. 27C also shows a plurality of divider slots 2607. Plurality of divider slots 2607 is provided in the embodiment shown in FIG. 27 so that the lateral placement of dividers 2250 can be adjusted. Dividers 2250 can be configured and designed in accordance with the length of each gliding seat 2260 section, i.e., first section 2620 and second section 2640 as shown in FIG. 23. Dividers 2250 may also span the entire depth of gliding seat 2260. The width and depth of divider slots 2607 depend on the dimensions of dividers 2250. This flexibility of design allows for easier installation of dividers 2250 regardless of shelf depth, i.e., 36", 48", 60" or longer. Middle connector 2630 includes two sets of feet 2602 that are disposed and configured to insert into longitudinal slots 2603 of both first section 2620 and second section 2640 so as to connect them. Middle connector 2630 includes a slot 2604 is that is configured to accept and engage middle locking bar seat 2240. FIG. 27D shows the underside 2605 of middle connector 2630. Underside 2605 of middle connector 2630 includes a plurality of slots 2606 between "ribs" 2609 which reinforce the rigidity of middle connector 2630 and prevent deformation during tooling process. In this way, middle connector 2630 serves to (1) join lengths of first section 2620 and second section 2640 and (2) provide lateral stability to gliding seat 2260 along its length between front head 2610 and rear head 2650. In addition, there is a locking tab 2608 underside 2605 to mate with the teeth on the surface of the middle bar (see, FIG. 28A). As will be appreciated by those of skill in the art, more than one middle connector 2630 and more than one middle locking bar seat 2240 may be used, depending on shelf depth.

Figure 28:
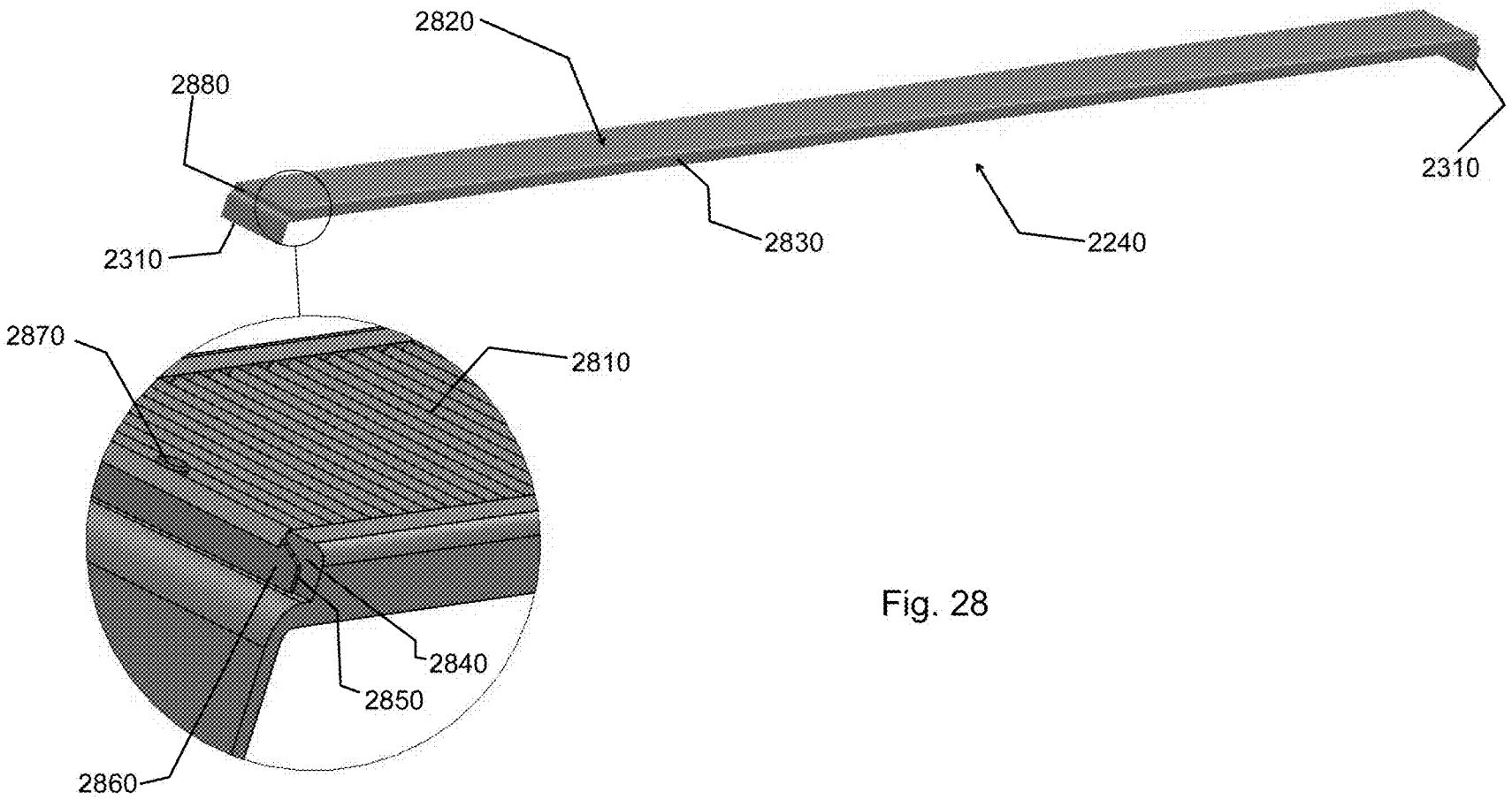
FIG. 28 shows a middle bar locking seat according to the present disclosure.

FIG. 28 shows middle locking bar seat 2240. Middle locking bar seat 2240 comprises a locking slat 2880 that includes a top surface 2820 having a plurality of locking ribs 2810, as shown more clearly in FIG. 28A. Locking ribs 2810 are similarly sized and disposed as are teeth 1341 on locking bar 1340. Middle locking bar seat 2240 also includes a pair of clips 2310 disposed on either end thereof that have already been described above in conjunction with other Figures. Middle locking bar seat 2240 also includes a C-channel base 2830. As shown more clearly in FIG. 28A, locking slat 2880 slides into C-channel base 2830 and is secured therein by a combination of a configuration and physical pinning. As shown in FIG. 28A, C-channel base 2830 comprises a pair of angled uprights 2840 each having an angled inner surface 2850. Locking slat 2880 includes a pair of matching edges 2860 that conform to angled inner surfaces 2850. The combination of matching edges 2860 and angled inner surfaces 2850 serve to secure locking slat 2880 vertically in C-channel base 2830. To secure locking slat 2880 securely in C-channel base 2830 in a lateral direction, pins 2870 are inserted into through-holes (not shown) at each end of locking slat 2880 and pass into receiving holes in C-channel base 2030 (not shown).

Gliding seats on wire shelves are described above in conjunction with FIGS. 22 to 28. Therein, a device to lock gliding seats to the front or rear extrusion is described in FIGS. 24, 25 and 28. FIGS. 29-35 describe an optional locking system for gliding seats that can be modified for use with to roller seats. FIG. 36 describes an alternative connection between two seats, FIG. 37 describes landing zones that can be used in conjunction with roller seats, and FIGS. 38-40 show shelf angle converters.

Figure 29:
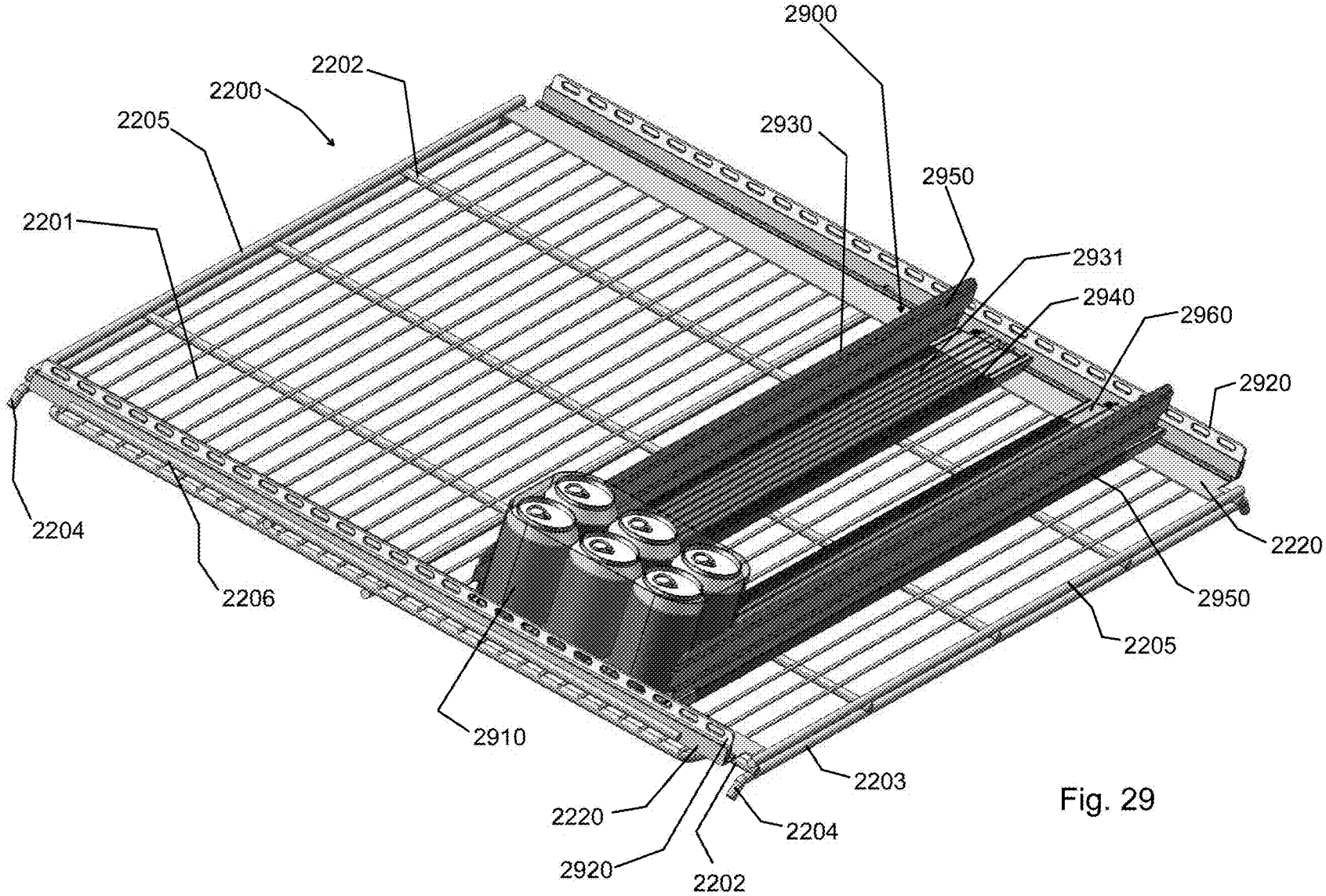
FIG. 29 shows a left front perspective view of a gliding seat system for a wire shelf that includes an alternative locking mechanism according to the present disclosure.

FIG. 29 shows an alternate embodiment of a merchandise-advancement system 2900 for use on wire shelf 2200. With respect to the individual elements of wire shelf 2200, these have been described in detail in conjunction with FIGS. 22 and 23, and that description will not be repeated here. Merchandise-advancement system 2900 also comprises front foot 2220 and rear foot 2220 that have likewise generally been described in detail in conjunction with FIGS. 22 and 23. However, front foot 2220 and rear foot 2220 of FIG. 29 include a different locking pin 3030 that is shown in, e.g., FIG. 30A. In FIG. 29, merchandise 2910 comprises a six-pack of cans, e.g., soda cans, as an example of merchandise with which merchandise-advancement system 2900 may be used. Merchandise-advancement system 2900 differs from those describes above in several respects. For example, a front rail and a rear rail 2920 are of a different configuration than those described above, but this configuration is merely a matter of choice. The lower profile of front rail and rear rail 2920 may make lifting and removal of merchandise 2910 easier. Other than size/design, front rail and rear rail 2920 serve the same purpose(s) as described above with respect to other front rails and rear rails. FIG. 29 also shows a gliding seat 2930 that is a one-piece construction and includes a plurality of gliding ribs 2931. Gliding seat 2930 has a plurality of divider slots 2940 that extend along the length of gliding seat 2930. Of course, divider slots 2940 need not extend the length of gliding seat 2930, but may only partially so extend or, alternatively, a plurality of divider slots 2940 may be used. In any case, divider slots 2940 and dividers 2950 are configured so that dividers 2950 insert into divider slots 2940. Dividers 2950 have a slightly different configuration than those dividers described above but, generally, serve an identical purpose. Also shown in FIG. 29 is a rear head 2960 disposed at an end of gliding seat 2930 that is located distal from where merchandise 2910 will be removed by a customer. Rear head 2960 includes an alternative locking mechanism (not shown) that will be described in conjunction with other Figures. A front head (not shown but see, FIG. 30A) identical to rear head 2960 is disposed in association with the front end of gliding seat 2930 proximal to where merchandise 2910 will be removed by a customer.

Figures 30, 30A:
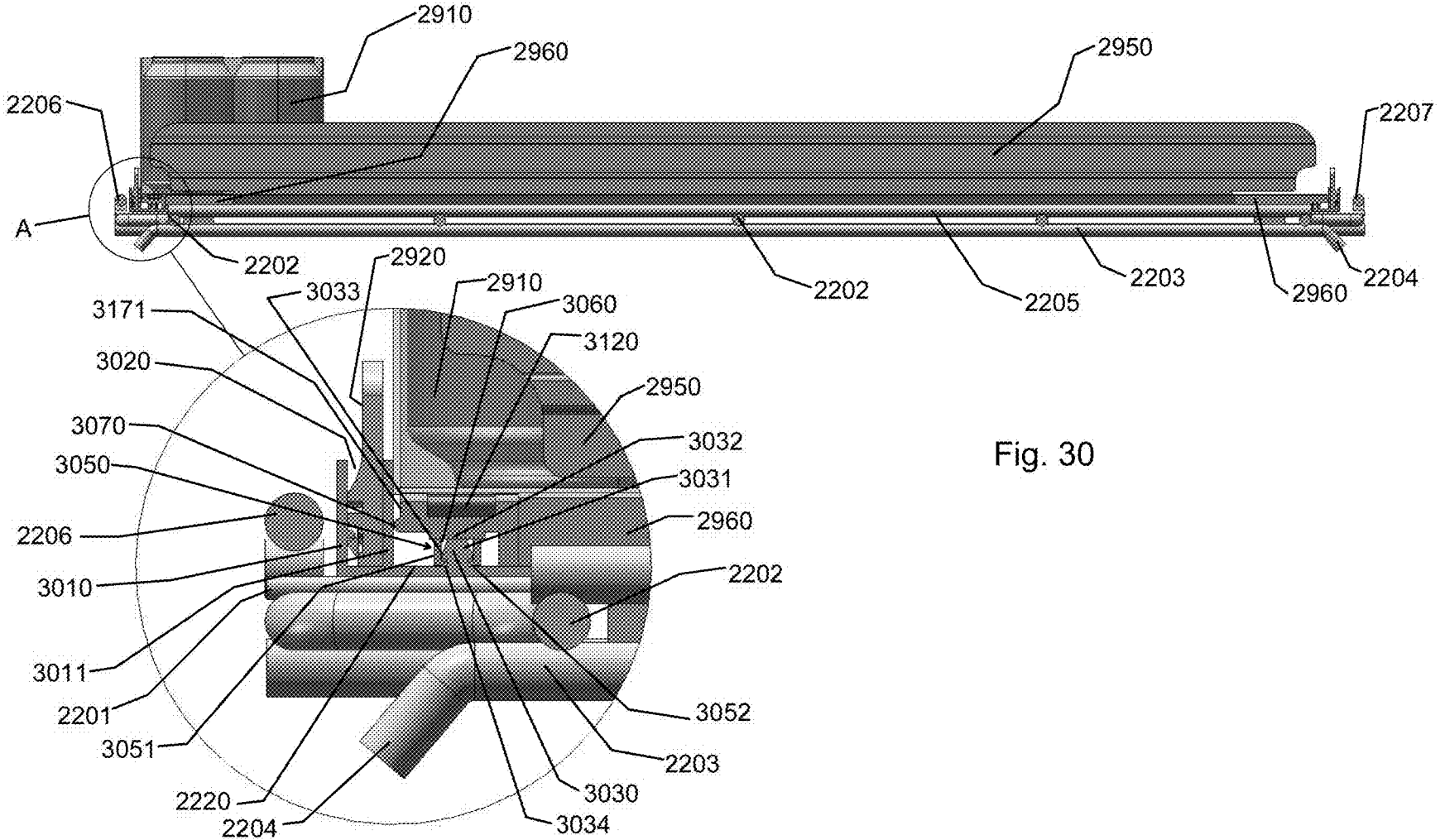
FIG. 30 shows a side view of the gliding seat system of FIG. 29.
FIG. 30A shows a detail view of the alternative locking mechanism shown in section "A" of FIG. 30 according to the present disclosure.

FIG. 30 shows a side view of merchandise-advancement system 2900 shown in FIG. 29. FIG. 30A shows a detail view of section "A" of FIG. 30. In FIG. 30A, front foot 2220 includes a front wall 3010 and a rear wall 3011 that provide a U-channel 3020, all of similar design to those features as described in conjunction with e.g., FIG. 11, above. Front foot 2220 (as well as rear foot 2220 (not shown in FIG. 30A)) includes a locking pin 3030 that traverses the length of front foot 2220 and rear foot 2220 (i.e., across width of wire shelf 2200). In the embodiment shown in FIGS. 29, 30 and 30A, front foot 2220 is extruded aluminum and, as a result, front wall 3010, rear wall 3011, U-channel 3020 and locking pin 3030 are integral with front foot 2220. Of course, front foot 2220 need not be extruded aluminum, and any of front wall 3010, rear wall 3011, and locking pin 3030 may be separately formed and attached to front foot 2220 by any means known to those of skill in the art, such as with adhesive or laser weld. Locking pin 3030 has a generally trapezoidal shape including two angled sides 3031 and a generally flat top surface 3032 that is disposed in a direction away from wire shelf 2200. Each angled side 3031 ends at a point 3033 to provide a channel 3034 on each side of locking pin 3030 along the length of locking pin 3030. As mentioned with respect to FIG. 29, at each end of gliding seat 2930 is either rear head 2960 or front head 2960. In FIG. 30A, front head 2960 is disposed at the front end (i.e., proximal to where a customer will remove merchandise 2910) of gliding seat 2930. The design and structure of front head 2960 and rear head 2960 will be discussed more fully in conjunction with FIGS. 31, 32 and 33. For purposes of explanation of the interaction between locking pin 3030 and front head 2960, front head 2960 has two arms 3050 which, in the embodiment shown in FIG. 30A have a general "L" shape. Each arm 3050 is disposed away from a bottom surface 3060 of front head 2960 in a direction toward wire shelf 2200, and each arm 3050 includes a "long" side 3051 and a "short" side 3052. Each long side 3051 is of a sufficient length so that each short side 3052 can matingly engage one channel 3034 of locking pin 3030. Also, each long side 3051 is designed and configured to "flex" so as to allow each short side 3052 to slide along each angled side 3031 of locking pin 3030 and "snap" into mating engagement with one channel 3034 of locking pin 3030 when downward pressure (i.e., toward wire shelf) is applied. Although each short side 3052 "snaps" into mating engagement with one channel 3034 of locking pin 3030 when downward pressure is applied, this mating engagement can be disengaged by lifting front head 2960 (and/or rear head 2960). Also, each long side 3051 is of a length so that a bottom surface 3060 (i.e., the surface to which each arm 3050 is attached) contacts generally flat top surface 3032 of locking pin 3030. This configuration allows front head 2960 and rear head 2960 to be "locked" into position anywhere along locking pin 3030 which allows fine adjustment of, e.g., gliding seat 2930 laterally with respect to width of sire shelf 2200. At the same time, although front head 2960 and rear head 2960 are said to be "locked" into position, when a locking panel 3120 (see, FIG. 31 and related discussion) is released, gliding seat 2930 can be slid laterally along locking pin 3030 to adjust placement of gliding seat 2930. Front head 2960 (and rear head 2960, not shown) each also includes protrusions 3070 (see, FIG. 31A) that abut rear wall 3011. Protrusions 3070 are provided on a front end 3171 of front head 2960 so that when a locking panel 3120 (see, FIG. 31) is released, gliding seat 2930 can be slid laterally along locking pin 3030 with less friction than if the entire front end 3171 abutted rear wall 3011. In the embodiment shown (see, FIG. 31A) two protrusions 3170 are used, but as will be appreciated, the number of protrusions 3170 used, if any, can vary.

Figures 31, 31A, 31B:
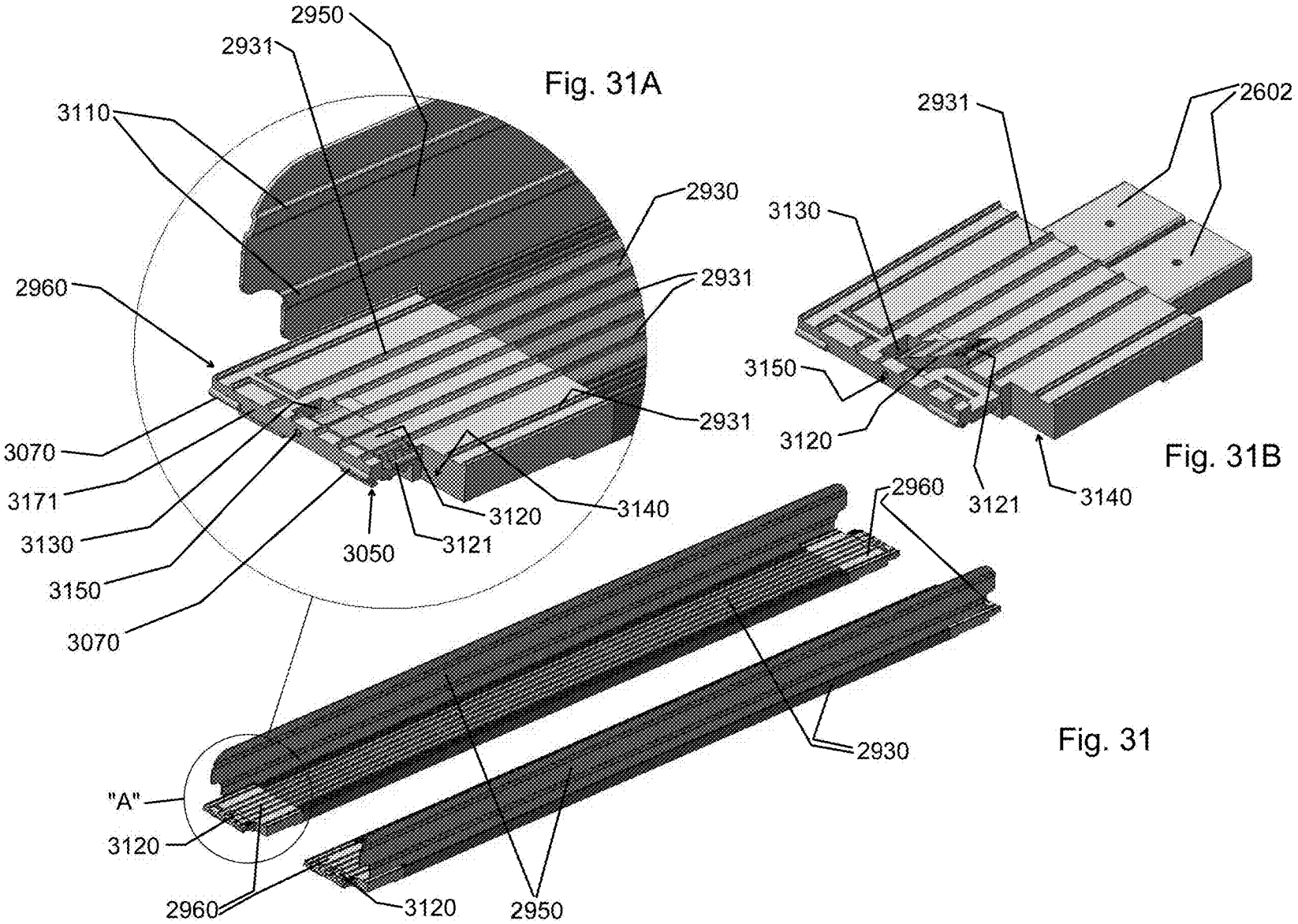
FIG. 31 shows the gliding seat system of FIG. 29 separate from the wire shelf.
FIG. 31A shows a detail view of section "A" of the alternative locking mechanism of FIG. 31.
FIG. 31B shows a partially exploded view of the alternative locking mechanism shown in FIG. 31A according to the present disclosure.

FIG. 31 shows merchandise-advancement system 2900 of FIG. 29 without wire shelf 2200 or merchandise 2910. FIG. 31A shows a detail view of section "A" of FIG. 31. In the embodiment shown in FIG. 31A, divider 2950 is a generally "flat" configuration and includes two ribs 3110 disposed along the length of divider 2950. Ribs 3110 protrude away from divider 2950 in a direction toward merchandise 2910 (not shown). Ribs 3110 serve to support merchandise 2910 vertically yet provide a small surface area of contact with merchandise 2910 so that friction between divider 2950 and merchandise 2910 is reduced. Ribs 3110 also provide stiffness that helps avoid bending caused by rolling merchandise, particularly heavier packages that are often displayed in beverage coolers. As will be appreciated, the configuration and placement of ribs 3110 is a matter of choice and can be eliminated completely if desired although the elimination of ribs 3110 is not preferred. Front head 2960 includes gliding ribs 2931 that are disposed and configured to align with gliding ribs 2931 of gliding seat 2930. Front head 2960 also includes a locking panel 3120, a well 3130 and opening 3140. Locking panel 3120 will be described more fully in conjunction with FIG. 34. As can be seen in FIG. 31B, locking panel 3120 is rotatably attached to front head 2960 as will also be more fully described in conjunction with FIGS. 32 and 34. Well 3130 is provided to allow locking panel 3120 to rotate (as shown in FIG. 31B), and opening 3140 is provided for ease of gripping of an end 3121 of locking panel 3120 by a user. A pin 3150 is inserted through-holes 3220 and 3240 (see, FIGS. 32A and 32B, respectively) to hold locking panel 3120 in place.

Figure 32:
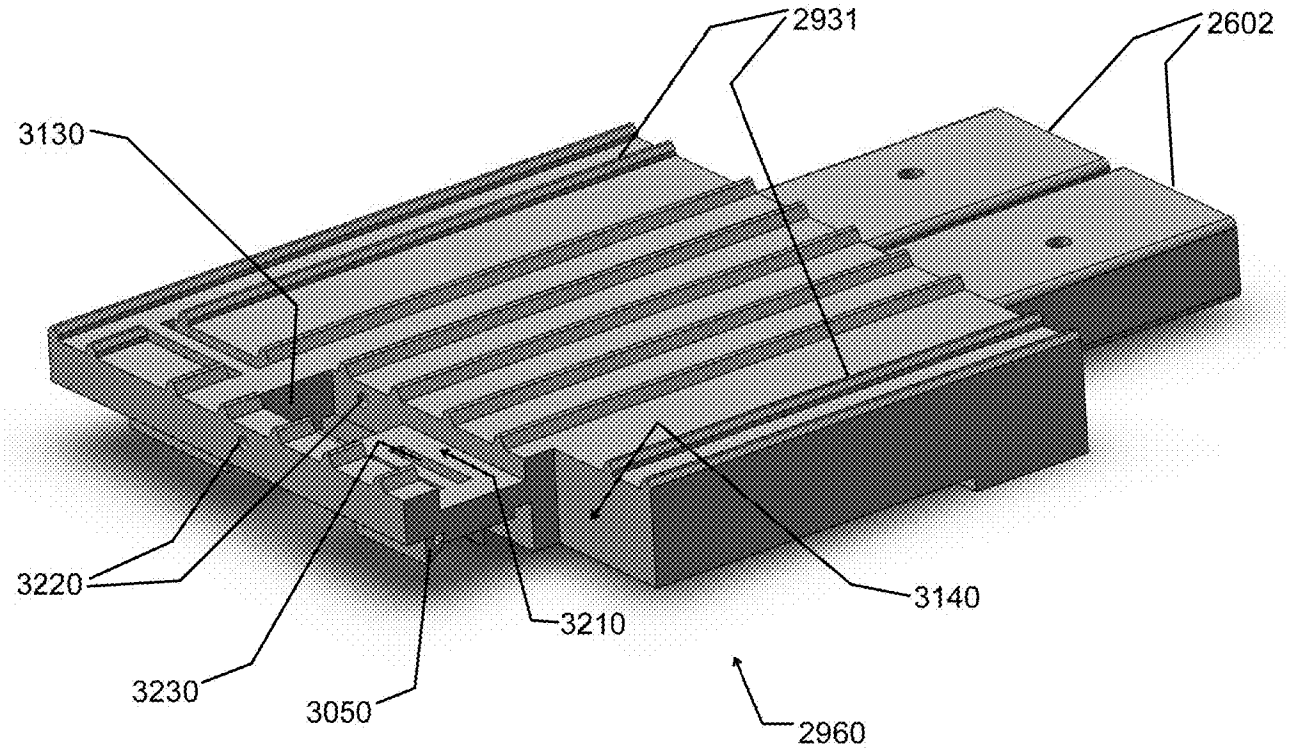
FIG. 32 shows a top perspective view of the alternative locking mechanism according to the present disclosure.
Figure 32A:
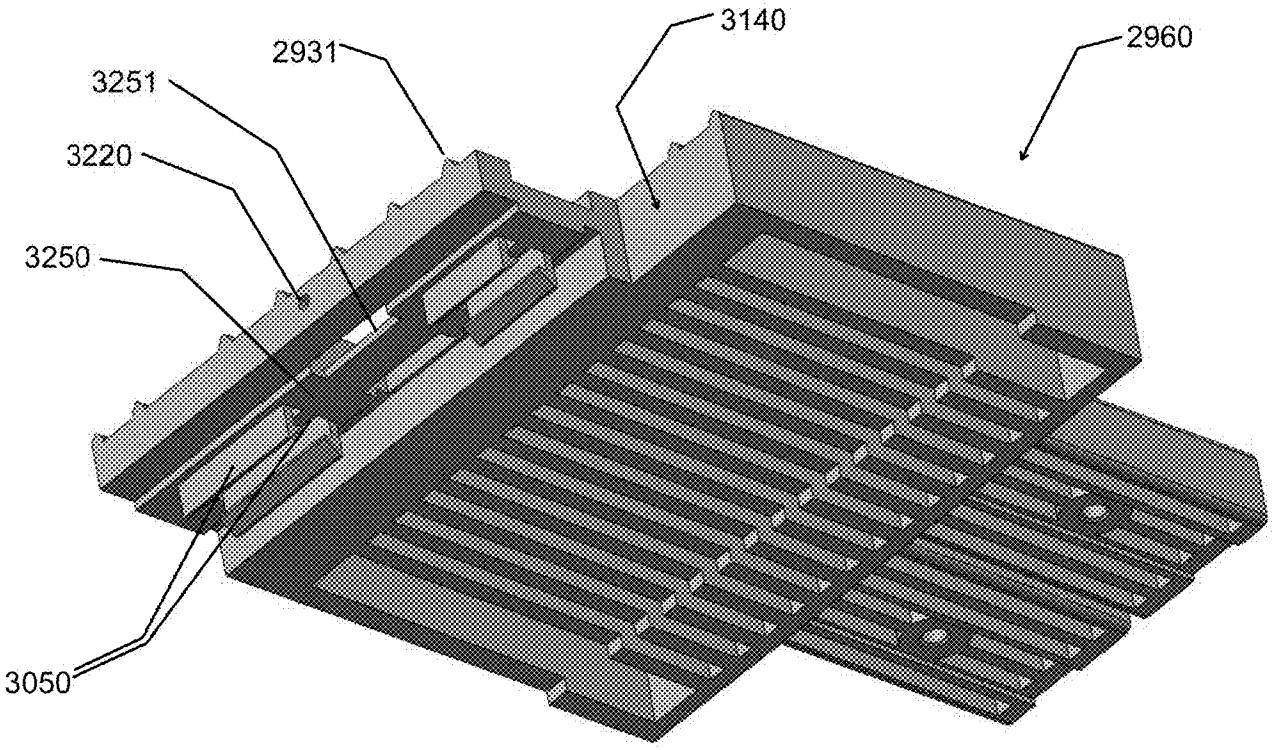
FIG. 32A shows a bottom perspective view of the alternative locking mechanism of FIG. 32.
Figure 32B:
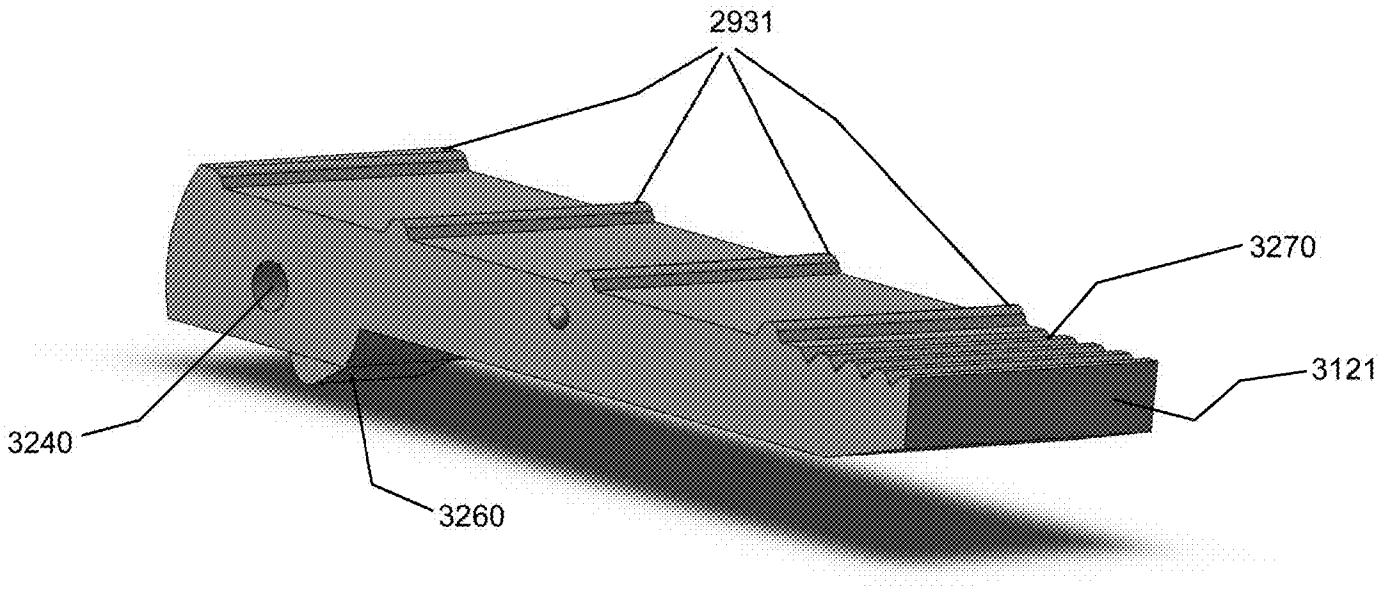
FIG. 32B shows a perspective view of a locking panel that is part of the alternative locking mechanism according to the present disclosure.

FIG. 32 shows a top perspective view of front head 2960 detached from gliding seat 2930 and without locking panel 3120. Of note with respect to FIG. 32 are locking panel space 3210, holes 3220 and slots 3230. Locking panel space 3210 is designed and configured to closely accept locking panel 3120 so locking panel 3120 seats flush in front head 2960 and so that gliding ribs 2931 of locking panel (see, e.g., FIG. 32B) align with gliding ribs 2931 of front head 2960. Holes 3220 are provided to accept a pin (not shown) passing there through and also through locking panel holes 3240 (see, FIG. 32B) to rotatably affix locking panel 3120 in locking panel space 3210. Slots 3230 are provided to inspect the locking pin from underneath to ensure complete insertion of locking panel 3120. FIG. 32A shows a bottom perspective view of front head 2960. Of note with respect to FIG. 32A is a connecting strip 3250 that connects to two arms 3050. Arms 3050 in FIG. 32A are of a different configuration than arms 3050 shown in FIG. 30, but serve the same purpose as arms 3050 shown in FIG. 30. As will be appreciated by one skilled in the art, arms 3050 of FIG. 32A will operate in conjunction with a locking strip that has a generally rectangular shape, rather than a trapezoidal shape. Connecting strip 3250 has a relatively narrower portion 3251 that is disposed below cam 3260. When locking panel 3210 is in a "down" position as when it is seated flush with front head 2960, a cam 3260 contacts and presses upon narrow portion 3251. This downward motion causes front head 2960 to be firmly locked into position along locking pin 3030. On the other hand, when locking panel 3210 is lifted (see, FIG. 31B) this releases the pressure and allows front head 2960, and thus gliding rib seat 2930 and merchandise-advance system 2900 to be either slid, or lifted and removed, for re-placement to another location, or for cleaning, or for any other purpose. FIG. 32B shows a perspective view of locking panel 3120. Adjacent to end 3121 of locking panel 3120 are a plurality of ridges 3270 that provide a gripping surface for locking panel 3120 to allow easier gripping for rotation thereof.

Figure 33:
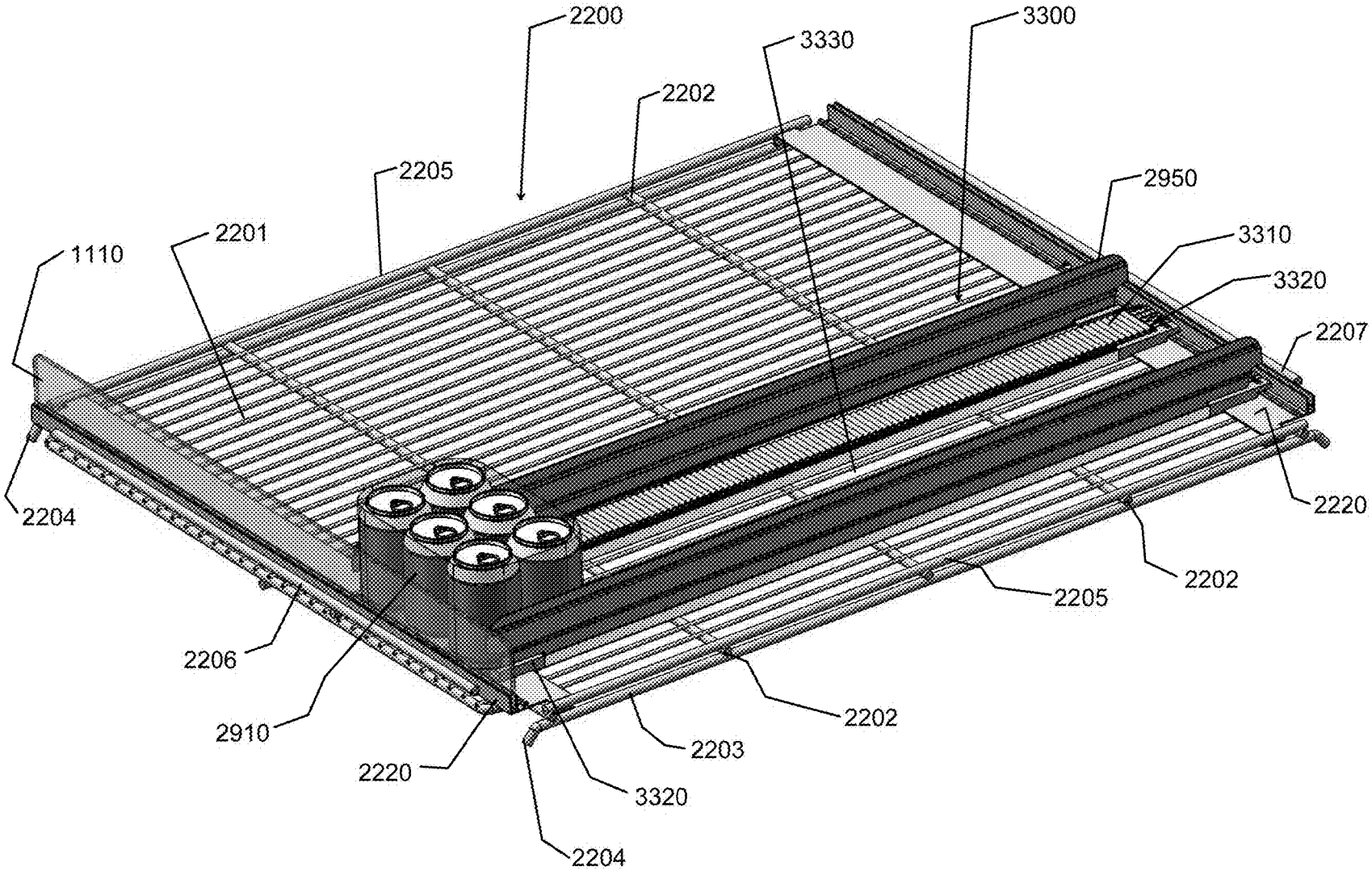
FIG. 33 shows a left front perspective view of a roller seat system for a wire shelf that includes an alternative locking mechanism according to the present disclosure.

FIG. 33 shows an alternate embodiment of a merchandise-advancement system 3300 for use on wire shelf 2200. With respect to the individual elements of wire shelf 2200, these have been described in detail in conjunction with FIGS. 22 and 23, and that description will not be repeated here. Merchandise-advancement system 3300 also comprises front foot 2220 and rear foot 2220 that have likewise generally been described in detail in conjunction with FIGS. 22 and 23. Front foot 2220 and rear foot 2220 of FIG. 33 include locking pin 3030 that is shown in, e.g., FIG. 30A. In FIG. 33, merchandise 2910 comprises a six-pack of cans, e.g., soda cans and divider 2950 as shown in FIG. 29. Merchandise-advancement system 3300 differs from those describes above in three respects. First, merchandise-advancement system 3300 includes a roller seat 3310 that is a one-piece construction and includes a plurality of rollers. The elements of roller seat 3310 have been described above in detail in conjunction with, e.g., FIG. 1. Of course, roller seat 3310 need not be a one-piece construction as shown in FIG. 33, but may be a plurality of connected roller seats. A suitable connector for a plurality of roller seats will be described in conjunction with FIGS. 36-36B. Second, merchandise-advancement system 3300 includes different front head 3320 (see, description in conjunction with FIG. 35) and rear head 3320. Third, merchandise-advancement system 3300 includes a roller base 3330 into which roller seat 3310 fits (see, description in conjunction with FIG. 35).

Figure 34:
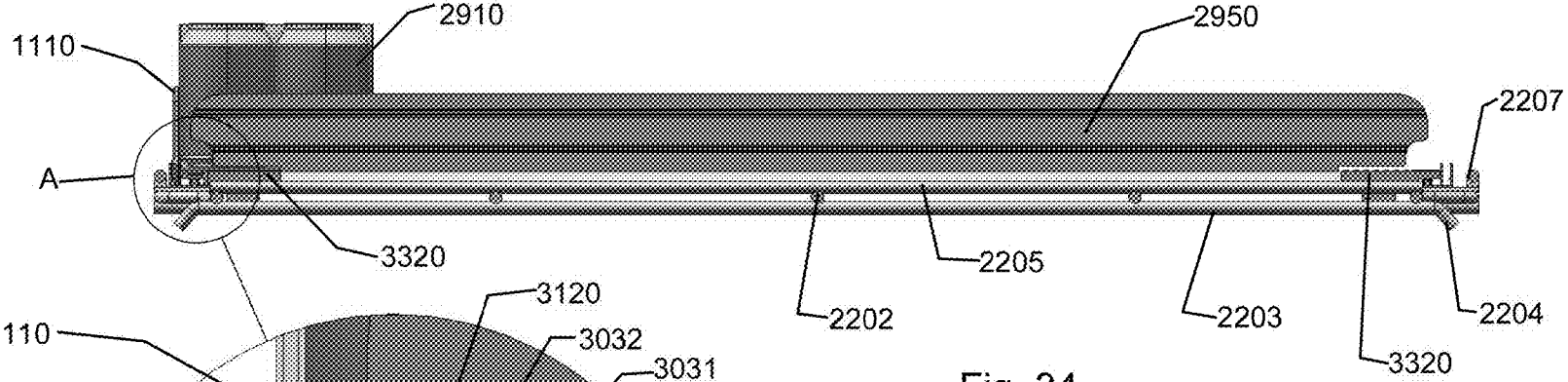
FIG. 34 shows a side view of the roller seat system of FIG. 33.
Figure 34A:
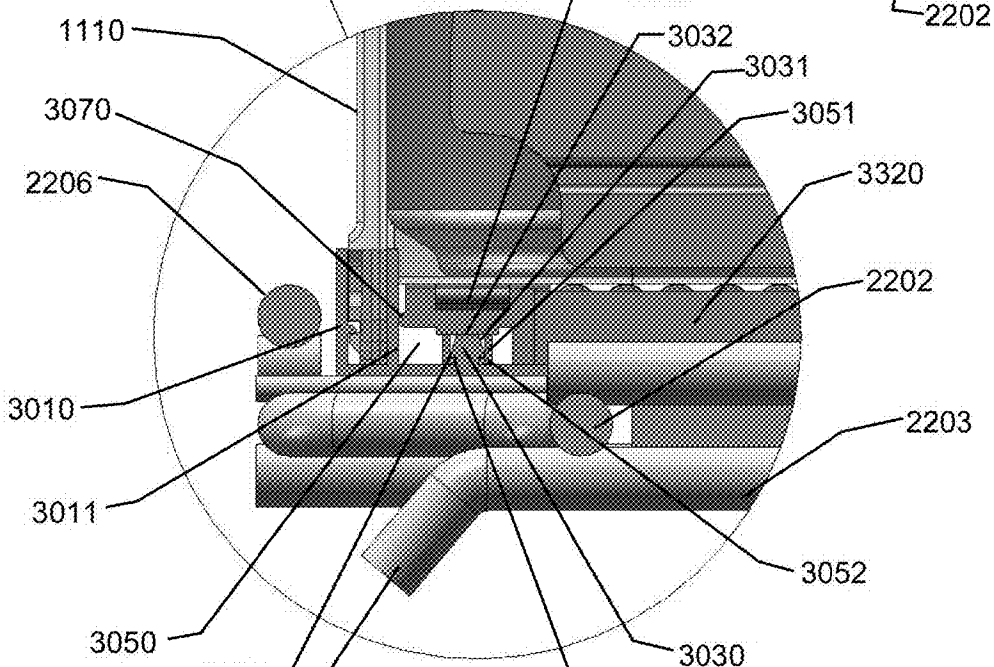
FIG. 34A shows a detail view of the alternative locking mechanism shown in section "A" of FIG. 34 according to the present disclosure.

FIG. 34 shows a side view of merchandise-advancement system 3300 shown in FIG. 33. FIG. 34A shows a detail view of section "A" of FIG. 34. The elements of FIG. 34A are essentially identical as shown in FIG. 30A. However, FIG. 34A shows a front head 3320 that is designed and configured to accept a roller seat therein as will be more fully described in conjunction with FIG. 35.

Figures 35, 35A:
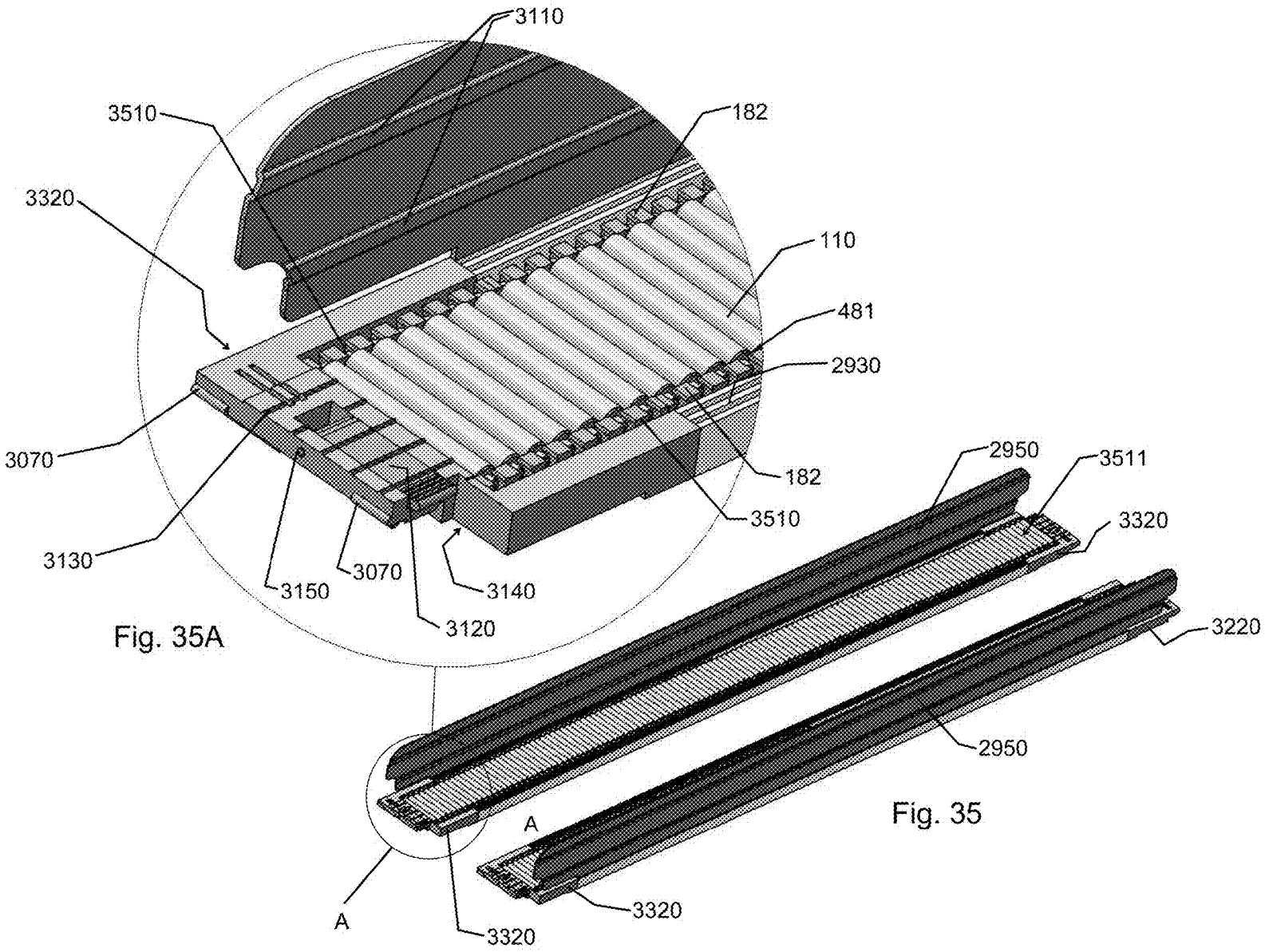
FIG. 35 shows a top perspective view pair of roller seats, one with a left divider, one with a right divider as shown in FIG. 33, disposed apart from the wire shelf.
FIG. 35A shows a detail view of section "A" of the alternative locking mechanism of the FIG. 35.
Figure 35B:
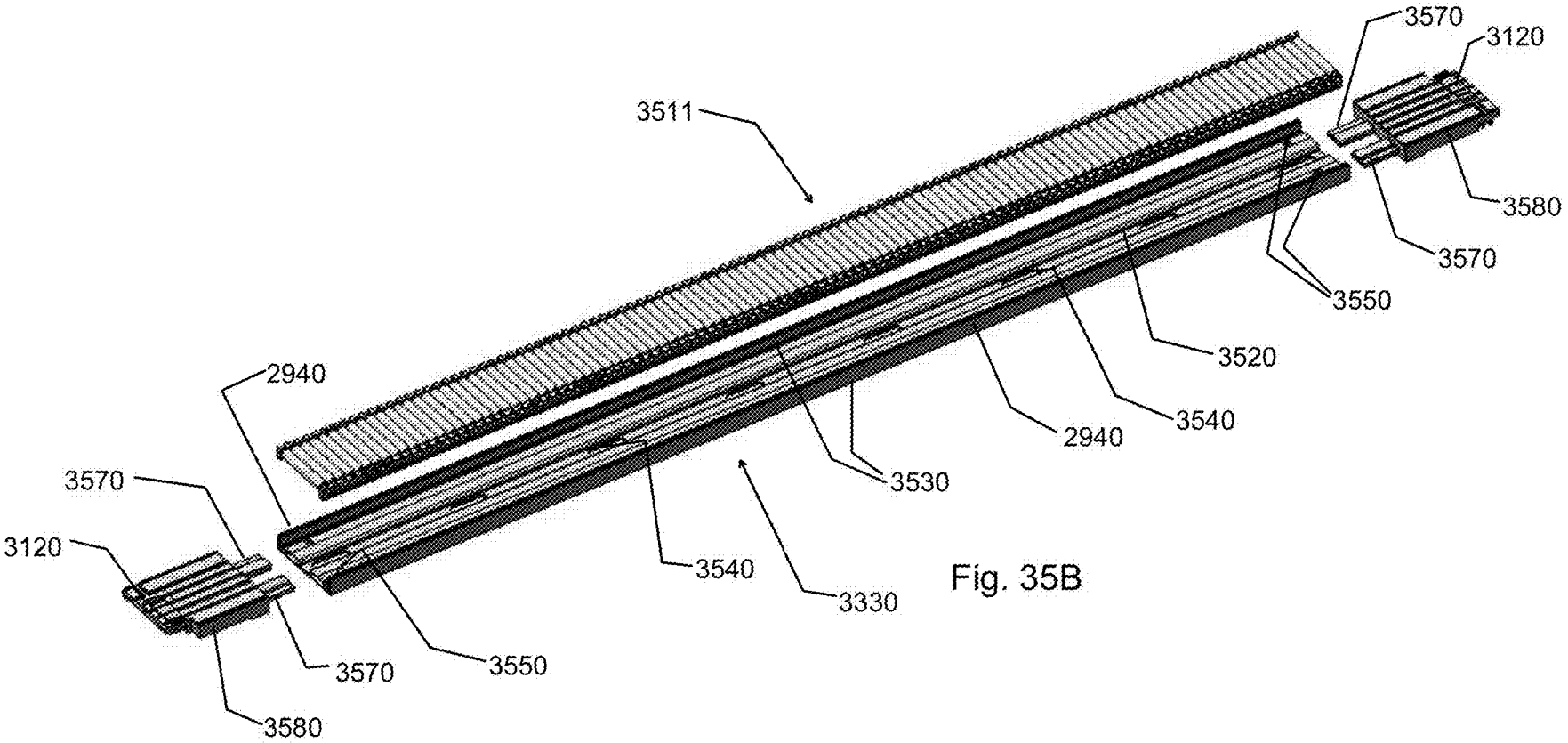
FIG. 35B shows an exploded view of an alternative roller seat system.
Figures 35C, 35D, 35E, 35F:
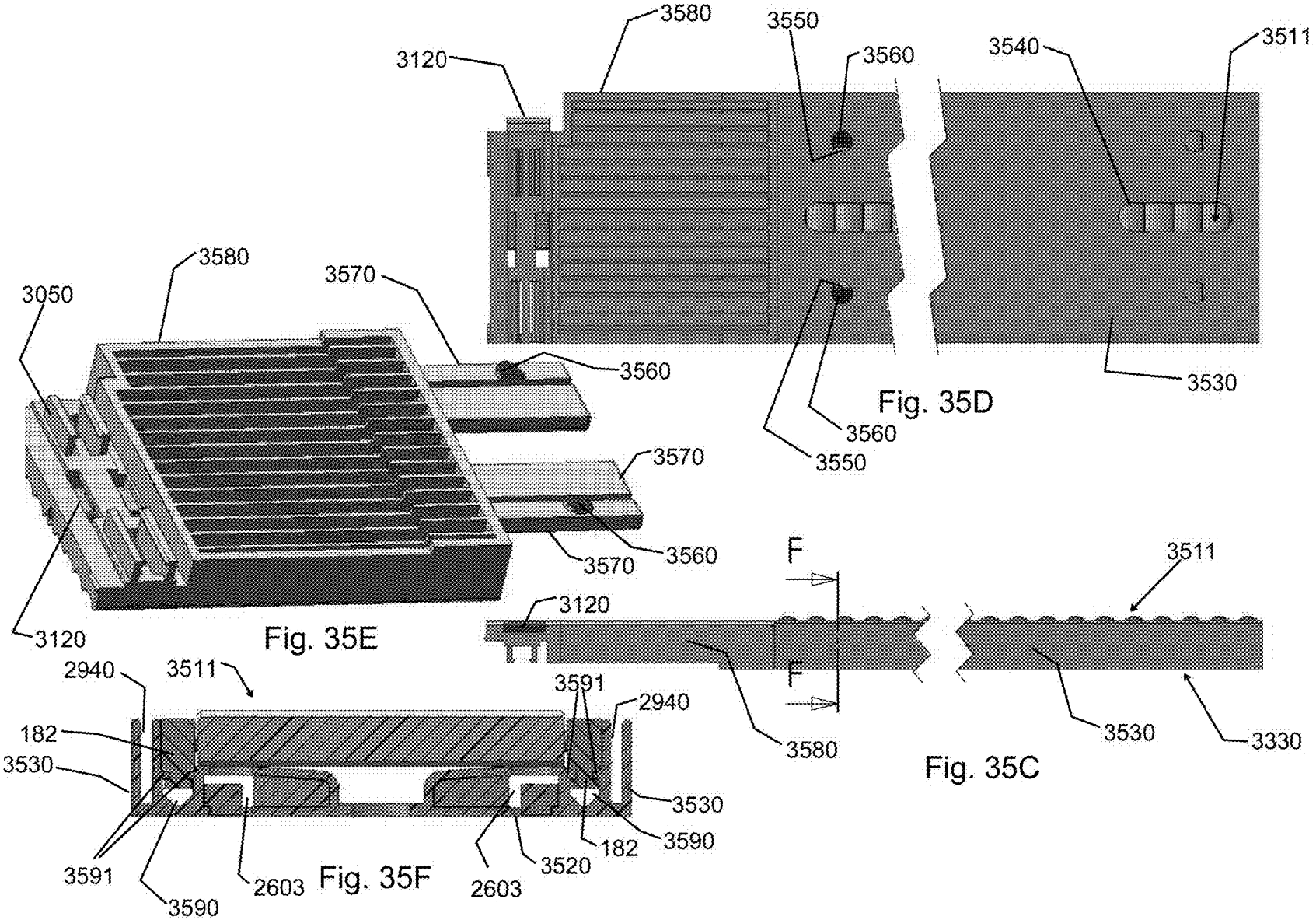
FIG. 35C shows a side view of the front (or rear) section of the roller seat system of FIG. 35B.
FIG. 35D shows a bottom view of the front (or rear) section of the roller seat system of FIG. 35C.
FIG. 35E shows a bottom view of a front (or rear) head of FIG. 35C.
FIG. 35F shows a cross-sectional view through line "F"-"F" of FIG. 35C.
Figures 36, 36A, 36B:
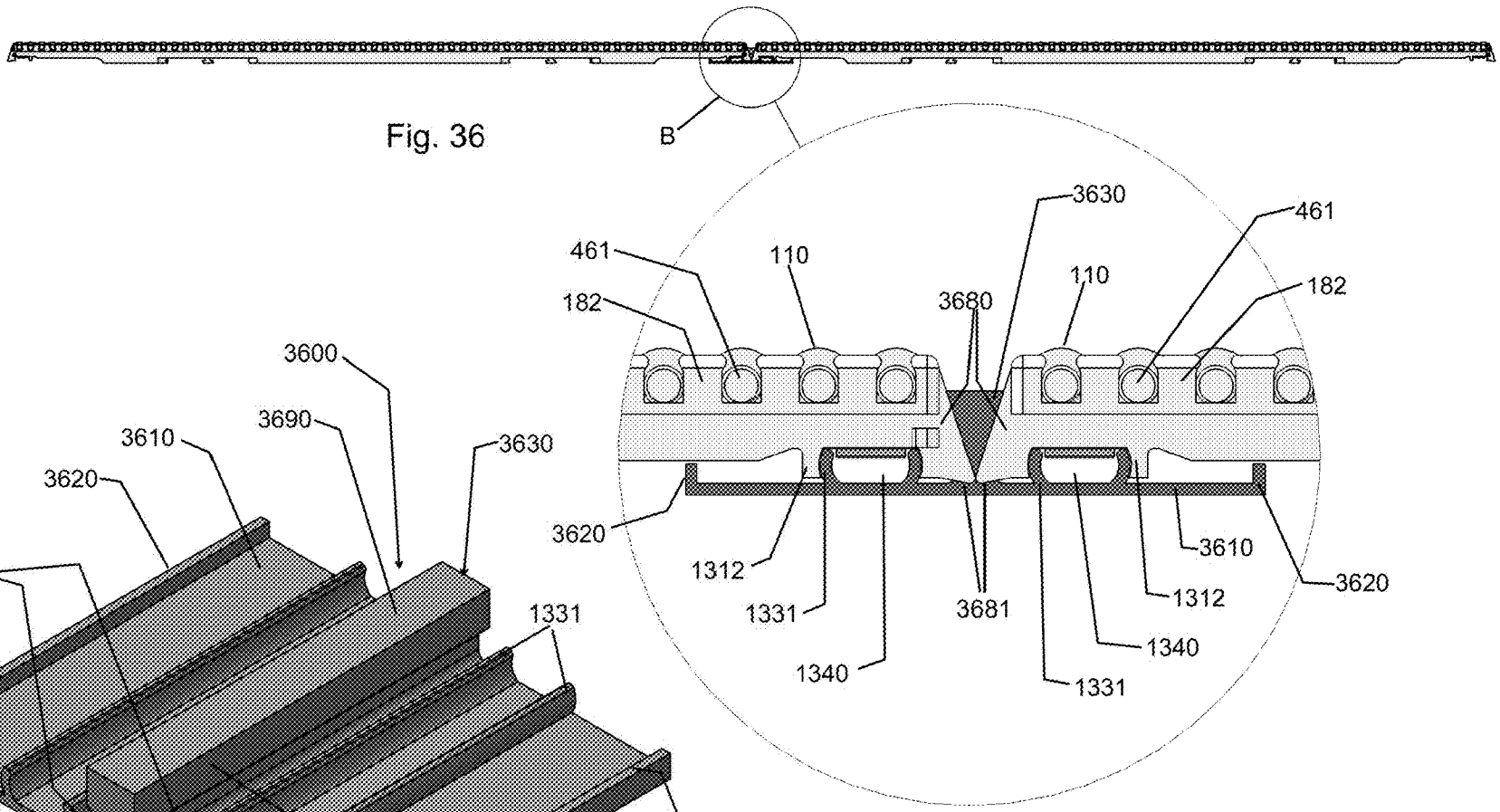
FIG. 36 shows a side view of a seat connector connecting two roller seats longitudinally to each other.
FIG. 36A shows a detail view of section "A" of FIG. 36.
FIG. 36B shows a top perspective view of the seat connector of FIG. 36 according to the present disclosure.

FIG. 35 shows merchandise-advancement system 3300 of FIG. 33 without wire shelf 2200 or merchandise 2910. FIG. 35A shows a detail view of section "A" of FIG. 35. All of the individual elements of FIGS. 35-35A have been described previously with respect to other Figures, with the exception of the configuration of front head 3320. Front head 3320 (and similarly rear head 3320) includes many of the same elements as front head 2960 and rear head 2960 as described above with respect to FIGS. 30A and 31A. However, front head 3320 and rear head 3320 eliminate gliding ribs 2931 of front head 2960 and rear head 2960. Rather than gliding ribs 2931, front head 3320 and rear head 3320 include an open space 3510 that is sized and configured to accept roller seat 3310 that is shown as a one-piece construction. As noted above, roller seat 3310 need not be a one-piece construction but may be a plurality of connected roller seats, as described in conjunction with FIGS. 27 and 36. FIG. 35B shows another alternative roller seat system of the present disclosure. FIG. 35B shows an exploded view of roller base 3330 (generally described above in conjunction with FIG. 33). In FIG. 35B, a roller seat 3511 is different than that shown in FIG. 33 in that it is sized and configured to fit the front head and rear head 3580 which are similar to front head and rear head 2960 in FIGS. 29, 31, 32, 32A and 32B, and to fit entirely in roller base 3330. Roller base 3330 comprises a base bottom 3520, divider slots 2940, opposing base walls 3530 that match the length of roller base 3300, a plurality of fluid drain slots 3540, and through-holes 3550 sized and configured to each accept anchors 3560 (see. FIG. 35E) on feet 3570 of front head 3580 (see, FIG. 35E). Anchors 3560 in the embodiment shown in FIG. 35E have a sloped configuration that assists in providing a "snap-fit" with through-holes 3550. In addition, the dimension of the top of or anchor 3560, i.e., that area distal from feet 3570 is at least, and preferably a bit larger, than through-holes 3550 to ensure a tight "snap-fit". FIGS. 35C, 35D, 35E and 35F show details of parts of the roller seat system of FIG. 35B. FIG. 35C is a side view of roller base 3330 and front head 3580 (or rear head 3580). FIG. 35D is a bottom view of FIG. 35C. Anchors 3560 on feet 3570 of front head 3580 mate with through-holes 3550 on base bottom 3520 to connect front head 3580 and base bottom 3520. FIG. 35E shows a bottom perspective view of front head 3580 (or rear head 3580). FIG. 35F shows the cross-section through line "F"-"F" of FIG. 35C. of the roller track of FIG. 35C, showing roller base 3330, base bottom 3520, longitudinal slots 2603, divider slots 2940, opposing base walls 3530, roller support bars 182, and roller support strip holders 3590. There are two tabs 3591 on each roller support strip holder 3590, which lock into channels (unnumbered, see, similar channels in FIGS. 5B-5C) on roller support bars.

Figure 14:
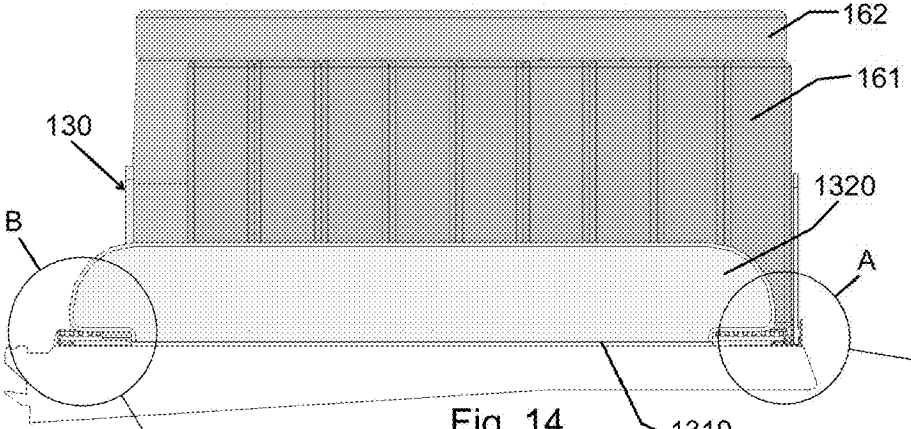
FIG. 14 is a side view of the discrete gravity feed roller seat and adjustable divider of FIG. 13.
Figure 14B:
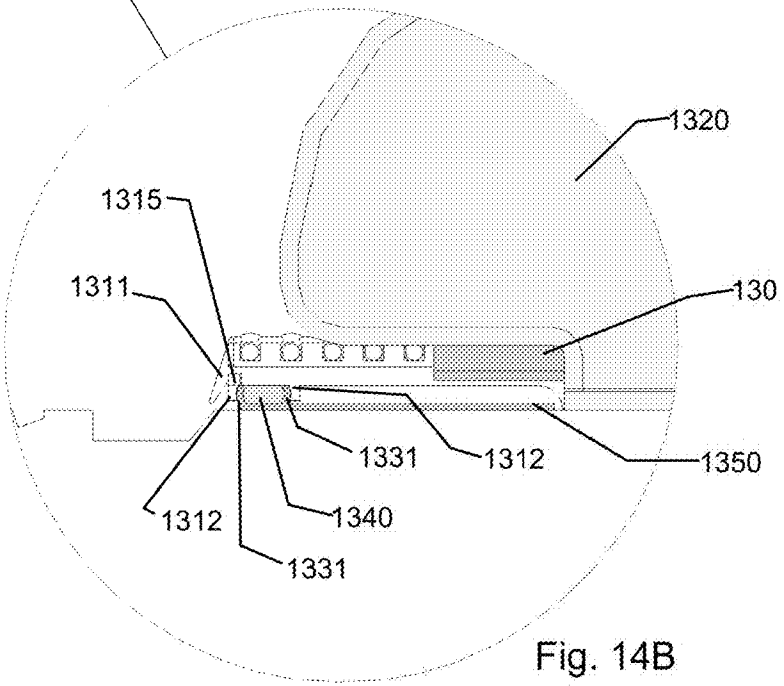
FIG. 14B is a detail view of section "B" of FIG. 14.

FIG. 36 shows two gravity feed roller seats as described above with respect to e.g., FIGS. 13-14 that are joined together with a seat connector 3600 shown in detail in FIG. 36A. Only the necessary relevant elements of gravity feed roller seats as described in FIGS. 13-14 will be identified in FIG. 36B. Seat connector 3600 includes a connector base 3610, two transverse edges 3620 disposed away from connector base 3610, two sets of lock rod holders 1331 (see, FIG. 13) and a T-rod 3630. Lock rod holders 1331 and T-rod 3630 are both also disposed away from connector base 3610 in the same direction as transverse edges 3620. As a result of this configuration all of transverse edges 3620, lock rod holders 1331 and T-rod 3630 are disposed on the same side of connector base 3610 to mate/interact with a bottom side of roller seats. T-rod 3630 has a relatively square upper section 3640 and a neck section 3650, resulting in two transverse channels 3670 across the width of connector 3600. In FIG. 36B, locators 3680 comprise a combination of a locking flange 1312 and locator 1311 (see, FIG. 13D). To connect two roller strips, a tip 3681 of each locator 3680 is placed into one transverse channel 3670 and pressed downwardly causing locking flange 1312 and locking flange 1312 portion of locator 3680 to engage lock rod holders 1331 on connector base 3610. Lock tab 1610 (see, FIG. 16A) engages a slot or "gap" between two adjacent teeth of the plurality of teeth 1341 that are disposed on lock rod 1340 in the same manner as described above in conjunction with FIGS. 13-16. This engagement prevents lateral movement of joined roller seats. One of each of the transverse edges 3620 contacts the bottom of a roller seat to provide support therefor to limit the ability of the rollers seats flex so as to possibly become disconnected from connector 3600. Connector 3600 can be made of aluminum, plastic or other material. As shown in FIG. 36 B channels 3670 are sized and configured so that the upper surface 3690 of T-rod 3630 is lower than the surface of the rollers on which merchandise is placed, thereby allowing for smooth forward movement of merchandise across the gap between the two roller seats. Multiple connectors 3600 can be used to integrate several roller seats together to meet longitudinal depth requirements of wire shelf 2200 without the need for extra tooling. This is particularly useful for deep cooler and wire rack systems.

Both gliding seats and roller seats are designed to provide sufficient stiffness to stably place the gliding seat and/or roller seat on a wire shelf. The foregoing design of a locking mechanism design allows easy placement of the gliding seats and roller seats into any desired lateral position on a wire shelf by simply locking the front head 2960 and rear head 2960 on the front foot 2220 and rear foot 2220 (preferably each made of aluminum extrusions, but other materials can be used), and then insert dividers 2950 easily into the divider slots 2940. Of course, although dividers 2950 and divider slots 2940 are exemplified in FIGS. 29-36 to engage each other along the length of the gliding seat and roller seat, other designs of dividers and divider slots as exemplified herein may be used. In addition, the seat connector 3600 shown in FIG. 36 provides a solution for problems associated with shelves in cooler or rack systems with depths from 36" to 72".

A problem that can arise with roller seats in installations that will be subject to stocking of relatively heavy merchandise, i.e., twelve packs of soda or beer cans or bottles roller breakage, particularly in the front section (proximal to where a customer will remove merchandise) or the rear section, caused by the impact of a customer replacing merchandise or during merchandise restocking, respectively. The present disclosure provides a "landing zone" as a solution to this problem.

Figures 37, 37A, 37B:
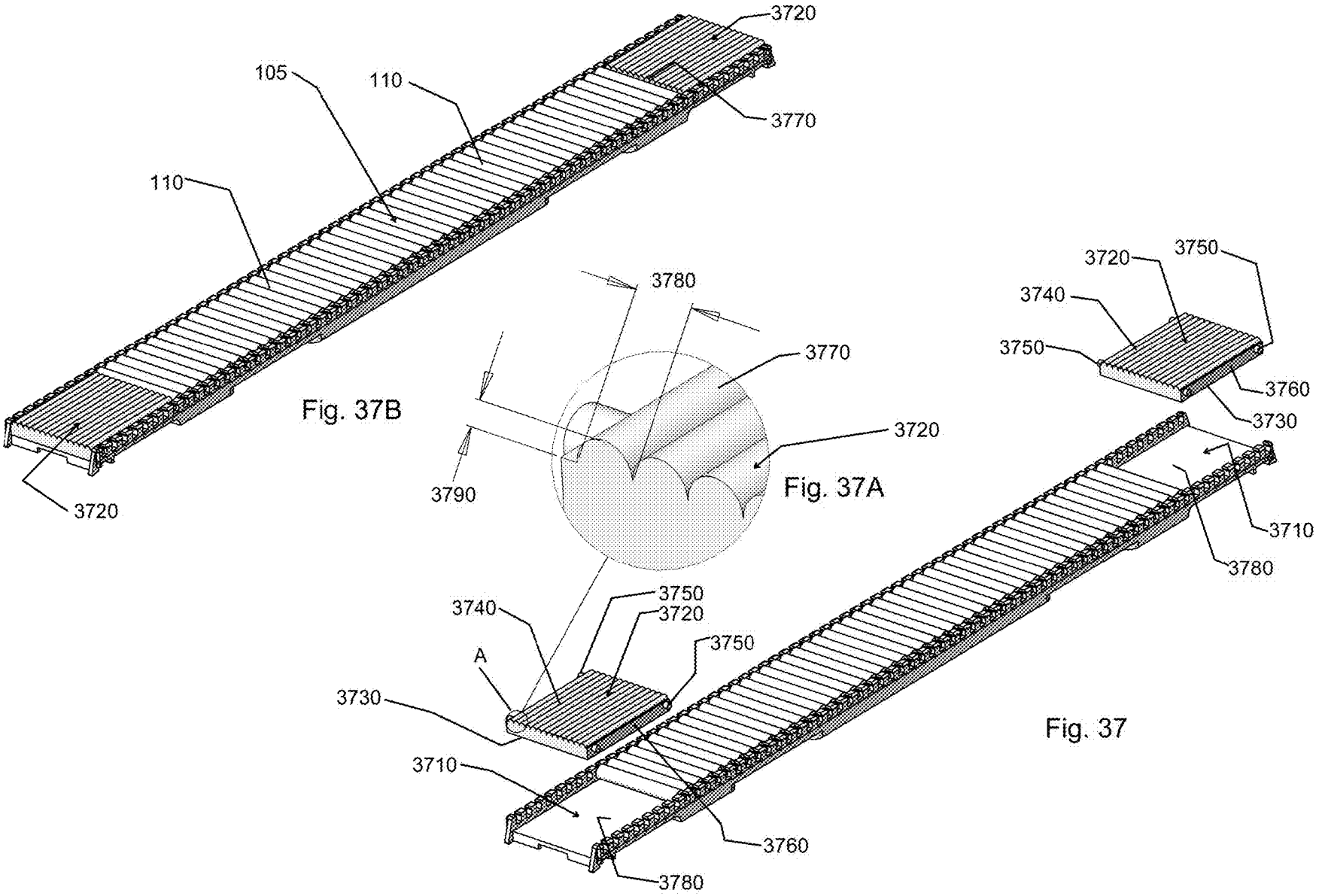
FIG. 37 shows a perspective view of front and rear landing zones that can be used with roller seats.
FIG. 37A shows a partially exploded view of front and rear landing zones of FIG. 37.
FIG. 37B shows a detail view of section "B" of FIG. 37A according to the present disclosure.

FIG. 37 shows a landing zone 3710 disposed in the front and rear sections of e.g., a discrete gravity feed roller seat 105 comprised of a plurality of rollers 110 of the present disclosure as described in conjunction with FIG. 1. A loading panel 3720 comprises a bottom surface 3730, a top surface 3740 and loading panel pins 3750 disposed at side edges 3760 of loading panel 3720. FIG. 37A shows a detail view of section "A" of FIG. 37. As shown in FIG. 37A, top surface 3720 is comprised of a plurality of curved ribs 3770 that are disposed in a direction generally perpendicular to rollers 110. Curved ribs 3770 allow for merchandise to "glide" along top surface 3740 whether due to restocking at the rear or replacement of merchandise by a customer at the front. As shown in FIGS. 37 and 37B, loading panels 3720 are a solid plate that is seated on a base 3780 of roller seat 105. The construction of loading panel 3720 as a solid plate allows it to absorb impact of merchandise placement, sparing rollers 110 of having to do so and possibly become broken. While loading panel 3720 is described as a solid plate, it will be appreciated that loading panel may be provided with, e.g., a base grid 630 comprised of a plurality of longitudinal ribs 640 and a plurality of transverse ribs 620 (see, FIG. 6D) to increase the stiffness/strength of loading panel 3720 while reducing material use/cost. The depth of loading panel 3720 depends on the merchandise that will be disposed on roller seat 105, usually 1.5", 2", or 3". Curved ribs 3770 can have curve width 3780 and curve height 3790 that similarly depends on the merchandise that will be disposed on roller seat 105. In the embodiment shown in FIG. 37A, e.g., curve width 3780 is approximately 3 mm and curve height is approximately 1.5 mm, respectively. Loading panel 3720 can be easily installed on roller support bars 182 by placing loading panel pins 3750 into side openings 460 of roller support bars 182 as described in conjunction with, e.g., FIG. 4A. FIG. 37B shows loading panels 3720 in place in the roller seat. As can be seen in FIG. 37B, curve height 3790 of curved ribs 3770 is provided so that curved ribs are slightly higher than the upper surface of rollers 110. This configuration also lessens impact of merchandise on rollers 110.

A gravity-feed merchandise-advancement mechanism requires pitch as a necessary condition. While it is possible to make a new shelf according to a designed pitch, it would be desirable to have a mechanism that creates pitch for existing shelves, i.e., for retrofit. The following embodiment of the present disclosure provides angle converters that satisfy this desire.

Figure 38A:
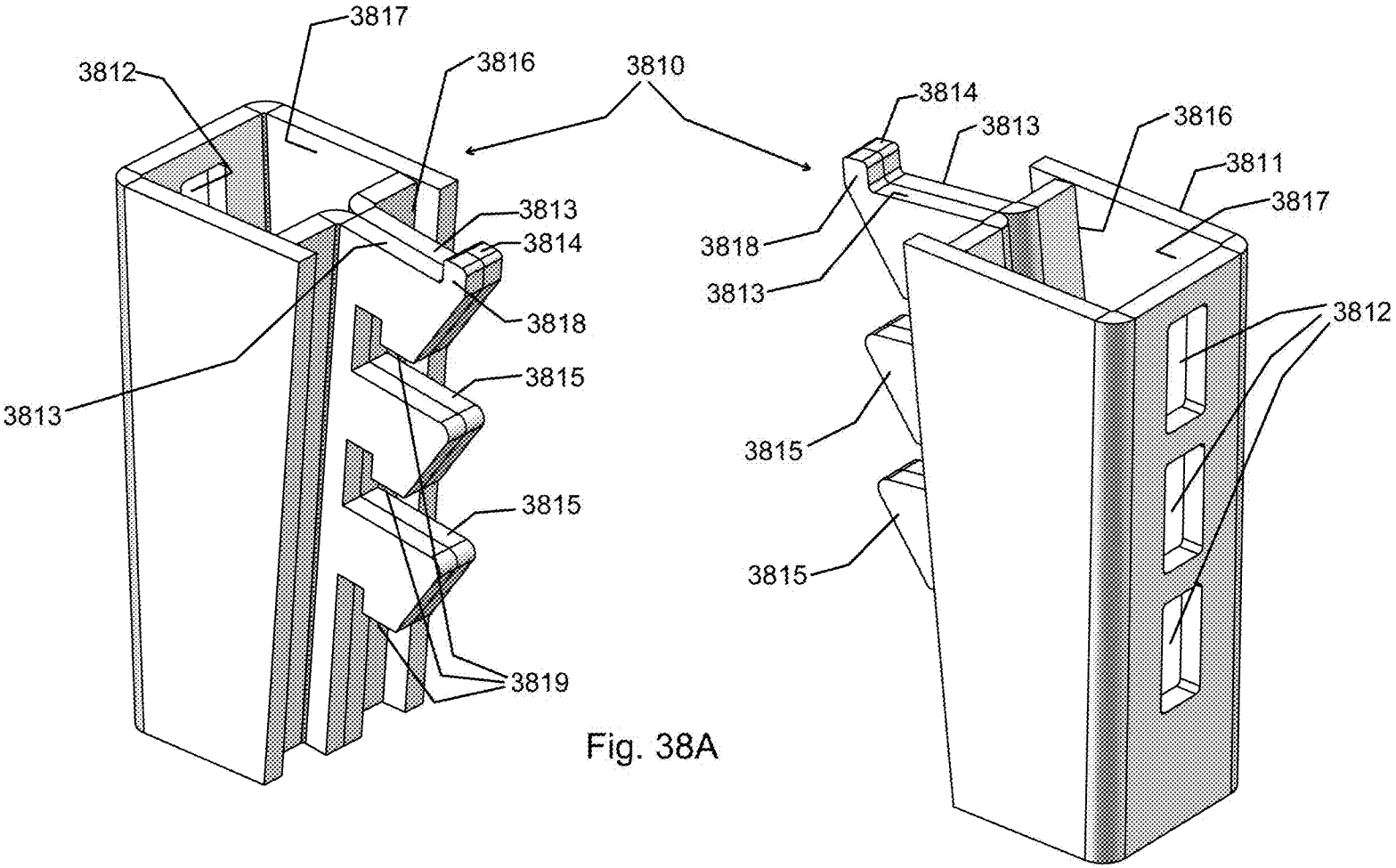
FIG. 38A shows front and rear perspective views of a center angle converter.
Figure 38B:
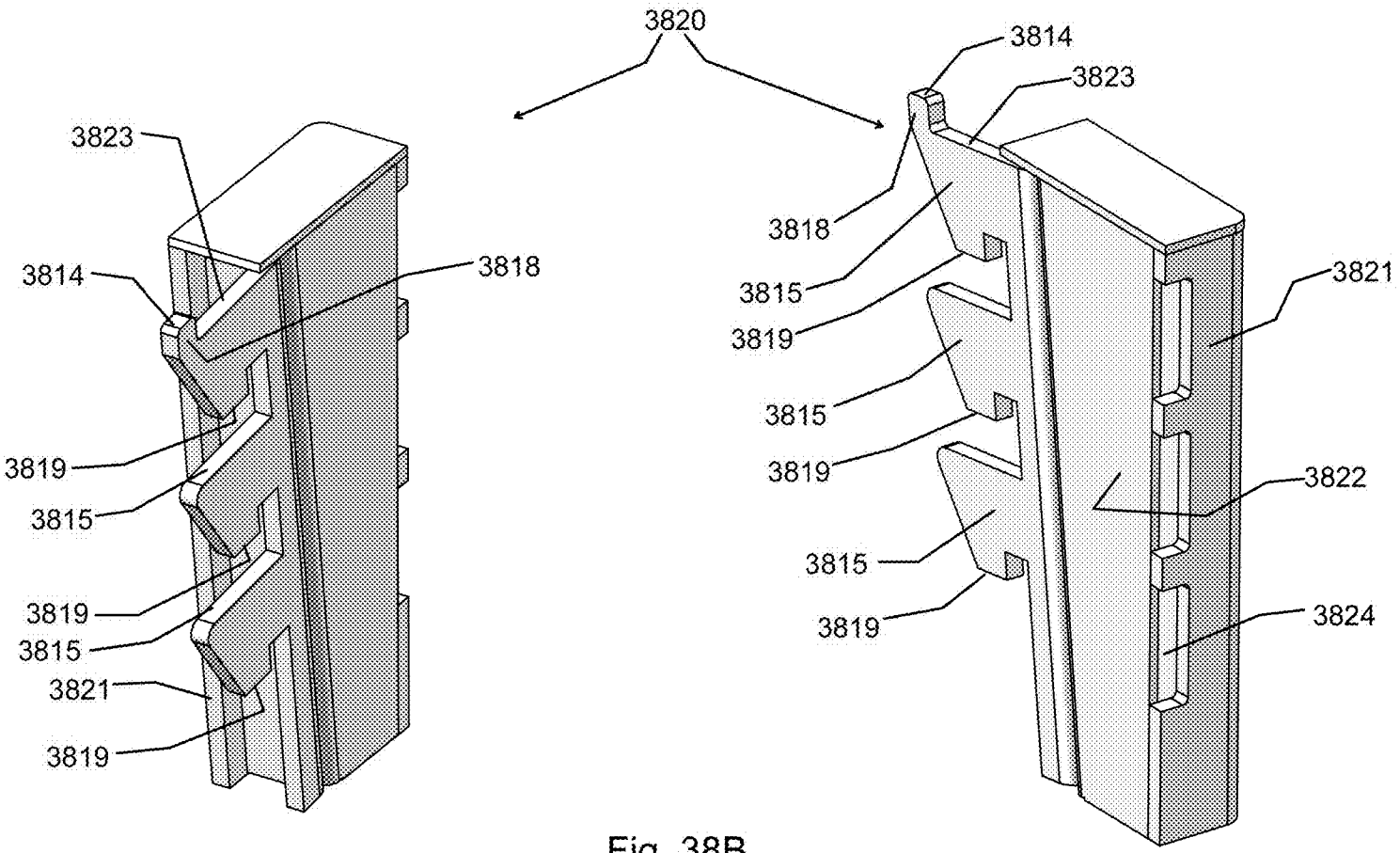
FIG. 38B shows front and rear perspective views of a left angle converter.
Figure 38C:
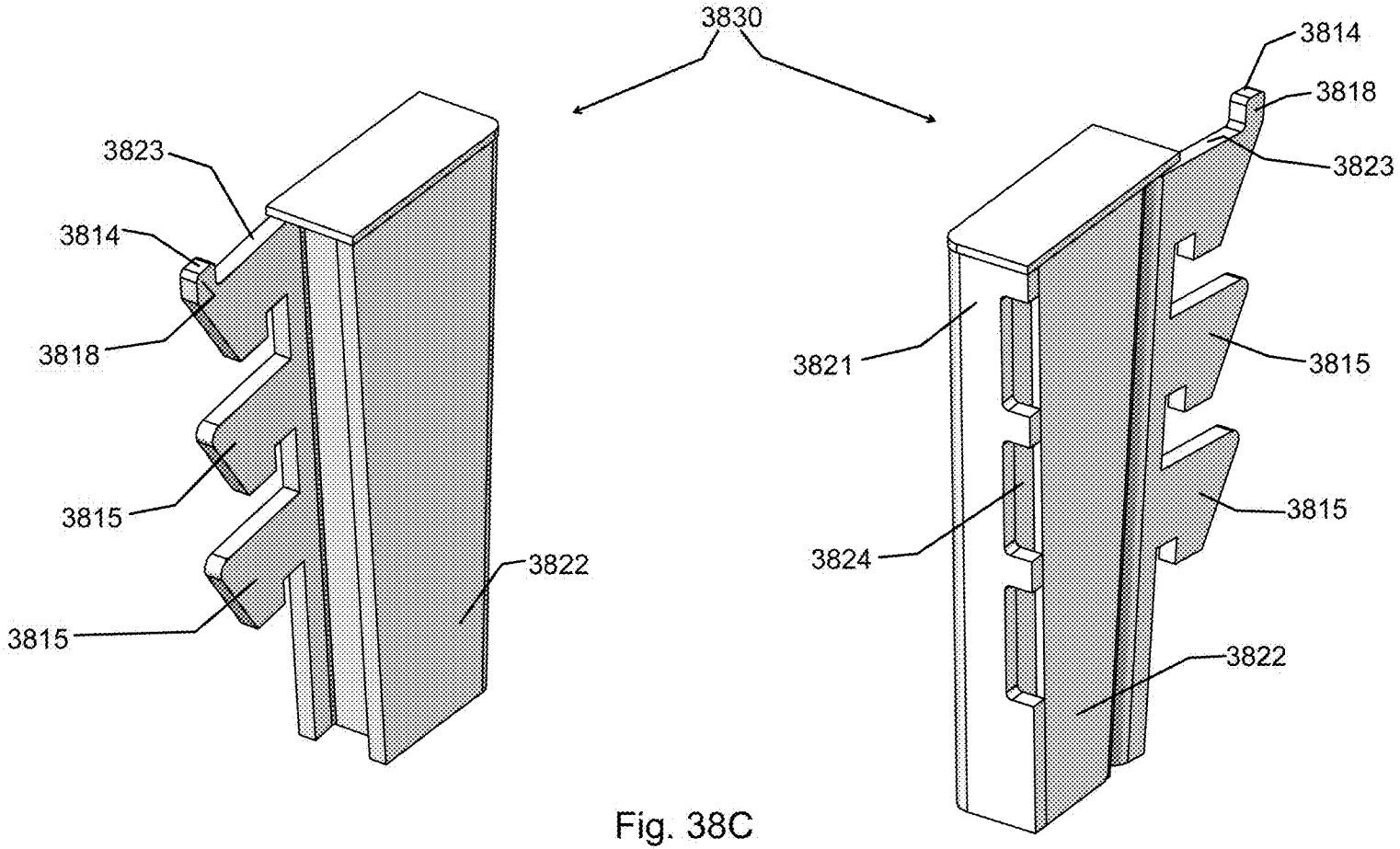
FIG. 38C shows front and rear perspective views of a right angle converter.

FIGS. 38A, 38B and 38C are front and rear perspective views of a center angle converter 3810, a left angle converter 3820 and a right angle converter 3830, respectively. As is known in the art, shelving gondolas comprise uprights that are vertically disposed from a base. Shelves are generally attached to the gondola uprights perpendicularly to the uprights using brackets that are inserted into slots that are generally evenly space on the gondola uprights. The level at which the gondola shelves are placed and the height between shelves disposed vertically in relation to each other depend upon the level at which the brackets are placed in the upright slots. Angled shelves can be fabricated for use on the vertically disposed uprights as a retrofit for standard gondola shelves, but this involves additional cost and wastes the standard shelving material. Center angle converter 3810, left angle converter 3820 and right angle converter 3830 can be used to retrofit standard perpendicular shelves into pitched shelves for use with gravity-feed merchandise-advancement mechanisms.

Referring first to FIG. 38A, center angle converter 3810 comprises a U-channel 3811 having a plurality of three slots 3812 on a front side (i.e., the side facing away from gondola surface), and two L-shaped vertical rods 3813 having a plurality of bracket teeth 3814, 3815 that can be made of metal, a tough and strong plastic (such as polycarbonate or polyphenylene), or a combination of metal and plastic. In the embodiments shown in FIGS. 38A-C, angle converters 3810, 3820 and 3830 are made of metal. L-shaped vertical rods 3813 are welded together and a vertical edge 3816 of each is welded to a side wall 3817 of U-channel 3811 to form an integral center angle converter 3810 having slots 3812 on the front side and bracket teeth 3814, 3815 on the back side (i.e., the side facing toward gondola surface). Bracket tooth 3814 is designed with a tab 3818 on top of bracket tooth 3814 that prevents center angle converter 3810 from being pulled out of a slot on the gondola upright. A lower tab 3819 on each bracket teeth 3814, 3815 hooks into the gondola upright. Bracket teeth 3814, 3815 provide load support and stability for center angle converter 3810. The actual dimensions of center angle converter 3810, including the depth, width, height and thicknesses of each part depend on the gondola and loading capacity of the shelf for best fit and durability. Center angle converter 3810 can be designed and fabricated to provide one or two pitches, such as 5° or 12°, or both 6° and 12°.

Referring to FIG. 38B left angle converter 3820 comprises a half U-channel 3821 i.e., an L-panel wall, instead of U-channel 3811, a metal sheet 3822 as a side wall covering half U-channel 3821 and one L-shaped rod 3823 having bracket teeth 3814, 3815. Half U-channel 3821, metal sheet 3822 and L-shaped rod 3823, if metal, are welded together to create an integral unit. When assembled, left angle converter 3820 has approximate "half" size slots 3824. As with center angle converter 3810, tab 3818 on top bracket tooth 3814 prevents left angle converter 3820 from being pulled out of a slot on the gondola upright. Thickness of metal sheet 3822 can be relatively thin. The total width of left angle converter 3820 is slightly less than half of the width of the gondola upright. The actual pitch of left angle converter 3820 will be selected to match the pitch of center angle converter 3810. Referring to FIG. 38C, right angle converter 3830 is a mirror image of left angle converter 3820. As mentioned above, center angle converter 3810, left angle converter 3820 and right angle converter 3830 can be made of metal or tough plastic and, if metal, can be welded individual components or cast. Both U-channel 3811 and half U-channel 3821 are angled to provide the desired pitch to shelves that are inserted into them.

Figure 38D:
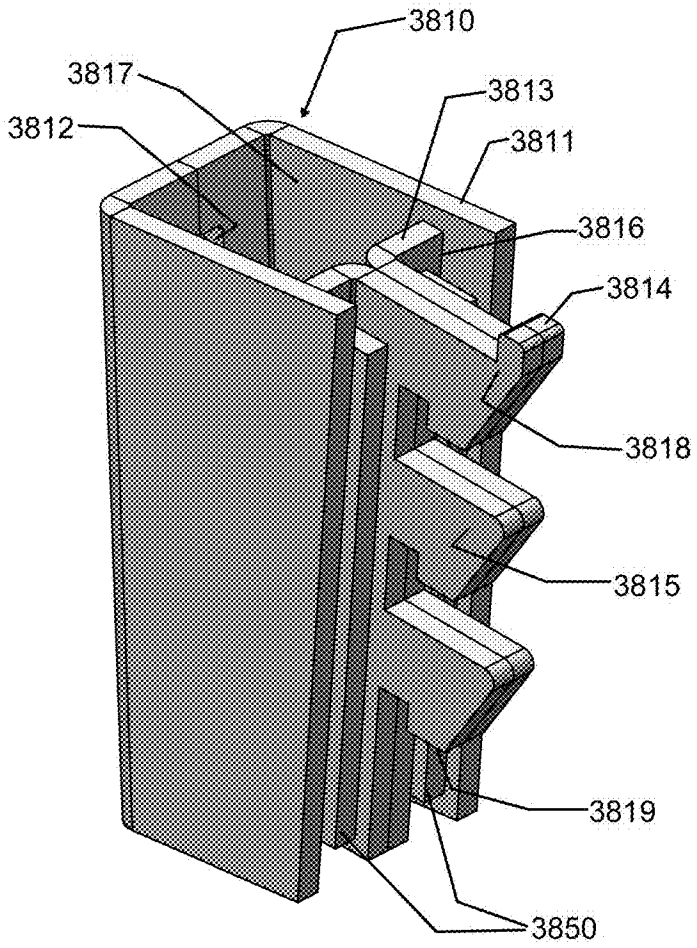
FIG. 38D shows front perspective views of right and center angle converters having vertical front panels to provide added stabilization against gondola upright surfaces.
Figure 38D:
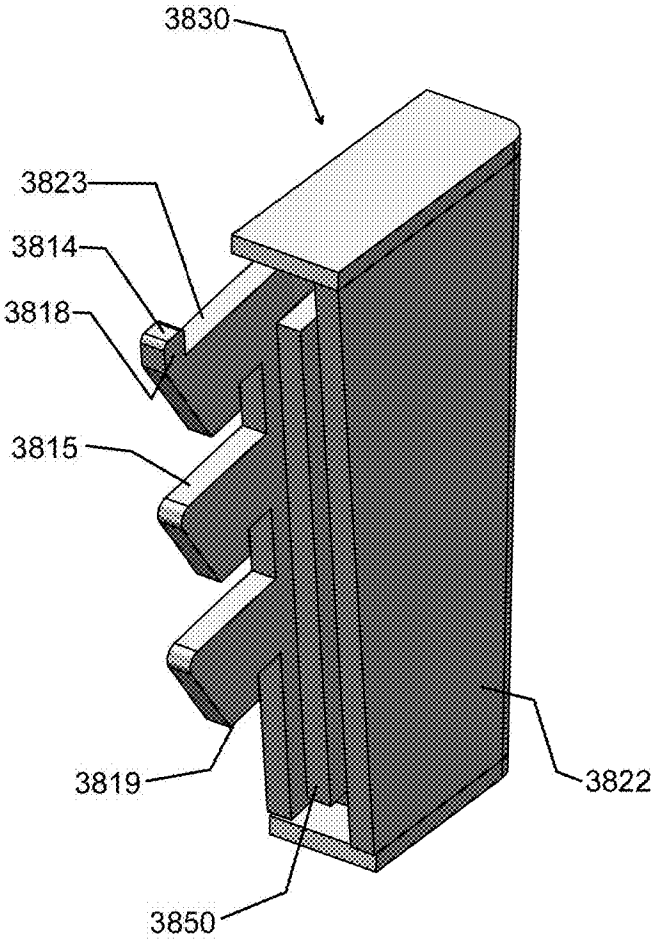
Figure 39C:
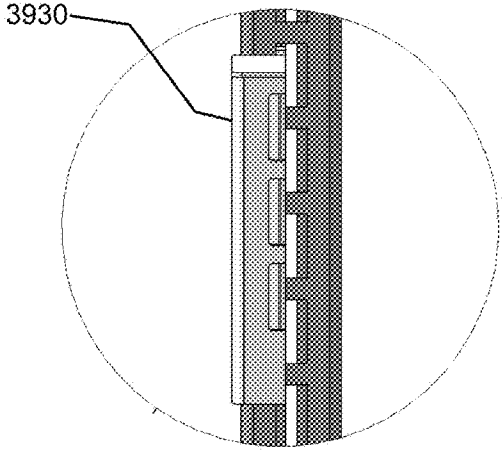
FIGS. 39A, 39B and 39C show front views of left, center and right angle converters installed on gondola uprights, according to the present disclosure.
Figures 40, 40A:
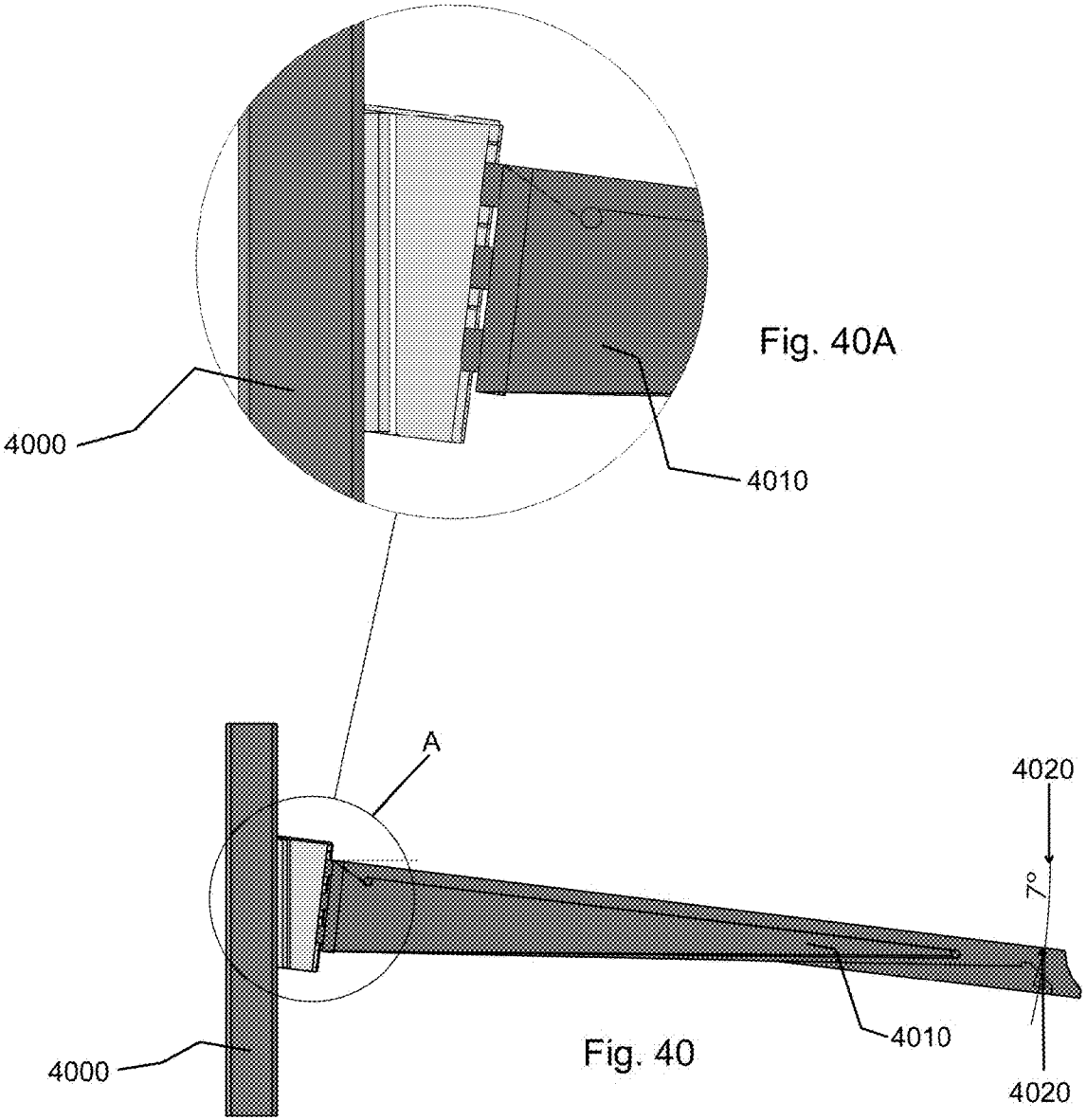
FIG. 40 shows side view of a shelf bracket installed on angle converter.
FIG. 40A shows a detail view of section "A" of FIG. 40, according to the present disclosure.

FIG. 38D shows center angle converter 3810 of FIG. 38A and right angle converter 3830 of FIG. 39C having all the elements as above described, but with the addition of a vertical front panel 3850. Center angle converter 3810 has two vertical front panels 3850, one on each side of bracket teeth 3814, 3815 and right angle converter 3830 has one vertical front panel converter 3850. Vertical front panel(s) 3850 can be added to add further stability to angle converters 3810, 3820 and 3830 against front surfaces of gondola uprights.

Figure 38E:
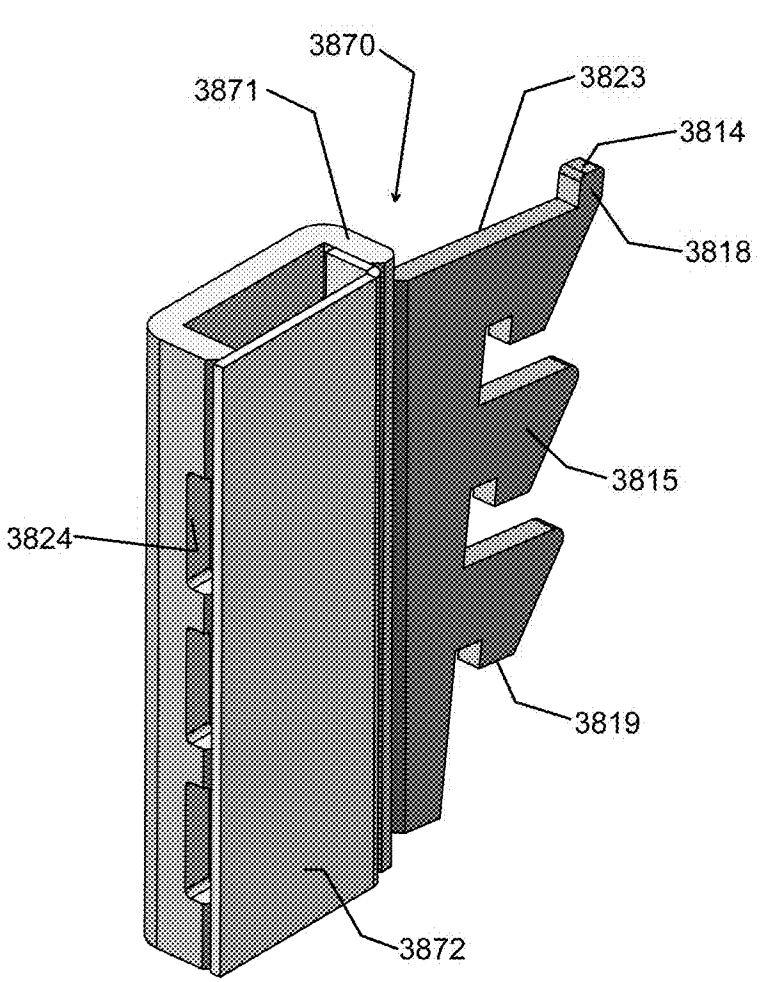
FIG. 38E shows a front perspective view of center angle converter and a rear perspective view of a right angle converter, respectively, made with seamless tubes, according to the present disclosure.
Figure 38E:
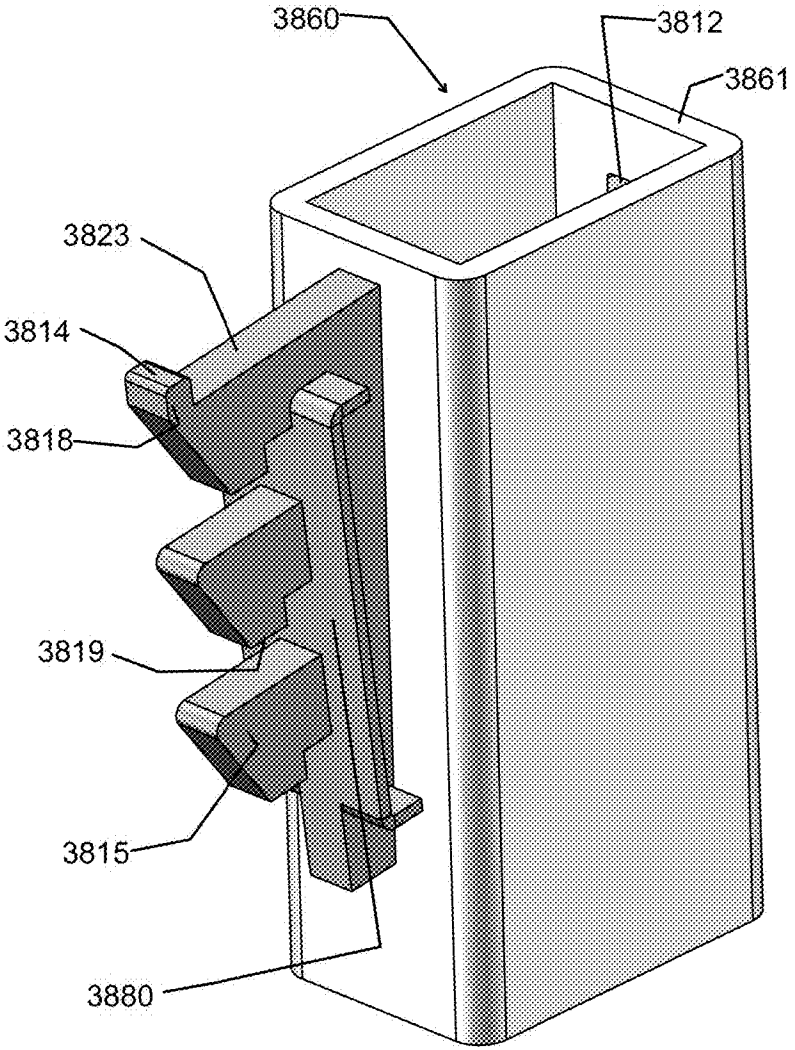

FIG. 38E shows an alternate construction of a angle converter that provides additional strength and stiffness for deeper shelves such as 28" to 36", or deeper. Center angle converter 3860 uses a seamless tube 3861 instead of a welded construction as described with respect to center angle converter 3810 of FIG. 38A. Right angle converter 3870 uses half a seamless tube 3871 instead of a welded construction as described with respect to center angle converter 3830 of FIG. 38C. right angle converter 3870 also includes an L-shaped side panel 3872 to close the opening of half seamless tube 3871. Both center angle converter 3860 and right angle converter 3870 include an angle panel 3880 (not shown in conjunction with right angle converter 3870. Angle panel 3880 is used because seamless tube 3861 and half seamless tube 3871 cannot be angled as easily as U-channel 3811 and half U-channel 3821. Angled panel 3880 works with bracket teeth 3814, 3815 to provide stabilization against the front surface of gondola upright.

Figure 39B:
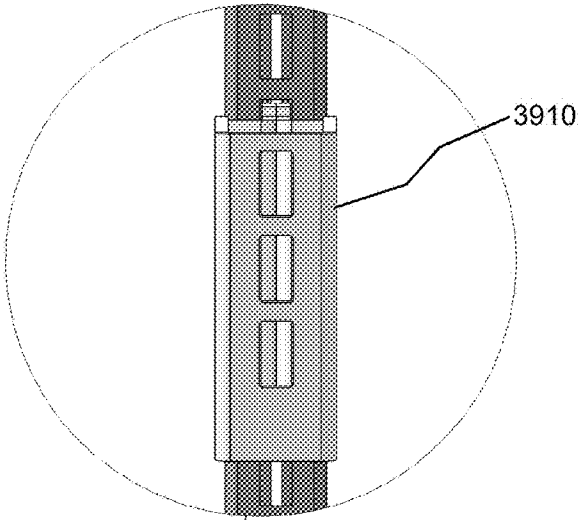
Figure 39A:
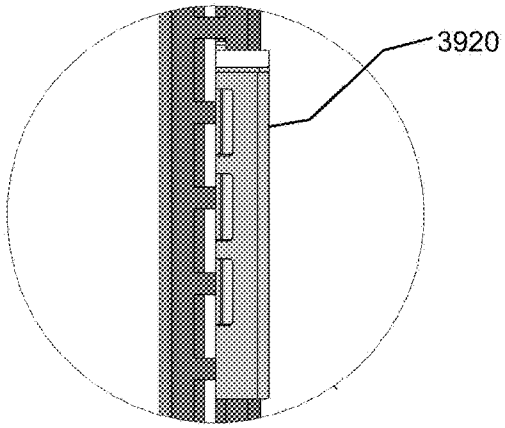

FIGS. 39A, 39B and 39C show left angle converter 3820, center angle converter 3810, and right angle converter 3830 disposed on a left, center and right gondola upright, respectively.

FIG. 40 shows a side view of left angle converter 3820 placed on a gondola upright 4000 and holding a shelf bracket 4010. FIG. 40A is a detail view of section "A" of FIG. 40. As shown in FIG. 40, the declined pitch 4020 shown is 7°, although, as noted above pitches of between 5° and 12° are a common range of pitches that can be accommodated by left angle converter 3820, center angle converter 3810, and right angle converter 3830.

Figure 41:
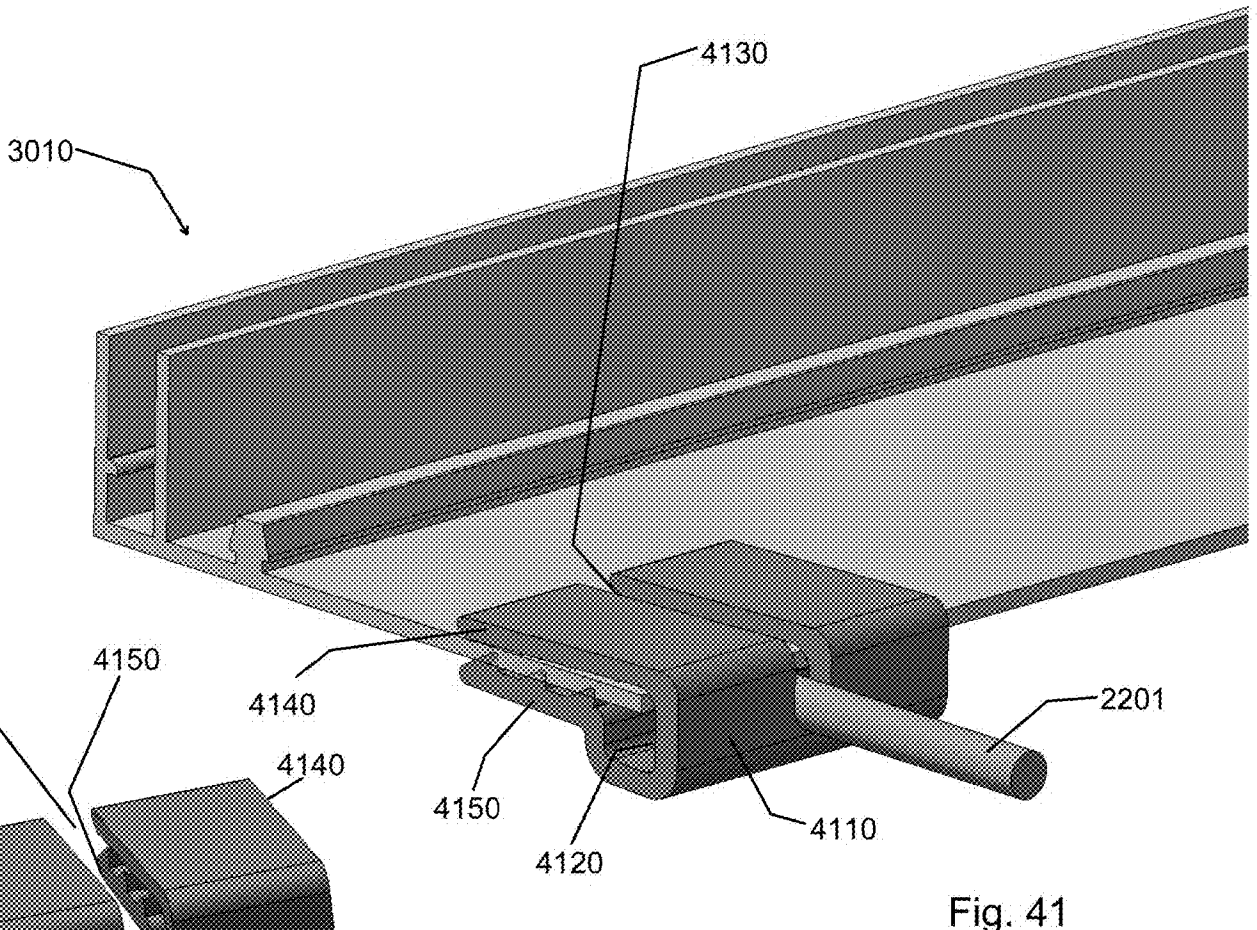
FIG. 41 shows a perspective view of a plastic clip used to lock an extruded aluminum foot to a wire shelf.
Figure 41A:
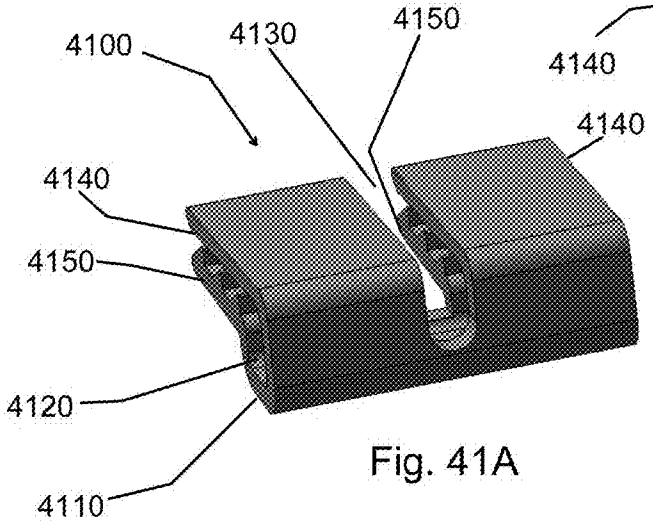
FIG. 41A shows a perspective view of the plastic lock clip of FIG. 41 detached from an extruded aluminum foot and, according to the present disclosure.

FIG. 41 shows a panel clip 4100 that is used to lock a structure (e.g., front foot 2220 or rear foot 2220) to a wire (e.g., wire 2201) of wire shelf 2200. Panel clip 4100 includes a base 4110, a U-channel 4120, a slot 4130, an upper jaw 4140 and a lower jaw 4150. U-channel is sized and configured to provide sufficient depth to accommodate the "depth" of wire 2201 in slot 4130. Slot 4130 is sized and configured to provide sufficient width to accommodate the "width" of wire, as shown in FIG. 41. Upper jaw 4140 and lower jaw 4150 are sized and configured to grip front foot 2220 (or rear foot 2220) with sufficient force so that front foot 2220 or rear foot 2220 is held laterally in position on wire shelf 2200. In the embodiment shown in FIG. 41, upper jaw 4140 has a smooth surface adjacent to the top surface of front foot 2220, while lower jaw 4150 has a toothed surface adjacent to the bottom surface of front foot 2220. A toothed surface has been found to improve the gripping strength of upper jaw 4140 and lower jaw 4150 of clip 4100.

Figures 42, 42A:
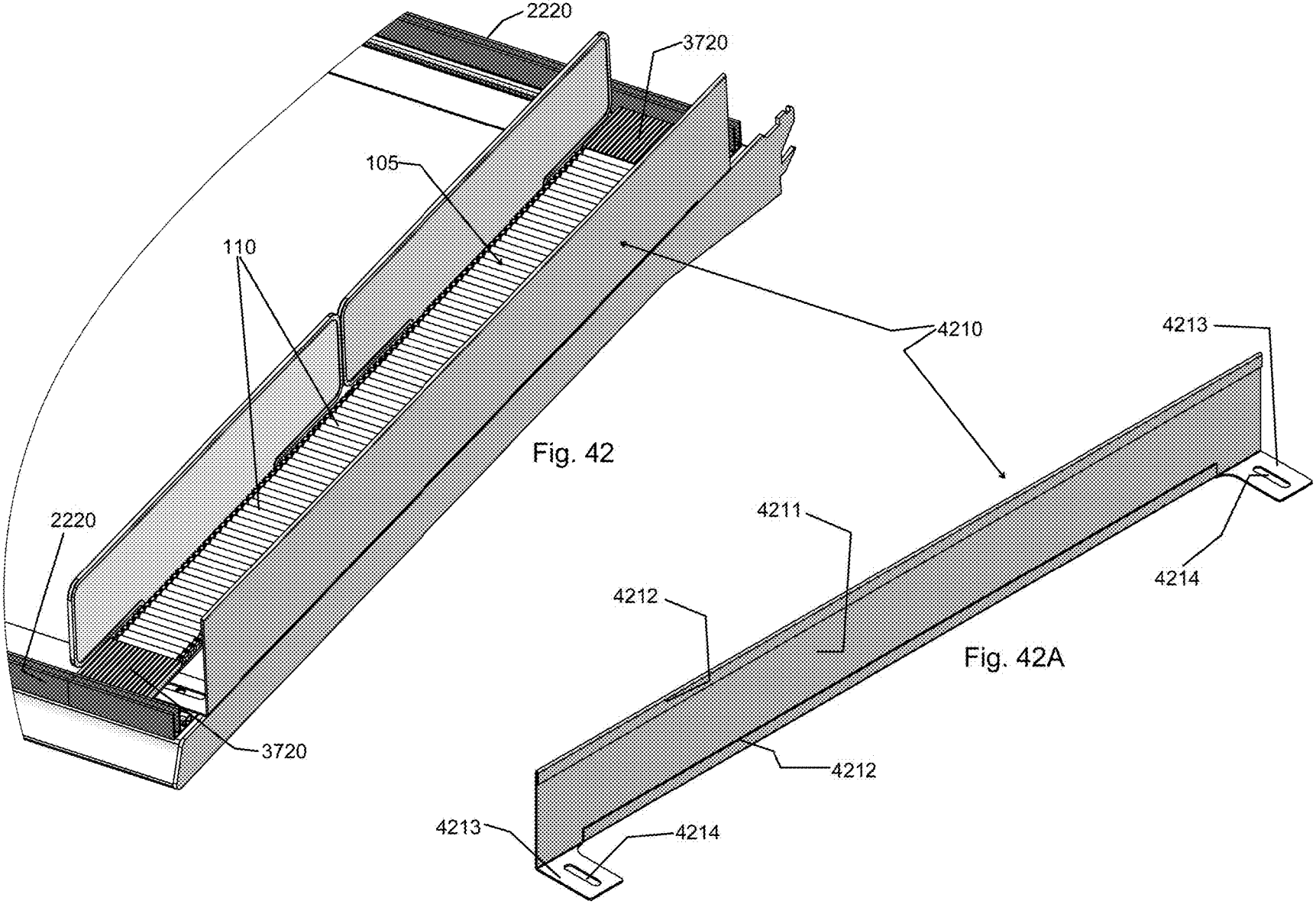
FIG. 42 shows a perspective view of an end divider.
FIG. 42A shows a perspective view of the end divider of FIG. 42 in place on a wire shelf, according to the present disclosure.

FIG. 42 shows a merchandise-advancement mechanism as essentially shown in FIG. 37, the description of which will not be repeated here. FIG. 42A shows an end divider 4210 that can be used at an end of an arrangement of merchandise advancement mechanisms on a wire shelf 2200 or shelf support 150. End divider 4210 includes a divider panel 4211, a plurality of bent edges 4212, and front and rear feet 4213. Each of front and rear feet includes a slot 4214 sized and configured to accept a push pin, such as push pin 1150. Front and rear feet 4213 are sized and configured to be inserted into a space between e.g., front foot and a rear foot 2220 and landing zone 3720. Bent edges 4212 are provided to provide stiffness to end divider 4210, but can be omitted if end divider 4210 is made of sufficiently stiff material or if additional space between rows of merchandise is needed.

Figures 43, 43A, 43B:
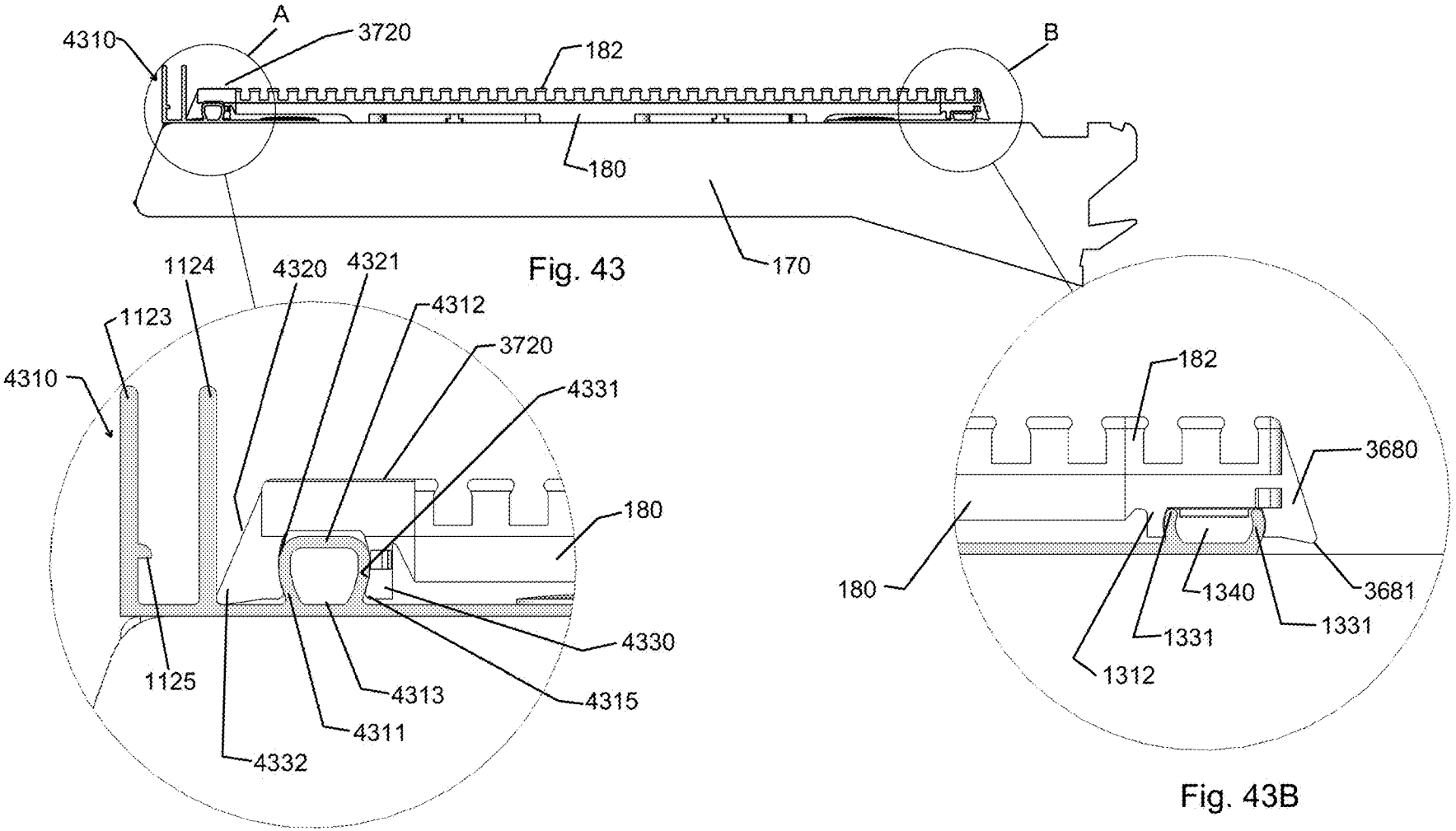
FIG. 43 shows a side view of a roller seat (without rollers) having two different locking systems on a gondola or wire shelf.
FIG. 43A shows a detail view of section "A" of FIG. 43.
FIG. 43B shows a detail view of section "B" of FIG. 43.

FIG. 43 shows that different sized and structured locking mechanisms can be used on the same merchandise-advancement mechanism. In FIG. 43 a roller seat, such as roller seat 180, has disposed thereon roller support bars 182. A front foot 4310 has a locking system shown in detail in FIG. 43A. Front foot 4310 includes a lock arm holder 4311 that, as shown in FIG. 43, has a pear- or heart-shape, i.e., curved sides curving inward from a wider upper surface 4312 to a lower surface 4313 that result in an undercut 4315. Roller seat 180 has a front lock arm 4320 and a rear lock arm 4330. Front lock arm 4320 and rear lock arm 4330 both have a curved inside surface, 4321 and 4331, respectively, that are configured to matingly engage curved sides of lock arm holder 4311. Front lock arm 4320 also includes a locator 4332, the purpose of which has been described in conjunction with other Figures, such as FIG. 36B. FIG. 43B shows a locking system substantially similar to that shown and described with respect to FIG. 36B, and that description will not be repeated here. As mentioned above, FIGS. 43, 43A and 43B serve to illustrate that different sized and structured locking mechanisms can be used according to the present disclosure. In some instances, a larger locking mechanism is desirable because a larger locking mechanism requires more force to lock. This helps to ensure that the roller seat is locked and installed properly.

Figure 44:
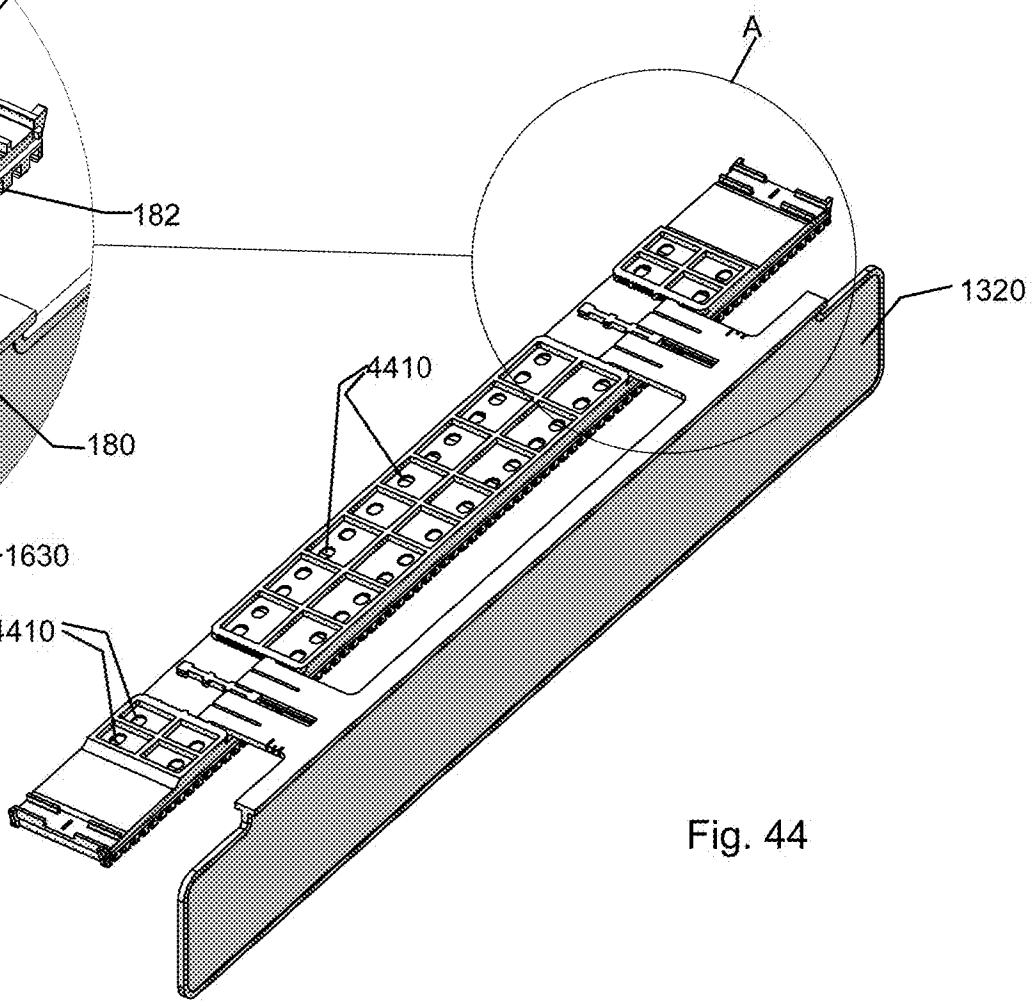
FIG. 44 shows a bottom perspective view of a roller seat (without rollers) having drainage holes.
Figure 44A:
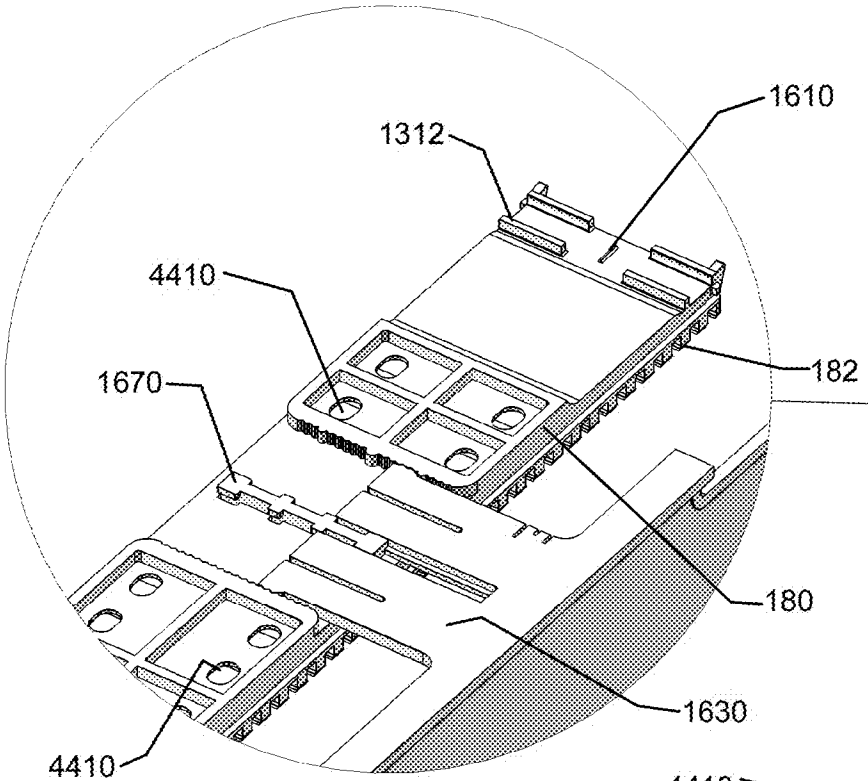
FIG. 44A shows a detailed view of section "A" of FIG. 44.

Drainage of condensation and/or spillage is of concern in merchandise display installations, and particularly in refrigerated merchandise display installations. FIG. 44 shows the addition of drainage holes in a roller seat, such as roller seat 180. The structure shown in FIG. 44 is substantially similar to that shown in FIGS. 16-16A, the description of which will not be repeated here. Also shown in FIG. 44 are drainage holes 4410 are sized and spaced to allow for the water or liquid caused by condensation or leakage due to broken merchandise package. Drainage holes 4410 also assist in cleaning of roller seat 180. Drainage "holes" can be any size or shape of opening, including longitudinal slots parallel to the length of the roller seat. As will be appreciated, drainage can be important for sanitary requirements, particularly for refrigerated display systems.

It should also be noted that the terms "first", "second", "third", "upper", "lower", "front", "rear" and the like may be used herein to modify various elements. These modifiers do not imply a spatial, sequential, or hierarchical order to the modified elements unless specifically stated. Also, it should be understood that where certain materials are mentioned as useful in making one or more of the elements of any embodiment of the present disclosure, it will be understood by those of skill in the art that the selection of material is a mere matter of design choice and/or of the necessary physical attributes of any particular element.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

All of the patents and patent publications referred to herein are Incorporated herein by reference as if fully set forth verbatim in this disclosure.

What is claimed is:

1. A discrete gravity feed merchandise advancement seat comprising a single longitudinal track, wherein said single longitudinal track is comprised of:

a base comprising: a top, a bottom, a width having two sides, a length having two ends, and a pair of oppositely disposed merchandise advancement mechanism retention elements disposed on the top along at least a portion of the length;

a gravity feed merchandise-advancement mechanism having a surface configured to accept merchandise disposed in association with the merchandise advancement mechanism retention elements; and at least one attachment element integral with the base, wherein the at least one attachment element is connected via a snap-fit connection with at least one complementary attachment element disposed on a shelf element selected from the group consisting of: a front stop, a front foot, a rear stop and a rear foot, wherein snap-fit connection is provided by attachment elements and complementary attachment elements selected from the group consisting of: (a) a plurality of snap-in teeth attachment elements disposed on the base that engages a plurality of acceptor complementary attachment elements disposed on the shelf element or disposed on a structure attached to the shelf element; (b) a C-shaped attachment element disposed on the base that engages a rod-like complementary attachment element disposed on the shelf element; and (c) a pair of locking flange attachment elements disposed on the base that matingly engage a pair of lock rod holder complementary attachment elements, wherein the snap-fit connection allows lateral movement of the base relative to the shelf element less than the width of the base; and a first landing zone disposed proximal one end of the base comprising a solid plate that fits into the merchandise advancement mechanism retention element and a plurality of curved ribs disposed on the solid plate that allows merchandise to glide along a top surface of the plurality of curved ribs and onto the surface of the gravity feed merchandise-advancement mechanism.

2. The discrete gravity feed merchandise advancement seat according to claim 1, wherein the merchandise advancement mechanism retention elements are selected from the group consisting of respective first and second support bars, respective first and second base C-channels and any combinations thereof.

3. The discrete gravity feed merchandise advancement seat according to claim 1, wherein the gravity feed merchandise advancement mechanism is selected from a plurality of rollers, a gliding rib bed comprised of a plurality of gliding ribs, and any combinations thereof.

4. The discrete gravity feed merchandise advancement seat according to claim 1, wherein the at least one attachment element is attached to the at least one complementary connector element disposed on the front foot or on the rear foot.

5. The discrete gravity feed merchandise advancement seat according to claim 1, wherein one of the at least one attachment elements is disposed at each end of the length of the base.

6. The discrete gravity feed merchandise advancement seat according to claim 5, wherein the attachment elements are positioned so that the base is symmetrical along the length from one end to the other.

7. The discrete gravity feed merchandise advancement seat according to claim 1, further comprising a merchandise gravity driver disposed on the top of the discrete gravity feed merchandise advancement seat, wherein the gravity driver includes C-shaped guide channels comprised of an upper side disposed substantially parallel to lower offset portions that are connected by substantially vertical side walls, wherein the lower offset portion is shorter than the upper side and engages an undercut disposed along each side of the merchandise advancement mechanism retention elements.

8. The discrete gravity feed merchandise advancement seat according to claim 7, wherein the driver is comprised of:

a driver deck having a top, a gridded bottom, a front edge, a rear edge and two sides; and a merchandise guide disposed on the top of and above the driver deck, wherein the merchandise guide comprises a vertical container box that holds a weight therein and a cap that includes a front surface and a front bottom edge, wherein the front surface is disposed at an angle of between about 3 to about 10 degrees relative to the vertical container box and toward the rear edge, wherein the front bottom edge of the cap coincides with the front edge of the driver deck, and wherein the rear edge of the driver deck extends rearward of the vertical container box.

9. The discrete gravity feed merchandise advancement seat according to claim 8, wherein the offset portion is disposed along a portion of each of the guide channels.

10. The discrete gravity feed merchandise advancement seat according to claim 1, further comprising at least one divider, wherein the divider is attached to the base by an attachment selected from the group consisting of fixedly attached to the base, removably attached to the base and adjustably attached to the base.

11. The discrete gravity feed merchandise advancement seat according to claim 10, wherein the divider is removably attached to the base, wherein the discrete gravity feed merchandise advancement seat further comprises a divider receiving element comprised of at least one slot disposed on the top, and wherein the divider comprises at least one tab that mates with the at least one slot disposed on the top.

12. The discrete gravity feed merchandise advancement seat according to claim 10, wherein the divider is adjustably attached to the base, wherein the discrete gravity feed merchandise advancement seat further comprises a divider receiving element comprised of at least one slot disposed on the bottom, and wherein the divider comprises at least one foot-like element that laterally and adjustably mates with the at least one slot on the bottom.

13. The discrete gravity feed merchandise advancement seat according to claim 1, further comprising at least one opening through the base from the bottom to the top, wherein the at least one opening allows liquid to drain through the base.

14. The discrete gravity feed merchandise advancement seat according to claim 1, further comprising a locator integral with and proximal to at least one end of the length, wherein the locator allows correct placement of the gravity feed merchandise advancement seat in relation to the front foot and a stop protrusion integral with and proximal to at least one end of the length, wherein the stop protrusion serves to limit the forward and/or rearward movement of a merchandise gravity driver disposed on the top of the discrete gravity feed merchandise advancement seat.

15. The discrete gravity feed merchandise advancement seat according to claim 14, comprising a locator disposed at each end of the base, wherein two bases of two of said discrete gravity feed merchandise advancement seats are connected end-to-end using a seat connector, wherein the seat connector comprises:

a connector base having a top, a bottom, a length with two ends and a width;

two transverse edges, wherein one transverse edge is disposed proximal each end;

a rod disposed between the two transvers edges; and two sets of lock rod holders, wherein one each of the two sets of lock rod holders is disposed between a transverse edge and the rod, wherein each of the two transverse edges, the rod and each of the two sets of lock rod holders is disposed away from the connector base in the same direction, wherein each of the two transverse edges, each of the two sets of lock rod holders and the rod connects with the bottom of each of the two discrete gravity feed merchandise advancement seats, wherein the rod provides a transverse channel across the width of the connector on each side of the rod, and wherein each of the two transverse channels accepts the locator on one each of the two discrete gravity feed merchandise advancement seats.

16. The discrete gravity feed merchandise advancement seat according to claim 1, further comprising a second landing zone disposed proximal the other end of the base.

17. The discrete gravity feed merchandise advancement seat according to claim 16, further comprising an end divider, wherein the end divider comprises;

a divider panel;

a plurality of bent edges;

a front leg;

and a rear leg, wherein each of the front leg and the rear leg includes a slot that accepts a push pin, and wherein each of the front leg and the rear leg is inserted into a space between a front foot and/or a rear foot and a landing zone.

18. The discrete gravity feed merchandise advancement seat according to claim 1, wherein the rod-like complementary attachment element is disposed in lock rod holders disposed on the at least one shelf element, and the lock rod holders matingly engage locking flanges disposed on the base.

19. The discrete gravity feed merchandise advancement seat according to claim 1, wherein attachment element and complementary element (c) further comprises an acceptor disposed on the base that engages spaced apart teeth disposed on a rod-like structure disposed on the shelf element or on a structure attached to the shelf element.

* * * * *